US005347478A

United States Patent [19]

Suzuki et al.

[11] Patent Number: 5,347,478

[45] Date of Patent: Sep. 13, 1994

[54] METHOD OF AND DEVICE FOR COMPRESSING AND REPRODUCING WAVEFORM DATA

[75] Inventors: Hideo Suzuki; Kazuhisa Okamura, both of Hamamatsu, Japan

[73] Assignee: Yamaha Corporation, Japan

[21] Appl. No.: 896,105

[22] Filed: Jun. 9, 1992

[30] Foreign Application Priority Data

Jun. 9, 1991 [JP] Japan ..... 3-163798
Jun. 9, 1991 [JP] Japan ..... 3-163799

[51] Int. Cl.[5] ..... G06F 7/00; G06F 15/31

[52] U.S. Cl. ..... 364/715.02; 364/724.01; 381/35

[58] Field of Search ..... 364/724.01, 715.02; 381/35

[56] References Cited

U.S. PATENT DOCUMENTS 4,406,203 9/1983 Okamoto et al. .
4,449,536 5/1984 Weaver ..... 364/715.02
4,523,276 6/1985 Maejima et al. .
4,654,781 3/1987 Schwartz et al. .
4,755,960 7/1988 Batson et al. ..... 364/715.02
4,777,620 10/1988 Shimoni et al. ..... 364/715.02
4,802,222 1/1989 Weaver ..... 364/715.02
4,809,577 3/1989 Fujita .
4,833,595 5/1989 Hjim .
4,882,754 11/1989 Weaver et al. ..... 381/35
4,885,584 12/1989 Dalrymple .
4,886,636 9/1989 Fukami et al. .
4,916,996 4/1990 Suzuki et al. .
5,081,897 1/1992 Takauji .
5,113,740 5/1992 Saito .

FOREIGN PATENT DOCUMENTS 60-97741 5/1985 Japan ..... 364/715.02
60-97742 5/1985 Japan ..... 364/715.02
62-102614 5/1987 Japan ..... 364/715.02

*Primary Examiner*—Tan V. Mai
*Attorney, Agent, or Firm*—Graham & James

[57] ABSTRACT

To waveform data is applied not only a predetermined data compression processing but also a processing for further reducing the value of waveform data in accordance with a weight coefficient, which processing is performed at least at one stage selected from a stage before the data compression processing is performed, a stage when the data compression processing is being performed and a stage after the data compression processing has been completed. Data compression can thereby be performed to a further degree. A control for changing the rate of reduction or for not changing such rate at all can be made in a simple manner merely by changing the weight coefficient without changing the predetermined data compression processing system. Waveform sample data or tone control data consisting of multiple samples may be divided into plural sections each consisting of plural samples and a maximum value of effective bit number of sample data for each section may be detected. These sample data may be adjusted, for each section, to have a bit number corresponding to the detected maximum value for each section and the bit-number-adjusted sample data may be stored in a memory. Memory elements necessary for effective bits of data only are thereby occupied and unnecessary memory elements are not occupied and, therefore, saving of memory capacity and effective use of a memory can be realized.

52 Claims, 21 Drawing Sheets

PREPARING OF WAVEFORM TO BE COMPRESSED:
- ORIGINAL WAVEFORM IS SAMPLED OR TRANSFERRED FROM EXTERIOR
- ORIGINAL WAVEFORM MAY BE SUBJECTED TO NECESSARY TREATMENT

⇩

COMPRESSING AND STORING OF WAVEFORM DATA:
- VARIOUS "DATA SETTING" PROCESSINGS:
  - READ ADDRESS SETTING
  - WRITE ADDRESS SETTING
  - SETTING OF A LIMITTED NUMBER OF BITS IN ONE SAMPLE DATA
  - SETTING OF A WEIGHT COEFFICIENT (SHIFT DATA)
- DATA COMPRESSION AND REDUCTION PROCESSINGS:
  - DATA COMPRESSION PROCESSING BY PRED. DATA COMP. TECH.
  - DATA REDUCTION PROCESSING BY WEIGHT COEFFICIENTS
- TREATING WAVEFORM SAMPLE DATA TO VARIABLE-BIT-LENGTH FORM:
  - MAX. VALUE OF EFFECTIVE BIT NUMBER DETECTED FOR EACH FRAME
- PROCESSING FOR WRITING IN A MEMORY WAVEFORM SAMPLE DATA:
  - DATA OF VARIABLE-BIT-LENGTH ARE STORED IN A PACKED FASHION
  - VARIOUS CONTROL DATA ARE STORED AS HIDDEN BIT DATA

⇩

REPRODUCTION PROCESSINGS:
- SETTING OF VARIOUS PARAMETERS FOR TONE GENERATION
- READING WAVEFORM SAMPLE DATA FROM THE MEMORY:
  - DATA OF VARIABLE-BIT-LENGTH ARE ALTERED TO UNIFORM-BIT-LENGTH
  - HIDDEN BIT DATA ARE SEPARATED
- DEMODULATING COMPRESSED DATA TO DATA HAVING PREDET. CODED FORM
- RESTORING REDUCED DATA TO DATA OF UNIFORM WEIGHT
- SOUNDING

FIG. 1

ENTIRE PROCESSING FROM COMPRESSION TO WRITING

DATA COMPRESSION FILTER OPERATION

COMPRESSION FILTER SECTION 48

VARIABLE BIT LENGTH ADJUSTING & WRITING PROCESSING

DATA FORMAT OF WAVEFORM SAMPLE DATA AND HIDDEN BIT DATA

DATA TAKEOUT & REPRODUCTION SECTION 96

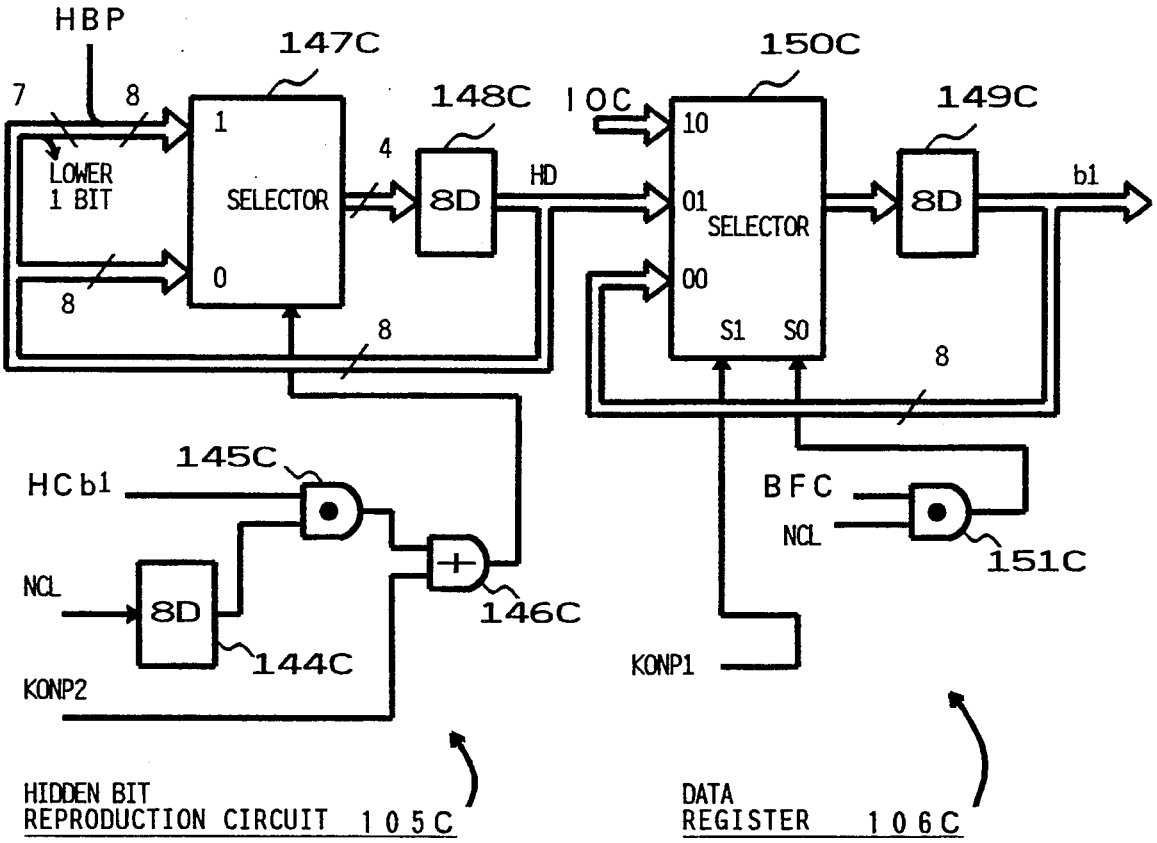
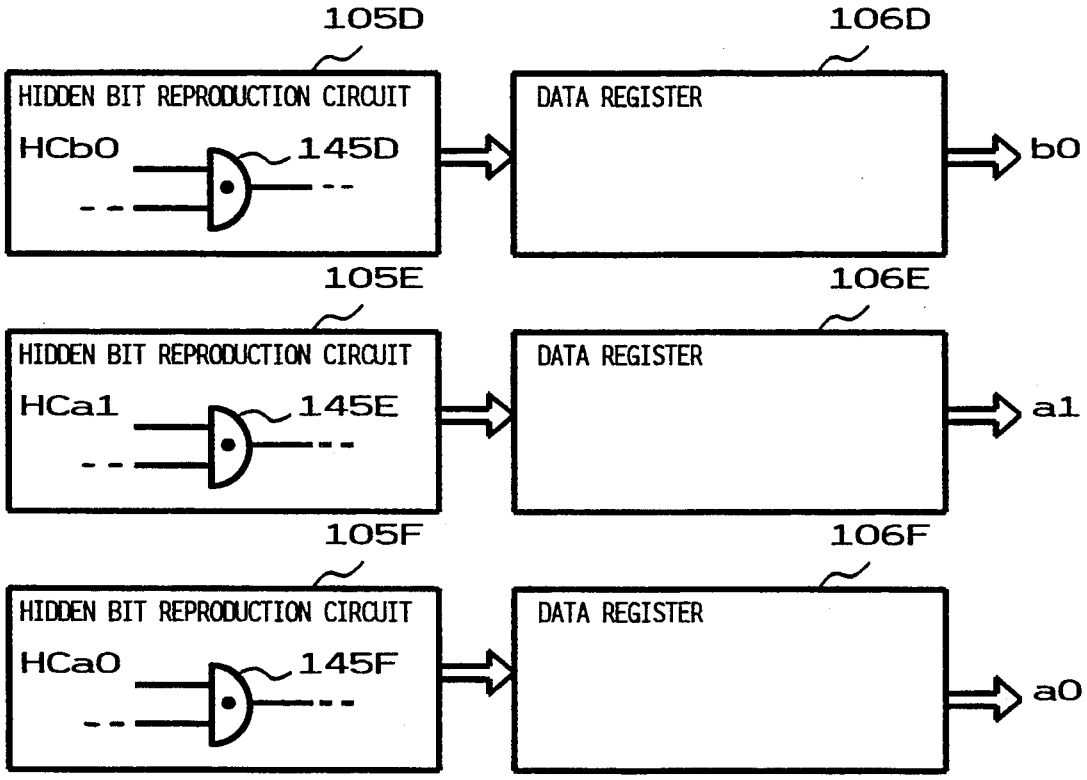
FIG.23

DATA COMPRESSION FILTER OPERATION (SECOND EMBODIMENT)

METHOD OF AND DEVICE FOR COMPRESSING AND REPRODUCING WAVEFORM DATA

BACKGROUND OF THE INVENTION

This invention relates to a method for compressing waveform data and a device therefore and a device for reproducing waveform data which are available for use in an electronic musical instrument or other tone generation device or a sound signal processing device.

This invention further relates to a method for compressing various waveform data such as a tone source waveform, sound signal waveform or control signal waveform and further relates to a method for compressing various digital data used for tone generation or tone control.

As a method for producing a tone source waveform in an electronic musical instrument, there is a method of sampling and storing a tone which has been actually acoustically sounded by, e.g., a natural musical instrument (e.g., Japanese Laid-open Patent Publication Nos. 54-161313, 62-89093 and 62-94896 etc.). Such external tone sampling system is advantageous in that a tone waveform of a high quality which is equivalent to tone of a natural musical instrument can be obtained but it requires a waveform memory of a large capacity, it must deal with a large amount of waveform data.

For simplifying a memory and circuits and devices relating to the memory, compression of waveform data has been proposed. For example, U.S. Pat. No. 4,916,996 which corresponds to Japanese Laid-Open Patent Publication No. 62-242993 discloses storing of tone waveform data which is compressed by the linear prediction method (LPC). Japanese Patent Publication No. Hei 1-45078 discloses expressing and storing waveform sample data in a floating-point representation consisting of a mantissa section and an exponent section. It is also known that data compression is performed using not only the PCM coding system but other coding systems such as DPCM, ADPCM and delta modulation as a data coding system. U.S. Pat. No. 4,809,577 also discloses a waveform data compression technique.

In the prior art waveform data compression technique, however, waveform data is compressed simply in accordance with a predetermined compression processing resulting in a uniform data compression. It is therefore difficult in the prior art technique to further perform data compression and particularly to perform data compression to a further degree in only a section of a waveform or to perform data compression in different degrees in different sections of a waveform. It is sometimes desired to perform data compression in a different manner in different sections of a waveform in such a manner that, for example, a normal data compression is performed in a section such as an attack portion in which accuracy of waveform should be secured and data compression is performed to a further degree in a section in which accuracy of waveform may be sacrificed. It is not possible to achieve such data compression performed in a different manner depending upon a section of a waveform.

In a data memory device using such data compression method as well as a data memory device storing data of the conventional PCM coding system, data is stored in one-to-one relation in each individual memory address and data length (data size, i.e., a bit number constituting one data) of data to be stored is fixed to a constant value. It is normal, for example, that one data is stored with a data length of 16 bits in an address of 16 bits. There is a special case where an address of 16 bits, for example, is divided into two sections each having 8 bits and two different 8-bit data are stored in the divided address sections. In this case also, data to be stored is of a fixed bit length of 8 bits.

As described above, in the prior art technique, data is stored with a fixed bit length and, therefore, a memory element is wasted in the case of storing data whose effective bit number is shorter than the fixed bit length. In a case, for example, where tone waveform data is to be stored in a manner to cover a maximum amplitude value with a fixed bit length of 16 bits, there occurs a case where the effective bit number is only two or three bits at a sample point of a small amplitude value and, therefore, a memory element for 13 bits or 14 bits per one address is wasted. The number of such memory elements wasted in the above described manner amounts, when totalled, to a number which cannot be neglected and, as a whole, constitutes a factor which prevents an efficient use of the memory device and also prevents reduction of the size of the entire circuitry and reduction of the manufacturing cost.

Japanese Laid open Patent Publication No. Hei 3-180896 (corresponding to U.S. patent application Ser. No. 07/623,129) discloses storing tone data in a memory in the form of data with a variable bit length. In this technique, however, it is not disclosed what specific method or means should be employed to produce data of variable bit length.

SUMMARY OF THE INVENTION

It is, therefore, a first object of the invention to provide a method for compressing data and a device therefore capable of facilitating data compression and controlling data compression freely with a simple circuit design.

It is a second object of the invention to provide a device for reproducing waveform data which is compressed in accordance with such data compression method.

It is a third object of the invention to improve a data compression method for compressing digital waveform data and other digital data for tone generation or tone control in order to reduce the number of wasted memory elements and thereby realize an efficient use of the memory device.

For achieving the first object of the invention, a method for compressing waveform data comprises a first step for providing waveform data to be compressed, a second step for performing a predetermined data compression processing to the waveform data, and a third step for performing a processing for further reducing a value of the waveform data in accordance with a desired weight coefficient, at least at one stage selected from a stage before the data compression processing is performed, a stage when the data compression processing is being performed and a stage after the data compression processing has been completed.

According to the method for compressing waveform data, a predetermined data compression processing is performed on the waveform data in the second step. The predetermined data compression processing may be performed by the linear prediction method or any other data compression system. It is a feature of the invention to provide the third step in which a processing for further reducing the value of waveform data in accordance with a desired weight coefficient at least at one stage selected from a stage before the data compression processing, a stage when the data compression processing is being performed and a stage after the data compression processing has been completed. By this data reduction processing, the value of the waveform data which has been compressed by the data compression processing is further reduced whereby a further data compression can be realized. Moreover, a control for changing the rate of reduction by changing the weight coefficient or not changing the rate of reduction at all can be made freely and easily. Accordingly, in a case where data compression is to be performed to a further degree in a certain section of a waveform or data compression is to be performed to different degrees in different sections of a waveform, such performance of data compression can be realized simply by changing the weight coefficient in the third step without changing the predetermined data compression processing system in the second step. Since the third step is a very simple step of reducing the value of waveform data in accordance with a desired weight coefficient (this processing can be realized by a data shifting or a suitable operation of coefficient such as division or multiplication), the circuit design can be a simple one.

Several manners of carrying out the method for compressing waveform data according to the invention will be described below.

The processing of the third step may be performed at a stage before the second step and the data compression processing may be performed by using a data compression filter in the second step. By this arrangement, discontinuity or noise component which may be produced by the data reduction processing can be absorbed by the compression filter provided in the post stage.

The third step may be performed at a stage after the second step and the data compression processing may be performed by using a data compression filter in the second step.

In the third step, a series of waveform data may be divided into plural sections and the processing for further reducing the value of the waveform data may be performed for each of the sections in accordance with a weight coefficient which is set independently for each of the sections. By this arrangement, in a case where it is desired to differentiate the degree of waveform compression in a desired section in the entire tone generation period (e.g., when it is desired to differentiate the degree of waveform compression between an attack portion and a sustain portion), such differentiation in the degree of data compression can be realized simply by changing the weight coefficient without changing the predetermined data compression processing, so that the method is simple and advantageous.

A bit number data designating a limited number of bit in one sample data may be further provided for each of the sections and the weight coefficient for each of the sections may be set in such a manner that data for each of the sections after the data compression and reduction processings have been completed is of a bit number designated by said bit number data for the section. By this arrangement, the bit number of waveform data can be controlled readily to a desired bit number for each desired section in the entire tone generation period, so that this arrangement is advantageous for producing and controlling waveform data and a waveform memory can be efficiently utilized. Moreover, this arrangement is advantageous in that the weight coefficient for each section can be automatically set.

The data reduction processing in the third step may be performed by data shifting. This is advantageous in that the operation of weight coefficient can be made by simple data shifting.

The data compression processing in the second step may be performed by a two-stage compression filter, and the second step may comprise a coefficient preparation step for preparing filter coefficients to be used in the compression filter by a linear prediction method. This coefficient preparation step may comprise a step for multiplying waveform data to be applied to a first stage of the compression filter with a humming window function, calculating a first linear prediction coefficient on the bas is of self-correlation coefficient which is a result of the multiplication and providing the first linear prediction coefficient as a filter coefficient of the compression filter of the first stage, a step for performing the waveform data compression processing by the compression filter of the first stage, using the first linear prediction coefficient as the filter coefficient of the compression filter of the first stage, and a step for multiplying output waveform data of the compression filter of the first stage with a humming window function, calculating a second linear prediction coefficient on the basis of self-correlation coefficient which is a result of the multiplication and providing the second linear prediction coefficient as a filter coefficient of the compression filter of the second stage. By the operation of humming window function of two stages, an accurate filter coefficient can be produced.

The method may further comprise a fourth step for storing in a memory waveform data on which the data compression processing and the data reduction processing have been performed, and a fifth step for generating and storing, data indicating a memory position of the series of waveform data in the memory, when the data compression processing and the data reduction processing for a series of waveform data have been completed. The indication of a memory position of a series of waveform data can be made by identifying a start address, indicating an entire address size or indicating an end address. The entire size (capacity) of a series of waveform data becomes unpredictable because of the data compression and reduction processings but, by this arrangement, the entire size is automatically detected by the generation and storing of such memory position indicating data, so that this is advantageous for reading and reproduction of data in a later stage.

For achieving the first object of the invention, a waveform data compression device capable of carrying out the waveform data compression method according to the invention comprises reduction operation means for inputting waveform data to be compressed and performing an operation for reducing a value of the waveform data in accordance with a desired weight coefficient, compression filter means for inputting waveform data provided by the reduction operation means and performing a data compression processing on the waveform data, and coefficient generation means for producing a filter coefficient to be used in the compression filter means by a linear prediction method and supplying the filter coefficient to the compression filter means.

According to this waveform data compression device, the reduction operation means is provided in a stage prior to the compression filter means and the data compression processing is performed by using the compression filter in accordance with the linear prediction method. The reduction operation means inputs waveform data to be compressed and performs an operation for reducing the value of the waveform data in accordance with a desired weight coefficient. The compression filter means inputs waveform data provided by the reduction operation means and applies the data compression processing to the waveform data. The filter coefficient used by the compression filter means is produced by the coefficient generation means in accordance with the linear prediction method. Discontinuity of the data value which may be produced by the data reduction processing by the reduction operation means (e.g., the data value sometimes becomes discontinuous at a border line between weight coefficients when the weight coefficient has changed) can be absorbed by the compression filter means provided in the post stage.

For achieving the first object of the invention, another waveform data compression device capable of carrying out the waveform data compression method according to the invention comprises compression filter means for inputting waveform data to be compressed and performing a data compression processing on the waveform data, reduction operation means for performing an operation for reducing a value of waveform data provided by the compression filter means in accordance with a desired weight coefficient, and coefficient generation means for producing a filter coefficient to be used by the compression filter means by a linear prediction method and supplying the filter coefficient to the compression filter means.

According to this waveform data compression device, the reduction operation means is provided in a post stage of the compression filter means. In this case, for absorbing discontinuity and error in the data value which may be produced in the data reduction processing by the reduction operation means, the compression filter means may further comprise the operation means for inputting the output of the reduction operation means and expanding and restoring the value of the output waveform data of the reduction operation means and the operation of the compression filter coefficient may be applied to the restored data.

Several manners of carrying out the waveform data compression device according to the invention will be described below.

The compression filter means may divide a series of waveform data into plural sections and perform the data compression processing for each of the sections in accordance with a filter coefficient which is set independently for each of the sections. The device may further comprise memory means for temporarily holding data which is held in a delay section of the compression filter means when the data compression processing for one section has been completed, and control means for reading, when the data compression processing is re-performed with respect to a certain section, data for an immediately preceding section held by the memory means and setting the read out data in the delay section of the compression filter means for enabling the re-performing of the data compression processing. By this arrangement, the compression processing can be re-performed any desired number of times to obtain an optimum data compression. In this case, the signal state in the delay section of the compression filter concerning an immediately preceding section can be reproduced whereby an accurate compression filter operation can be performed no matter how many times the operation is re-performed.

A series of waveform data may be divided into plural sections and the reduction operation means may perform the data reduction processing independently for each of the sections in accordance with a weight coefficient which is set independently for each of the sections. The device may further comprise memory means for storing waveform data for each of the sections on which the data compression processing and the data reduction processing have been performed and also storing the weight coefficient for each of the sections. This is advantageous because, when the reduced data restored to the original state, weight is coefficient for each section is read from the memory means and used for the restoration operation.

In the memory means, the weight coefficient for each of the sections may be stored in a part of a memory region storing waveform data for a preceding section. This is advantageous because, in the restoration operation, a weight coefficient of a next section can be read out during reading of waveform data of a preceding section and this weight coefficient can be used as a weight coefficient for the restoration operation during reading of the waveform data of the next section, so that a control can be made in a simple and accurate manner.

The compression filter means may perform the data compression processing independently for each of the sections in accordance with a filter coefficient which is set independently for each of the sections, and the memory means may further store the filter coefficient for each of the sections in a part of a memory region storing waveform data for a preceding section. This is advantageous because, in the demodulation operation of compressed data, a compression filter coefficient for a next section can be read out during reading of waveform data of a preceding section and this compression filter coefficient can be used as compression data demodulation coefficient for the next section during reading of waveform data for the next section, so that a control can be made in a simple and accurate manner.

The device may further comprise setting means for setting a desired bit limiting number which designates a limited number of bits in one sample data, and control means for automatically setting the weight coefficient in such a manner that data after the data compression processing and the data reduction processing is of a bit number designated by said bit limiting number. This arrangement is advantageous for production and control of waveform data because the bit number of waveform data can be easily controlled to a desired number. This arrangement is also advantageous because the weight coefficient can be automatically set.

The control means may set the weight coefficient to a predetermined value to perform the data compression processing and the data reduction processing and, when data after the data compression processing and the data reduction processing is of a bit number which is not within said bit limiting number, may change the weight coefficient automatically to re-perform the data compression processing and the data reduction processing. This arrangement is advantageous because an optimum weight coefficient can be automatically set.

For achieving the second object of the invention, a waveform data reproduction device according to the invention comprises waveform memory means for storing waveform data on which a predetermined data compression processing and a data reduction processing executed in accordance with a weight coefficient have been performed, supply means for supplying a first coefficient to be used for demodulating waveform data and a second coefficient to be used for restoring a data value of waveform data to an original value thereof, compressed data demodulation means for applying a data demodulation processing to waveform data read from the waveform memory means in accordance with the first coefficient supplied by said supply means, and operation means for applying to waveform data read from the waveform memory means an operation for restoring, in accordance with said second coefficient supplied by said supply means, a data value of said waveform data to an original value thereof.

According to the waveform reproduction device according to the invention, the waveform memory means stores waveform data on which the predetermined data compression processing and the data reduction processing in accordance with the weight coefficient have been performed. The device comprises not only the compressed data demodulation means for applying the data demodulation processing to waveform data read from the waveform memory in accordance with the first coefficient but also the operation means for applying to the waveform data read from the memory means the operation for restoring the data value of said waveform data in accordance with the second coefficient. By this arrangement, waveform data to which the data compression processing and the data reduction processing have been applied can be accurately demodulated and reproduced.

The waveform memory means may store said first and second coefficients together with the waveform data and said supply means may separate and take out the first coefficient and the second coefficient from output data read from the waveform memory means. This arrangement is advantageous from the standpoint of saving of the memory capacity because the waveform memory can be used efficiently without waste.

For achieving the third object of the invention, a waveform data compression method in an aspect of the invention comprises a first step for providing digital waveform sample data consisting of multiple samples each of which is data of a predetermined bit number, a second step for dividing the waveform sample data into plural sections each consisting of plural samples and detecting a maximum value of effective bit number of the waveform sample data for each of the sections, and a third step for adjusting the waveform sample data provided by the first step in such a manner that waveform sample data for each of the sections has a bit number corresponding to the maximum value which has been detected for each of the sections in the second step and for storing the bit-number-adjusted waveform sample data in memory means.

According to this waveform data compression method, in the second step, waveform sample data consisting of multiple samples is divided into plural sections each consisting of plural samples and a maximum value of effective bit number of the waveform sample data is detected for each section. In the third step, these waveform sample data are adjusted to have a bit number corresponding to the detected maximum value for each section and waveform sample data which has been adjusted in its bit number for each section is stored in the waveform memory. Therefore, waveform data which consists of continuous multiple samples such as tone waveform data from the start of generation of a tone to the end thereof is divided into plural sections and each of the waveform sample data thus divided into sections is adjusted in its data bit size to a variable bit length corresponding to the maximum value of effective bit number for each section and the waveform data which has thus been adjusted to data of variable bit length is stored in the memory. By adopting the data compression processing in which waveform data is processed to data of variable bit length, the data size, i.e., bit length, of the waveform data to be stored in the memory is not fixed but can be varied as desired. Accordingly, memory elements which are necessary for effective bits of waveform data only are occupied and unnecessary memory elements need not be occupied. Alternatively stated, spare memory elements are not occupied in waste but can be used for storing other data, so that saving of the memory capacity and effective use of the memory can be realized.

The method may further comprise a fourth step for storing data indicating the bit number for each of the sections. In the fourth step, the data indicating the bit number for each of the sections may be stored in a part of a memory region in the memory means storing waveform sample data for a preceding section.

In the method for achieving the third object of the invention, the method may further comprise a fifth step for performing a data compression processing on the waveform sample data provided by the first step, and in the second step, the processing for detecting the maximum value of effective bit number may be performed for the waveform sample data which has been compressed in the fifth step.

For achieving the third object of the invention, a waveform data compression method in another aspect of the invention comprises a first step for providing digital waveform sample data consisting of multiple samples each of which is data of a predetermined bit number, a second step for dividing the waveform sample data into plural block sections each consisting of plural samples and for performing a data compression processing for each of the block sections, a third step for dividing the compressed waveform sample data of each of the block sections into plural frame sections each consisting of plural samples and for detecting a maximum value of effective bit number of compressed waveform sample data for each of the frame sections, and a fourth step for adjusting the compressed waveform sample data provided by the second step in such a manner that waveform sample data for each of the frame sections has a bit number corresponding to the maximum value which has been detected for each of the frame sections in the third step and for storing the bit-number-adjusted waveform sample data in memory means.

According to the waveform data compression method in this aspect of the invention, the above described variable bit length adjusting processing is applied to waveform sample data to which a normal predetermined data compression processing (e.g., data compression processing by LPC method) has been applied. In this case, the variable bit length adjusting processing is applied for each frame section which is a finer division than a block section. Since the variable bit length adjustment processing can be made only by detecting the maximum value of effective bit number, this adjustment is simpler than a normal predetermined data compression processing and is more suitable for application in a fine frame section than the predetermined data compression processing. By combination of these two processings, further reduction in the data size can be realized with a relatively simple circuit design.

The waveform data compression method according to this aspect of the invention may further comprises a fifth step for further reducing a value of the waveform sample data in accordance with a desired weight coefficient for each of the block sections, at least at one stage selected from a stage before the data compression processing is performed, a stage when the data compression processing is being performed and a stage after the data compression processing has been completed. The method may further comprise a sixth step for storing a data compression coefficient and weight coefficient for each of the block sections and also storing data indicating a bit number for each of the frame sections. In the sixth step, the data compression coefficient and weight coefficient for each of the block sections may be stored, in the memory means, in a part of a memory region storing waveform sample data for a block section which precedes the block section and the bit number indicating data for each of the frame sections is stored, in the memory means, in a part of a memory region storing waveform sample data for a preceding frame section.

For achieving the third object of the invention, a method for compressing digital data for a tone generation or a tone control comprises a first step for providing digital data for a tone control consisting of multiple samples each of which is data of predetermined bit number, a second step for dividing the digital data into plural sections each consisting of plural samples and for detecting a maximum value of effective bit number of the digital data for each of the sections, and a third step for adjusting the digital data provided by the first step in such a manner that the digital data for each of the sections has a bit number corresponding to the maximum value which has been detected for each of the sections in the second step and for storing the adjusted digital data in memory means. The method may further comprise a fourth step for performing a data compression processing on the digital data provided by the first step and wherein, in the second step, the processing for detecting the maximum value of effective bit number is performed on the digital data which has been compressed in the fourth step.

According to the digital data compression method for tone control, the variable bit length adjusting processing which is the same as described above can be applied to not only to waveform data but to various digital data for tone control whereby, for the same reason as described above, saving of memory capacity and efficient use of a memory storing these digital data for tone control can be realized.

Embodiments of the invention will be described below with reference to the accompanying drawings.

BRIEF DESCRIPTION OF THE DRAWINGS

In the accompanying drawings,

FIG. 1 is a diagram showing schematically the entire flow of the waveform data compression and reproduction processings in an embodiment of the invention;

FIG. 23 is a block diagram showing another specific example of the hidden bit reproduction circuit and the data register in FIG. 16;

DESCRIPTION OF PREFERRED EMBODIMENTS

Figure 2:
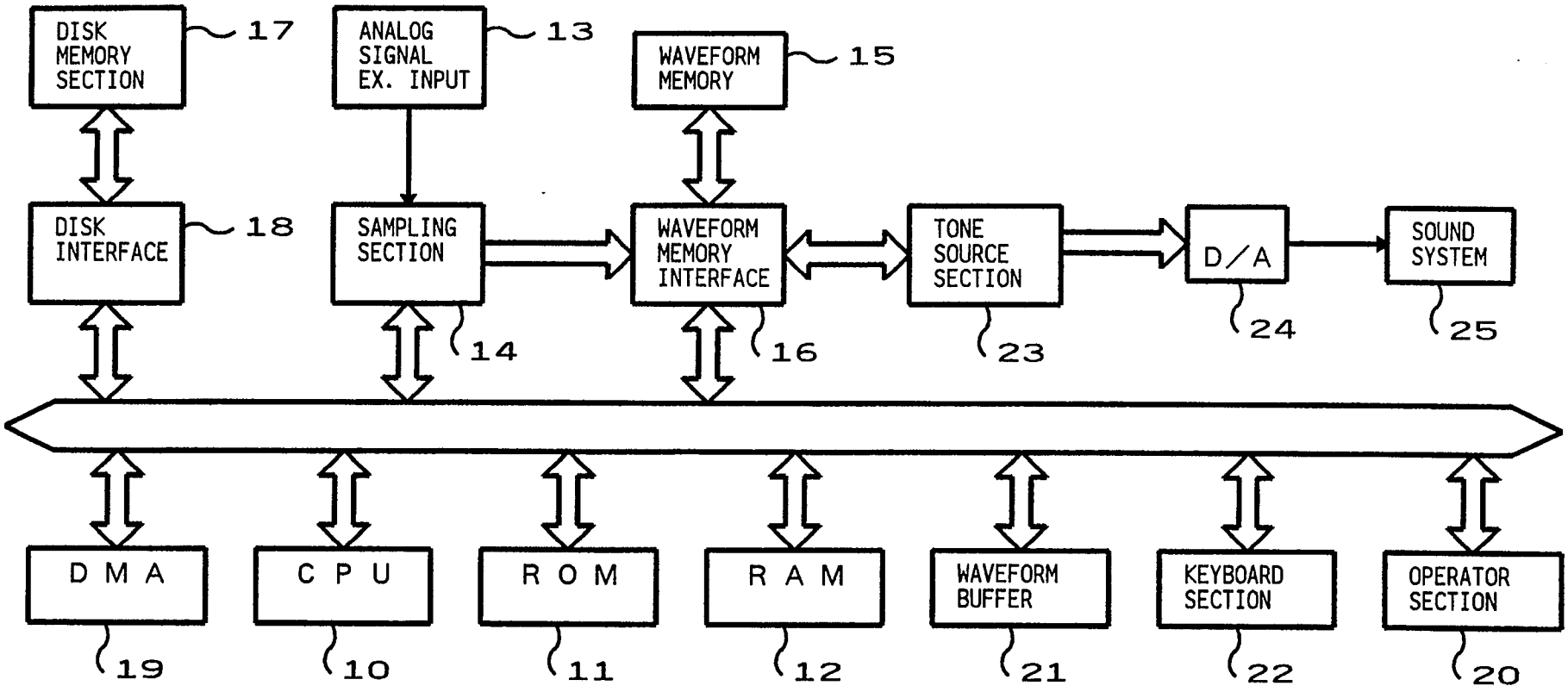
FIG. 2 is a block diagram showing an example of hardware construction of an electronic musical instrument which can be used for carrying out the waveform data compression and reproduction processings according to the invention.

Outline of Flow of the Entire Compression and Reproduction Processings of Waveform Data Referring first to FIG. 1, flow of the entire compression and reproduction processings of waveform data in one embodiment of the invention will be described.

First, a waveform to be compressed is prepared. For preparing this waveform, for example, an original waveform produced by a natural musical instrument is sampled and stored, or alternatively, a desired original waveform which has already been stored in an external memory or the like device is transferred from the external memory or the like.

The sampled original waveform may be subjected to a compression processing after being subjected to necessary treatments instead of using it directly as a waveform to be compressed. Such treatments include, for example, a processing for extracting an amplitude envelope of the original waveform, a processing for removing an amplitude envelope from the original waveform and standardizing the amplitude level to a uniform level, a converse processing for imparting a desired amplitude envelope to the original waveform, a processing for adjusting phase of the original waveform and a processing for extracting a noise component. One or more of these treatments may be performed. Instead of storing the entire processed original waveform in a memory, a necessary section thereof may be stored. In this case, when there is a section in which a start address of the original waveform to be stored in the memory should be set or which should be repeatedly read out, a processing for setting an address for the section which should be repeatedly read out is performed. Further, for effecting the repeated reading smoothly, a necessary waveform treatment processing is performed.

Then, a processing for compressing the waveform data and storing it in the memory is performed. Initially, various "data setting" is performed. Among such "data setting", there are read address setting and write address setting. The read address setting is setting of a range of an address at which the original waveform which has been subjected to the necessary treatment, i.e., the waveform to be compressed should be read, from the memory which stores it. In other words, in the read address setting, a read start address, a read end address or a range of repeated reading is set.

The write address setting is setting of a range of address in the memory in which waveform data after the data compression processing should be written. As will be described later, the bit number (i.e., length of data) of one sample of the waveform data after the data compression processing does not necessarily coincide with the bit number of one address of the memory in this embodiment and, moreover, the bit length is variable and one sample is not stored in exact one-to-one relation at one address but is written in a "packed" manner. Accordingly, notwithstanding that the amount of data (i.e., the number of samples) of the original waveform is known, the amount often the memory addresses for waveform data after the data compression processing is not known until the compression processing has been completed. In the write address setting, therefore, a start address at which initial data should be written can be set but a write end address cannot be set. As will be described later, the write end address is automatically stored when the data compression and write processings have been completed for facilitating subsequent processings.

As another example of "data setting" performed in this stage, there is setting of a limited number of bits in one sample data. This is a processing for setting a desired bit limiting number for each of sections (hereinafter referred to "block" or "block section") of a waveform to be compressed consisting of continuous plural periods for designating a limited number of bits in one sample data after data reduction and data compression processings for each block. In the entire sections of a waveform from the start of sounding to the end thereof, there are sections such as attack sections in which a fine reproduction characteristic is not required and there are also sections such as decay sections in which a fine reproduction characteristic is required. By making the bit number after data reduction and compression processings variable in accordance with the degree of precision required in reproduction of the waveform, the bit number of data can be saved and therefore efficiency is improved. For this reason, the waveform is divided into plural block sections and the bit limiting number is set as desired for each block section.

As another example of "data setting", there is a processing for setting weight coefficients (shift data). It is a feature of this embodiment that, while a predetermined data compression processing is performed in the waveform compression processing, a processing for reducing the value of waveform data on the basis of a desired weight coefficient is performed before or after or during the predetermined data compression processing. Weight coefficients for this data reduction processing are set. In the example described below, weighting operation is realized by data shifting, so that weight coefficients are sometimes referred to as shift data herein. In the embodiment to be described, weight coefficients (shift data) can be set for each block section so that the data reduction processing is performed in accordance with a weight coefficient which is independent for each block section.

For performing "data setting", not only a manual setting using a setting switch is employed but also set data may be loaded from outside. For setting a weight coefficient (shift data), it may be set manually or by inputting it from outside in the data setting stage or, alternatively, it may be set and changed automatically in accordance with the limited bit number during execution of the data compression processing.

Then, "data compression and reduction processings" are performed. In these processings, "predetermined data compression processing" according to a predetermined data compression technique such as the linear prediction method and "data reduction processing" according to the above described weight coefficients (data shift) are performed. The "predetermined data compression processing" is so to speak a main data compression processing according to a predetermined data compression technique such as the linear prediction method. In contrast thereto, the "data reduction processing" is so to speak a subordinate data compression processing in which the value of waveform data is further reduced on the basis of the weight coefficients (shift data) before or after or during the "predetermined data compression processing". The "data compression and reduction processings" will be described more fully later.

Thereafter, a processing for treating waveform sample data after the "data compression and reduction processings" to data of variable bit length is performed. In this processing, one block section is divided further into plural sections (hereinafter referred to simply as "frame" or "frame section") and the bit length of waveform sample data is determined for each frame section and the bit number of each waveform sample data is cut so that each waveform sample data will come within the bit length. For example, the maximum value of an effective bit number of waveform sample data is detected for each frame section and this maximum value is determined as a common bit length of waveform sample data in this frame section. Assuming, for example, that a bit of "0" continues by 5 bits counting from the most significant bit in waveform sample data expressed in a 16-bit format, the 5 bits of high orders which are "0" are bits which do not correspond to the effective value and therefore can be neglected whereas less significant 11 bits are effective bits. The maximum value of an effective bit number in the particular frame is the bit length which can cover all effective bits of the waveform sample data in the frame. Accordingly, cutting of the bit number of all waveform sample data within the frame to the bit length determined in the above described manner can leave all effective bits intact. Thus, waveform sample data can be processed so that it will become data of variable bit length for each frame section. This variable bit length treatment processing can be made automatically on the basis of detection of the maximum value of the effective bit number without depending upon a manual operation. It is of course possible to set and input data of variable bit length for each frame section by a manual operation.

Then, a processing for writing in a memory waveform sample data after the "data compression and reduction processings" which has been treated to a variable bit length is performed. Since, as described above, in storing waveform sample data of variable bit length in a memory, data are not stored at each address in a one-to-one relation but are stored in a packed fashion, a control is performed for writing one waveform sample data in a partial bit region of one address or over plural addresses. There is also performed a control for writing various control data including a compression coefficient used for data compression, a weight coefficient used for data reduction and data representing the bit number of waveform sample data in such a manner that these control data are mixed in the waveform sample data as hidden bit data. These writing processings will be described more fully later.

In a reproduction processing, various parameters for tone generation such as envelope setting parameter, effect setting parameter and tone color control parameter are determined in a known manner. Then, an operation for designating tone pitch of a tone to be generation or an operation for designating tone generating is performed by a tone generation designation unit such as a keyboard whereby waveform sample data is sequentially read from the memory in accordance with the designated tone pitch. Since the read out waveform sample data is data of variable bit length as described above, an adjusting processing for altering this data to data of a predetermined uniform bit length is performed as the waveform sample data is read out. Simultaneously therewith, a processing for taking the hidden bit data, i.e., various control data, mixedly existing in the waveform sample data from the data read from the memory and separating it out of the waveform sample data is performed. These bit length adjusting processing and hidden bit separation processing will be described more fully later.

Then, there are performed a demodulation processing for demodulating the compressed waveform sample data to data of a predetermined coded form (e.g., PCM form) and an operation processing for restoring the waveform sample data which has been reduced by a desired weight coefficient to data of a uniform weight. In this case, compression coefficients and weight coefficients contained in the hidden bit data, i.e., control data, which has been separated in the above described manner are used. That is, the demodulation processing is performed on the basis of the compression coefficients and the weight restoration processing is performed on the basis of the weight coefficients. Specific examples of these processings will be described later. Finally, the waveform sample data restored to data of a normal data form (e.g. data of PCM form of a uniform weight) is digital-to-analog converted and acoustically is propagated through a sound system.

Description of an Example of Hardware Construction

Referring now to FIG. 2, an example of hardware construction of an embodiment of an electronic musical instrument which can be used for carrying out the above described waveform data compression and reduction processings will be described.

The electronic musical instrument shown in FIG. 2 performs various processings and controls by using a microcomputer and includes a CPU (central processing unit) 10, a ROM 11 storing a program and various data and a RAM 11 for working and data storage. An analog signal external input section 13 inputs an analog acoustic signal from outside and includes, for example, a microphone. A sampling section 14 samples the analog acoustic signal applied from the analog signal external input section 13 and converts the sampled signal to PCM coded digital waveform sample data.

A waveform memory 15 is a memory capable of both reading and writing for storing waveform data. The waveform memory 15 is made, for example, of a RAM and may be made non-volatile, if necessary, by battery back-up or other means. A waveform memory interface 16 controls reading and writing of the waveform memory 15.

A disk memory section 17 includes a memory of a large capacity and its driver and may be of any type, e.g., a built-in hard disk or a detachable floppy disk. A disk interface 18 is an interface for reading data from or writing data in the disk memory section 17. A DMA controller 19 controls reading and writing in the disk memory section 17 in a DMA method and is used for transmitting waveform data between the disk memory section 17 and the waveform memory 15.

The waveform data compression processing is applied to waveform sample data produced by subjecting an analog acoustic waveform signal applied from the analog signal external input section 13 to the PCM coding. This original waveform data sampled from outside which is to be compressed may be stored in the waveform memory 15 or may be stored once in the disk memory section 17. The above described treatment processing performed when necessary for the original waveform data (removal of an envelope and extraction or preparation of the attack section or repeated section etc.) may be performed by using the microcomputer of the electronic musical instrument or may be performed by storing the waveform data once in the disk memory section 17 and setting the waveform data in a separate waveform processor or waveform processing computer for the treatment thereof. In the former case, a predetermined area of the RAM 12 or the waveform memory 15 may be used as a buffer memory in the course of the treatment processing and waveform data to be compressed having plural periods and consisting of many sample points for which the treatment processing has been completed is stored in the waveform memory 15. In the latter case, waveform data to be compressed having plural periods and consisting of many sample points for which the treatment processing has been completed is transferred from the disk memory section 17 to this electronic musical instrument and stored in the waveform memory 15.

Alternatively, original waveform data may be sampled by a separate sampling system, stored in a floppy disk or the like storage medium and transferred from the disk memory section 17 to this electronic musical instrument and stored in the waveform memory 15.

The predetermined data compression processing and the data reduction processing are applied to waveform to be compressed prepared in the waveform memory 15 in the above described manner. In this embodiment, the data compression and reduction processings are executed in accordance with the control by the microcomputer. An operator section 20 includes various switches for selection, setting and control of tone color which are normally provided in an operation panel of an electronic musical instrument and switches and displays for selection, setting and control of other tone elements and various effects. The operator section 20 may also include switches and displays for setting the above described various data in the waveform treatment processing and data compression and reduction processings. Description of details of these switches and displays will be omitted.

A waveform buffer memory 21 is a buffer which temporarily stores waveform data which is being processed or has been processed when the data compression and reduction processings are performed. The waveform data which has been subjected to the data compression and reduction processings is read from the buffer memory 21 and written in the waveform memory 15 while the above described loading processing and hidden bit insertion processing are executed.

A keyboard section 22 has, as is well known, keys for designating tone pitch of a tone to be generated. In reproducing a tone, parameters for generating a tone are set to a desired state in the known manner in the operator section 20. Then, a desired key in the keyboard section 22 is depressed.

A tone source section 23 reads waveform data from the waveform memory 15 in accordance with the state of the parameters set in the operator section 20 and key depression information in the keyboard section 22 and generates a tone signal on the basis of the read out waveform data. The tone source section 23 performs the above described data bit length adjusting processing and the hidden bit separation processing and also performs the demodulation processing for demodulating the compressed waveform sample data and the processing for restoring the weight. A digital waveform sample signal generated by the tone source section 23 is converted to an analog signal by a D/A converter 24 and supplied to a sound system 25 for acoustic propagation.

Description of Blocks and Frames

The waveform to be compressed stored in the waveform memory 15 is PCM coded data of a predetermined bit length (e.g., one sample being 16 bits) and consists of many sample points. When this data is compressed, the data is processed after being divided into block sections and frame sections as described above. By way of example, one block consists of 1024 samples and a series of waveform to be compressed corresponding to one tone as a whole normally consists of a larger number of sample points than one block and, accordingly, a block section may be divided into plural sections. One block consists of 64 frame sections and, therefore, one frame section consists of 16 sample points.

In the waveform data compression and reduction processings, processing is executed in accordance with a compression coefficient and weight coefficient which are respectively proper to each block section. In other words, the compression coefficient and the weight coefficient are respectively common in one block section.

In the processing for making the bit length of waveform data variable, a variable bit length proper to each frame section is set. In other words, the bit length of waveform sample data is common in one frame section.

Outline of Compression and Writing

Figure 3:
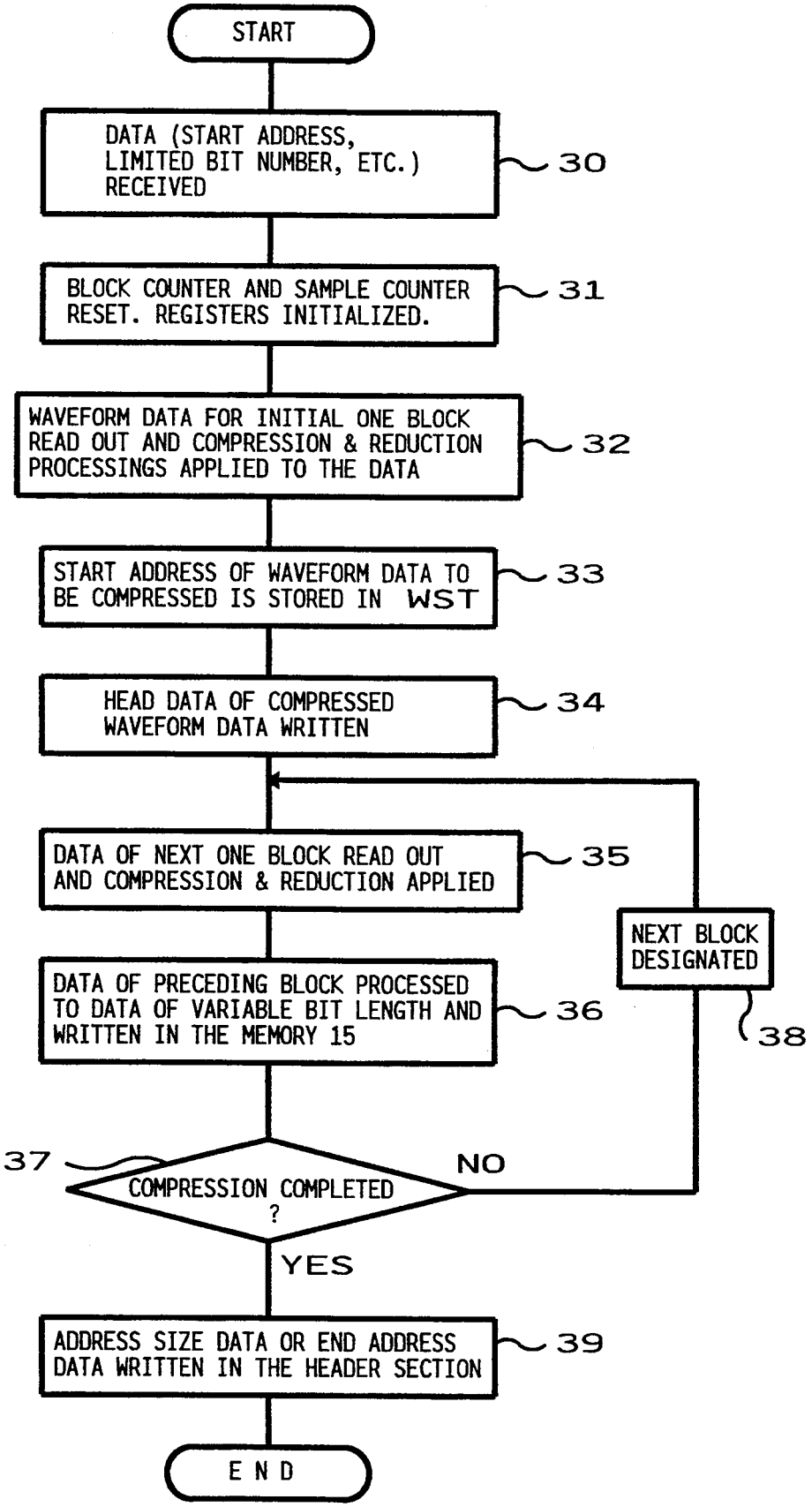
FIG. 3 is a flow chart showing schematically the entire flow of a processing from compression of waveform data to writing of data in a memory performed under the control of a microcomputer in this embodiment.

FIG. 3 is a flow chart of the entire processing from compression to writing of data which is executed under the control of the microcomputer.

In step 30, respective data set in the above described "data setting" are received to establish a state in which data compression processing can be started. Since, for example, the read start address of the waveform to be compressed in the waveform memory 15 and the limited bit number data for each block are set as desired by the operator, these data are received.

In next step 31, contents of a block counter for counting a block number for identifying a block section in which data compression processing is performed and contents of a sample counter for counting a sample number for identifying a sample point in the particular block section are respectively reset to zero. Contents of respective registers are set to their predetermined initial values. For example, the bit limiting number data designated for each block is set in a register storing the bit limiting number.

In next step 32, waveform data for initial one block of waveform to be compressed is read from the waveform memory 15 on the basis of the read start address set in the above manner. The predetermined data compression and reduction processings are applied to this waveform data for initial one block. A specific example of the data compression and reduction processings will be described later.

In next step 33, data for designating a start address in a memory area storing waveform data to be compressed from now is stored in a waveform start address table WST. When compressed waveform data is written in the waveform memory 15, the start address stored in the waveform start address table WST is referred to and reading is started from the start address.

In next step 34, head data of the compressed waveform data is written in a header section of an area where the compressed waveform data is stored.

Figure 4:
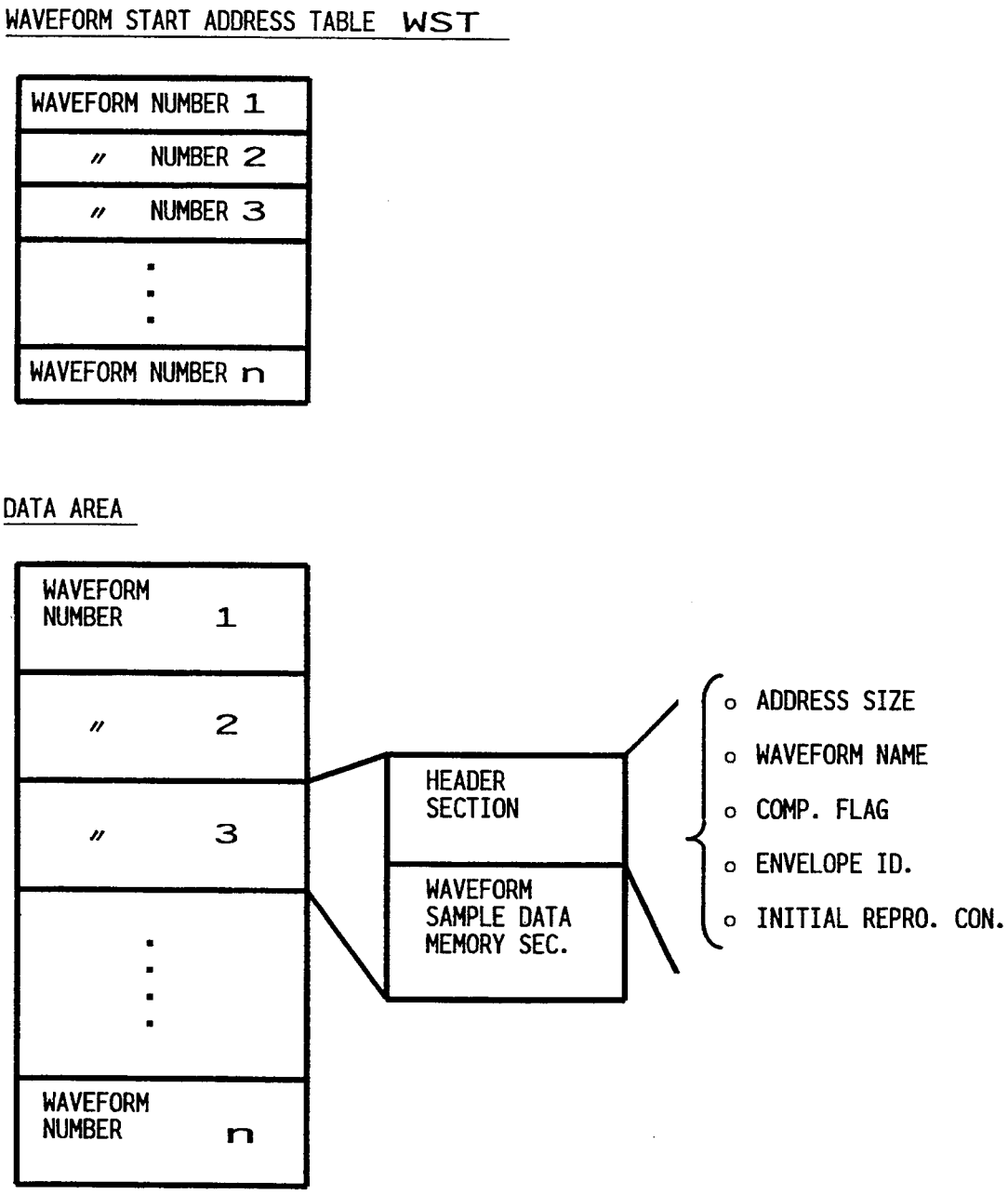
FIG. 4 is a diagram showing a format of a memory region of compressed waveform data in the waveform memory in FIG. 2.

An example of a format of a memory area of compressed waveform data in the waveform memory 15 is shown in FIG. 4. Waveform numbers 1 to n correspond to tones or tone colors of n types and waveform data corresponding to tones or tone colors of n types can be stored in the waveform memory 15. The number of n may be either fixed or variable. The waveform start address table WST stores start address data for each of the waveform numbers 1 to n. The data area is an area for storing waveform data for each of the waveform numbers 1 to n and has a header section and waveform sample data memory section in correspondence to the respective waveform numbers 1 to n. In the above described step 32, start address data is written in the waveform start address table WST corresponding to the waveform number which is assigned to a waveform to be compressed. This start address data specifies the head address of a waveform data memory area concerning this particular waveform number in the data area.

Head data stored in the header section includes, for example, waveform name data, compression presence or absence flag data, envelope identifying data, initial reproduction control data and address size data (or end address data).

The compression presence or absence flag data is a flag indicating whether the waveform is one which has been subjected to the compression processing or not. In this embodiment, description is made on the assumption that waveform data is subjected to the compression processing but it is also possible to select non-compression of waveform data. This flag is therefore provided.

The envelope identifying data is data for identifying the state of imparting of tone volume envelope, i.e., whether the waveform data is imparted, for example, with the entire tone volume envelope from start of tone generation to the end thereof, or with an envelope of the attack portion only or is not imparted with any timewise changing tone volume envelope (i.e., the waveform data is standardized to a constant level).

The initial reproduction control data is various control data necessary for reproducing waveform data in the initial block section and frame section and include compression coefficient data which is necessary for demodulating compressed waveform sample data, weight coefficient data which is necessary for weight restoration operation processing and bit number data which is necessary for adjusting the data bit length. Since the data compression processing and the weighting reduction processing are common in one block and the variable data bit length is common in one frame, the initial reproduction control data is made of compression coefficient data and weight coefficient data concerning the first block and bit number data concerning the first frame in the first block.

Compression coefficient data and weight coefficient data concerning the second and subsequent blocks are written in a memory area for waveform sample data of a block which is preceding the second and each subsequent block by one block in such a manner that it is mixed as hidden bit data in the waveform sample data. Since there is no preceding block or frame for the compression coefficient data and weight coefficient data and the bit number data for the first frame of the first block, these data are stored in the header section as the initial reproduction control data.

The address size data (or end address data) is data for indicating the number of the entire addresses (address size) at which the waveform data of the particular waveform number is stored. This data may be one indicating the last address of addresses at which the waveform data of the waveform number is stored, i.e., the end address.

As described above, the bit number (i.e., bit length) of one sample of the waveform data after the data compression processing does not necessarily coincide with the bit number of one address of the memory and, moreover, one sample is not stored in one address in one-to-one relation but is packed in a compressed manner and, accordingly, the size of the entire memory addresses for the waveform data after the compression processing is not known until the compression processing has been completed. For this reason, the address size data or end address data which is known at a time point when the data compression and writing processings have been completed is written in the header section for facilitating a reproduction processing in a later stage. In the above described step 34, the address size data or end address data is not written in the header section.

The head data stored in the header section is not limited to the above described example but any data may be stored as required. For example, when a part of the waveform is repeatedly read out, loop address data for designating the section from which the data is repeatedly read may be stored. In a case where data compression is performed selectively according to one of plural data compression systems, data indicating the selected data compression system may be stored in the header section for facilitating demodulation of data. Data indicating the name of the original waveform may be stored in the header section and this data may be read and displayed as required for convenience of the operation made by the operator.

Reverting to FIG. 3, in step 35, waveform data of next one block section of the waveform to be compressed is read from the waveform memory 15 and the predetermined data compression processing and the data reduction processing are applied to the read out waveform data of one block section.

The waveform data of the first block to which the data compression and data reduction processings have been applied by the processings of step 33 is temporarily stored in the waveform buffer memory 21 (FIG. 2). The waveform data of the second block to which the data compression and data reduction processings have been applied by the processings of step 35 is also temporarily stored in the waveform buffer memory 21. Thus, waveform data which have been subjected to the compression and reduction processings of adjacent two blocks (i.e., preceding block and next block) are respectively temporarily stored in the waveform buffer memory 21.

In next step 36, waveform data of the preceding block of the waveform data stored temporarily in the waveform buffer memory 21 is processed to data of variable bit length and then is written in the waveform memory 15. In this step, in writing the waveform data of the preceding block, the compression coefficient data and weight coefficient data concerning the next block for which the compression processing has been completed in the preceding step 35 is written in the state in which it is mixed with the waveform data. A specific example of the variable bit length processing and writing processing will be described later. In this step 36, the bit length processing and writing processing are initially made for the waveform data of the first block and the head address for writing is designated by the start address table WST.

In next step 37, whether or not compression of the entire waveform data has been completed is judged. When compression has not been completed, the routine proceeds to step 38 where next block is designated. Then, the routine returns to the above described step 35 where the waveform data compression and reduction processings about the designated next block are performed and the processing of step 36 is performed. The block is sequentially changed in this manner and the processings of steps 35 and 36 are repeated. When compression of the entire waveform data has been completed, step 37 becomes YES and the routine proceeds to step 39. In step 39, the address size data or end address data for the waveform data is written in the header section for the waveform number under processing. Though not described in detail, a write address is properly designated by an address pointer when compressed waveform data is written in the waveform memory 15, so that the address pointer designates the end address when compression of the entire waveform data has been completed. In step 39, therefore, the address size data or the end address data concerning the waveform data is automatically detected and this data is written in the header section.

Compression and Reduction Processings

(First embodiment)

Figure 5:
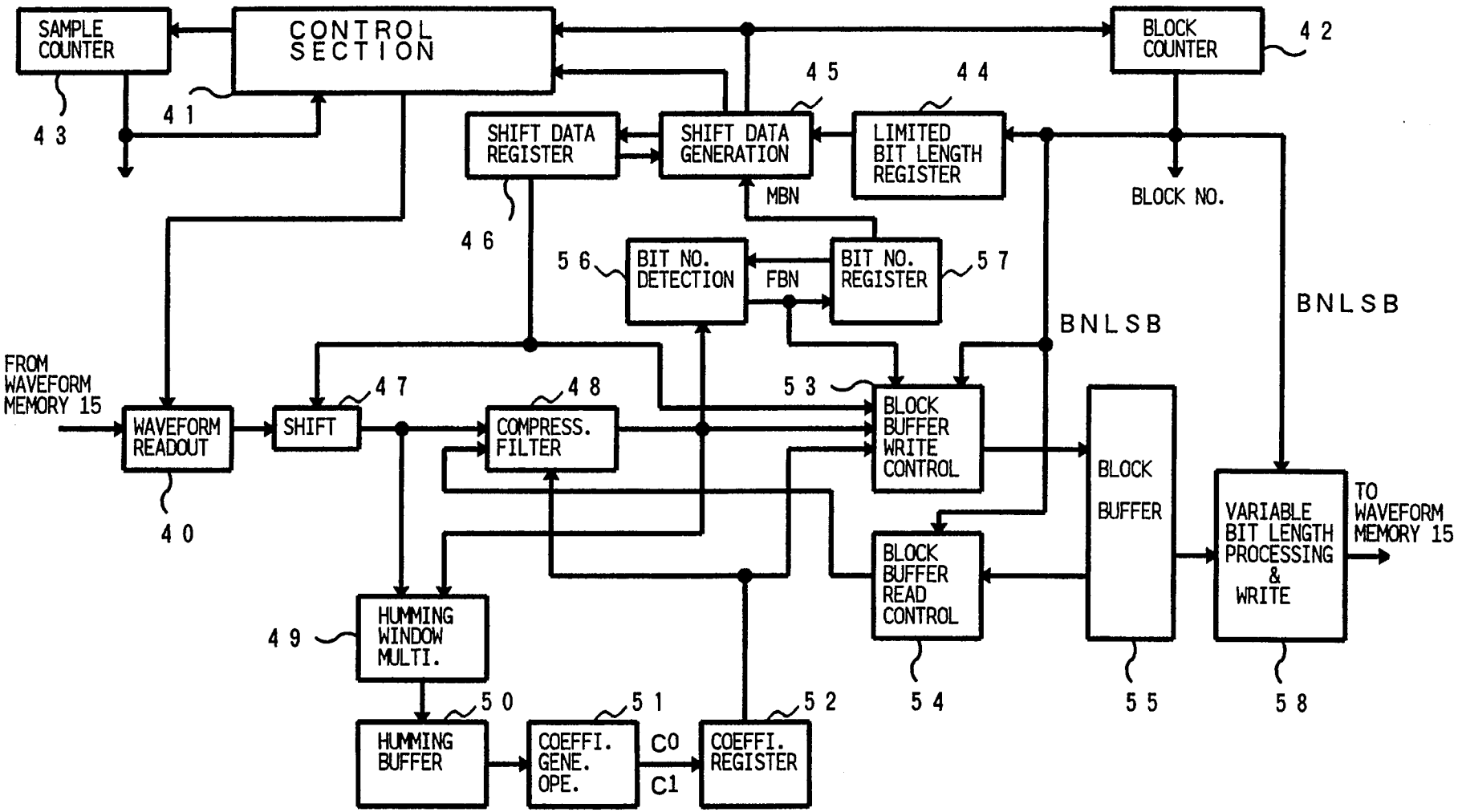
FIG. 5 is a functional block diagram showing an example of waveform data compression and reduction processings performed under the control of the microcomputer in FIG. 2.

The waveform data compression and reduction processings executed in the above described steps 32 and 35 are made under the control of the microcomputer. FIG. 5 is a functional block diagram showing an embodiment (the first embodiment) of the waveform data compression and reduction processings performed under the control of the microcomputer. As to the waveform data compression and reduction processings, description will be made with reference to the functional block diagram illustrated and presentation of a flow chart will be omitted. It is of course possible to perform the waveform data compression and reduction processings by a hardware circuit designed to carry out the functional block diagram instead of performing the processings under the control of the microcomputer.

In this first embodiment, a waveform data reduction processing in using a weight coefficient is executed in a stage prior to a data compression processing using a filter.

In FIG. 5, a waveform memory readout section 40 is provided for reading waveform data to be compressed from the waveform memory 15. A read address signal is supplied by control of a control section 41. The control section 41 performs controls of the entire system and supplies control signals to respective sections of the system. A block counter 42 counts a block number under processing. A sample counter 43 counts a sample number under processing.

As described previously, in the initial state (i.e., in step 31 of FIG. 3), contents of the block counter 42 and the sample counter 43 are reset to their initial values 0 by the control of the control section 41. Each time the waveform data compression and reduction processings for one sample have been completed, the sample counter 43 counts up by 1. Each time the waveform data compression and reduction processings for one block have been completed, the block counter 42 counts up by 1. The sample counter 43 is reset to 0 before it starts counting of one block. A read start address designating the scope of a waveform to be compressed is supplied to the control section 41 and a read address for the waveform memory 15 is specified by adding a count value of the sample counter 43 to this start address and adding a count value of the block counter 42 at a predetermined weight (weight of 1024 times) to the start address. This read address data is supplied to the waveform readout section 40 to designate the address of sample data to be read from the waveform memory 15. One frame section consists of 16 samples. The fifth bit and bits of higher orders the sample counter 43 are used also as data indicating the frame number.

A limited bit number register 44 stores data indicating the limited bit number which is preset for each block section as described above. By the initial setting processing in step 31 of FIG. 3, limited bit number indicating data for each block section is supplied to the register 44. In response to output of the block counter 42, i.e., block number data, limited bit number indicating data set for a block under processing is read from the register 44.

A shift data generation section 45 generates shift data, i.e., weight coefficients. The shift data generation section 45 generates proper shift data, i.e., weight coefficients, having regard to limited bit number indicating data concerning the particular block supplied from the limited bit number register 44 and other data. The shift data generated by the shift data generation section 45 is registered by a shift data register 46. The shift data, i.e., weight coefficients, registered in the shift register 46 is supplied to a shift circuit (i.e., weight operation circuit) 47.

The shift circuit 47 receives waveform sample data read from the waveform memory 15 through the waveform readout section 40 and performs an operation for reducing the value of the sample data by shifting the value of the sample data toward lower order bits by a bit number corresponding to the shift data. When, for example, waveform sample data whose effective bit number is 10 bits is shifted by 2 bits toward lower order bits, the effective bit number of the waveform sample data is reduced to 8 bits.

Waveform sample data provided by the shift circuit 47 is applied to a compression filter section 48. The compression filter section 48 performs a data compression processing by a filter. A filter coefficient, i.e., compression coefficient, of the compression filter section 48 is calculated for each block section by the linear prediction method on the basis of waveform sample data for each block section. For this calculation, there are provided a humming window multiplication section 49, a humming buffer 50, a coefficient generation operation section 51 and a coefficient register 52. A specific example thereof will be described later. A calculated compression coefficient is stored in the coefficient register 52 and applied to the compression filter section 48.

Waveform sample data provided by the compression filter section 48 is temporarily stored by a block buffer 55 through a block buffer write control section 53. Data stored in the block buffer 55 is read therefrom under reading control by a block buffer read control section 54 and applied to the compression filter section 48. This is an arrangement enabling a filter circuit of a single stage to be employed as the compression filter section 48 and to function as a compression filter of two stages by circulating data through the filter circuit. Therefore, stated more accurately, waveform sample data which is provided from the compression filter section 48 at the second circulation is data for which the compression processing has been completed.

A bit number detection section 56 detects an effective bit number of compressed waveform sample data provided by the compression filter section 48. In compressed waveform sample data provided in the 16-bit standard, for example, bits of "0" on the high order side are removed and the highest order bit and lower bits which are "1" are detected as the effective bit number. The bit number detection section 56 detects the maximum value of the effective bit number for each frame section and provides it as bit-number-by-frame data FBN. This bit-number-by-frame data FBN is temporarily stored in the block buffer 55 through the block buffer write control section 53 and used in the variable bit length processing for each frame. The bit number detection section 56 compares the bit-number-by-frame data FBN with the bit number data stored in the bit number register 57 and, when the bit-number-by-frame data FBN which has been currently provided is larger, stores it in the bit number register 57.

Thus, the bit number data stored in the bit number register 57 upon completion of processing of one block is the maximum value of the effective bit number in this block. This bit number data is supplied to the shift data generation section 45 as maximum bit number data MBN. Upon completion of processing of one block, the shift data generation section 45 compares the limited number data of this block supplied from the limited bit number register 44 with the maximum bit number data MBN and, when the maximum bit number data MBN is larger, it signifies that compressed waveform data exceeds the limited bit number set for this block, so that re-performing of compression and reduction processings concerning this block is commanded to the control section 41 and the value of shift data supplied to the shift data register 46 is made larger than the preceding time. Thus, the shift data, i.e., weight coefficient, is initially set to a proper predetermined value (a constant value or a value set as desired for each block) and the value of the shift data, i.e., weight coefficient, is automatically changed in relation to the limited bit number set for a particular block to re-perform the compression and reduction processings concerning the particular block, so that the shift data, i.e., weight coefficient, is automatically controlled so as to cause data after the data compression and reduction processings to have finally a bit number within the limited bit number set for the particular block. The finally established shift data, i.e., weight coefficient, for the block is temporarily stored in the block buffer 55 through the block buffer write control section 53 and later is written with the waveform sample data in the waveform memory 15. Instead of using such automatic determination of shift data, i.e., weight coefficient, shift data may be determined manually for each block.

The shift data generation section 45 compares, upon completion of processing for one block, the limited bit number data of the particular block supplied from the limited bit number register 44 with the maximum bit number data MBN. When the maximum bit number data MBN is smaller, compressed waveform data has a bit number within the limited bit number set for the block, so that the shift data generation section 45 supplies a block countup designation signal to the block counter 42 and the control section 41 so as to finish the processing for this block and shift to processing of a next block.

Figure 6:
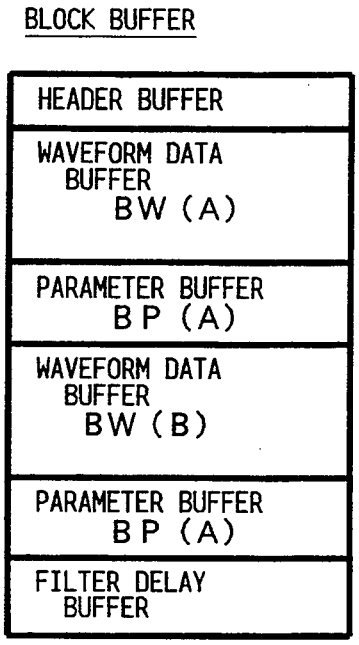
FIG. 6 is a diagram showing a memory format of a block buffer in FIG. 5.

The block buffer 55 is a buffer memory included in the waveform buffer memory 21 of FIG. 2. An example of memory format thereof is shown in FIG. 6. This block buffer 55 has waveform data buffers BW(A) and BW(B). Each waveform data buffer BW(A) or BW(B) can temporarily store waveform sample data of one block and, therefore, the block buffer 55 can temporarily store waveform sample data totalling two blocks. The buffer in which waveform sample data should be stored is switched between the buffers BW(A) and BW(B) depending upon whether the block count is even or odd. The block buffer 55 has the waveform buffers BW(A) and BW(B) for two blocks for enabling a control to be made so that, when waveform data of a certain block is written in the waveform memory 15, compression coefficient and shift data (weight coefficient) for next block should be written together as hidden bit data. The two adjacent blocks which are temporarily stored in the block buffer 55 are referred to as "block A" and "block B".

Parameter buffers BP(A) and BP(B) temporarily store control data to be written mixedly with waveform sample data as hidden bit data, storing compression coefficient and shift data (weight coefficient) of the block A or B and bit number data for each frame in the block A or B (bit-number-by-frame data FBN).

A header buffer temporarily stores head data to be stored in the waveform memory 15.

A filter delay buffer temporarily stores signal data which was stored in a delay circuit section for performing unit delay of a signal in the compression filter section 48 when the compression processing for the preceding block ended. This filter is provided for the above described necessity of re-performing the data compression and reduction processings for data of one block when the bit number of waveform sample data after the compression and reduction processings is not within the limited bit number. More specifically, for re-performing such compression and reduction processings, contents of signal data in the delay circuit section in the compression filter section 48 must be reproduced in the same contents existing immediately after the compression processing for the preceding block. For realizing this, signal data which was held in the delay circuit section in the compression filter section 48 when the compression processing for the preceding block ended temporarily stored in the filter delay buffer and, when re-performing of the compression processing for the next block has been demanded, data stored in this filter delay buffer is set in the delay circuit section in the compression filter section 48 to reproduce the initial state for performing a compression processing for the block.

Reverting to FIG. 5, A variable bit length processing and write section 58 reads compressed data for one block which is stored in the block buffer 55 and cuts the data bit number of this data to the bit size of the maximum bit number FBN for each frame section (i.e., variable bit length processing). The section 58 performs also processings of writing compression coefficient and shift data (weight coefficient) for next block mixedly with waveform sample data and writing data representing the variable bit number FBN for next frame mixedly with waveform sample data. A specific example thereof will be described later.

Description of the Compression Filter Section (First Embodiment)

Figure 7:
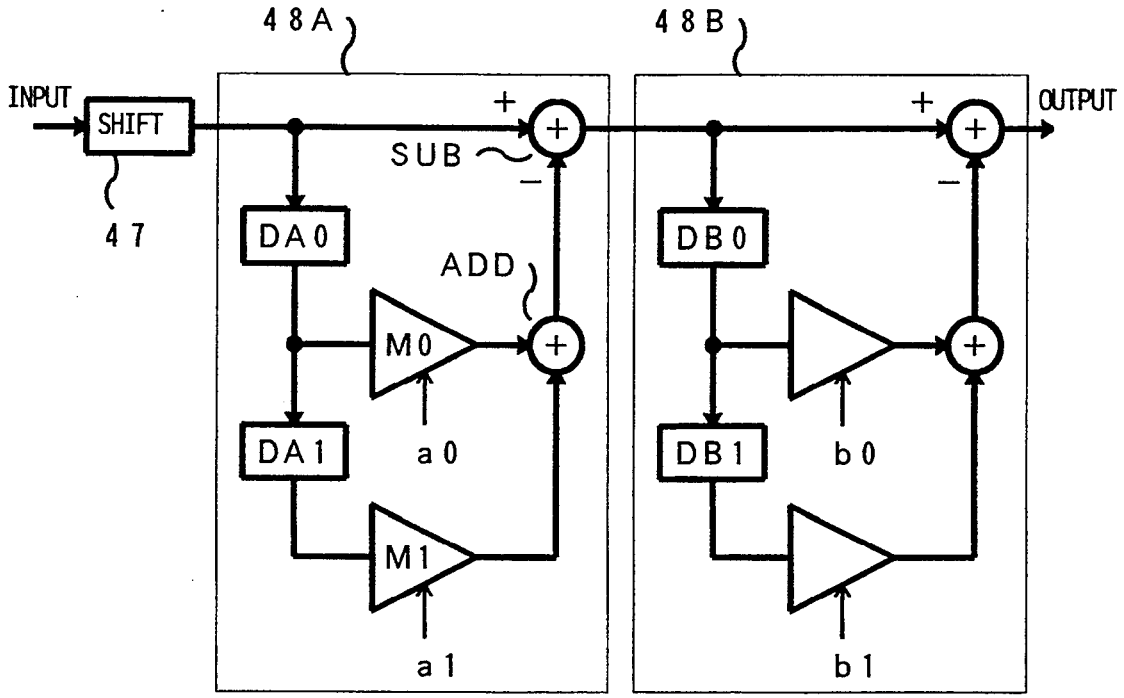
FIG. 7 is a diagram showing an example of the concept of the shift circuit and compression filter section in FIG. 5.

FIG. 7 schematically shows an example of basic structure of the shift circuit section 47 and the compression filter section. The compression filter section consists of secondary filters 48A and 48B cascade-connected in two stages. In the filter 48A of the first stage, waveform sample data which has been subjected to the reduction processing and provided by the shift circuit 47 is applied to a delay section DA0 and output of the delay section DA0 is multiplied by a coefficient a0 in a multiplier M0. The output of the delay section A0 is also applied to a second delay section DA1 and output of the delay section DA1 is multiplied by a coefficient a1 in a multiplier M1. Thus, products obtained by multiplying data of one sample before and data of two samples before respectively by a coefficient are added together by an adder ADD and the sum (convolution sum) is subtracted from data at the present sample point by a subtractor SUB. The output of the subtractor SUB is applied to the filter 48B of the second stage. The second stage filter 48B and the first stage filter 48A are of the same construction and are different in their coefficients b0, b1. By cascade-connecting the secondary filters 48A and 48B in two stages, the data compression processing can be carried out effectively and besides setting of compression coefficients can be facilitated. Further, as the compression filter section 48, a hardware circuit of a secondary filter for one stage has only to be provided and this secondary filter for one stage may be used on a time shared basis. This simplifies the hardware construction of the device.

Figure 8:
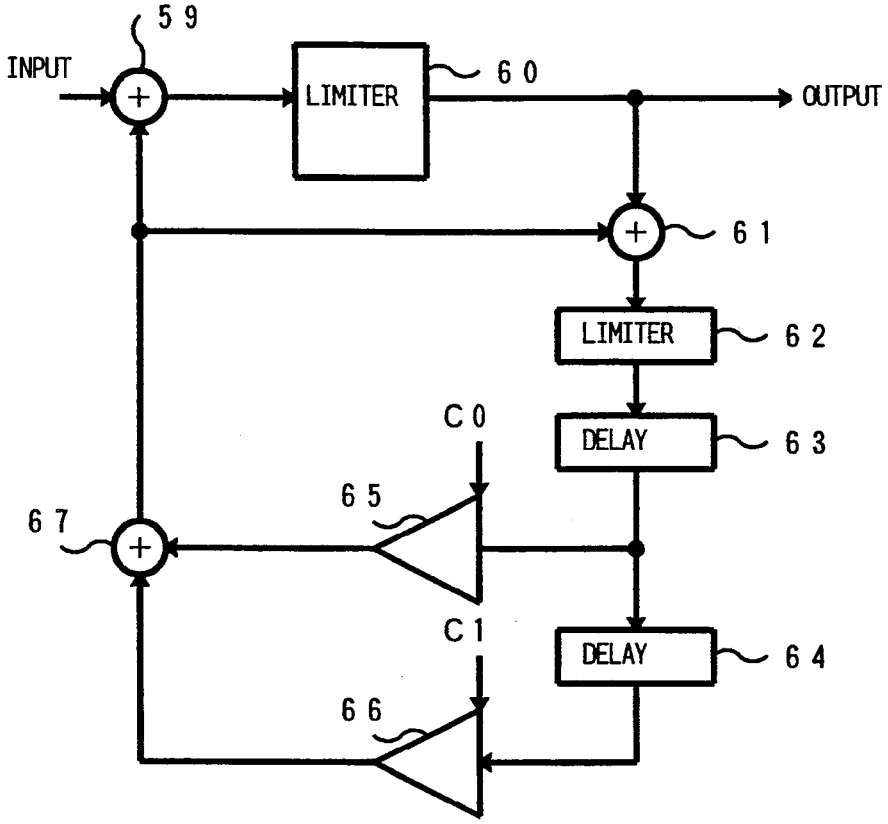
FIG. 8 is a diagram showing an example of a hardware circuit in the compression filter section consisting of secondary filter for one stage.

FIG. 8 shows an example of a hardware circuit of the compression filter section 48 consisting of secondary filter for one stage. In this circuit, output of a subtractor 59 for subtracting a convolution sum from input waveform sample data at the present sample point is delivered out through a limiter 60. The convolution sum is added to the output of the limiter 60 by an adder 61 to reproduce input waveform sample data at the present sample point which in turn is applied to delay sections 63 and 64 through a limiter 62. Multipliers 65 and 66 multiply the outputs of the delay sections 63 and 64 with compression coefficients c0 and c1 and a convolution sum of these products is obtained by an adder 67. Values of the compression coefficients are a0, a1 when this compression filter section 48 is used as the first stage filter 48A and b0, b1 when the compression filter section 48 is used as the second stage filter 48B. When the above described re-performing of the compression and reduction processings is made, contents of the filter delay buffer (i.e., signal data which was stored when the compression processing for the preceding block ended) are set in the delay sections 63 and 64.

Generation of Compression Coefficients

Figure 9:
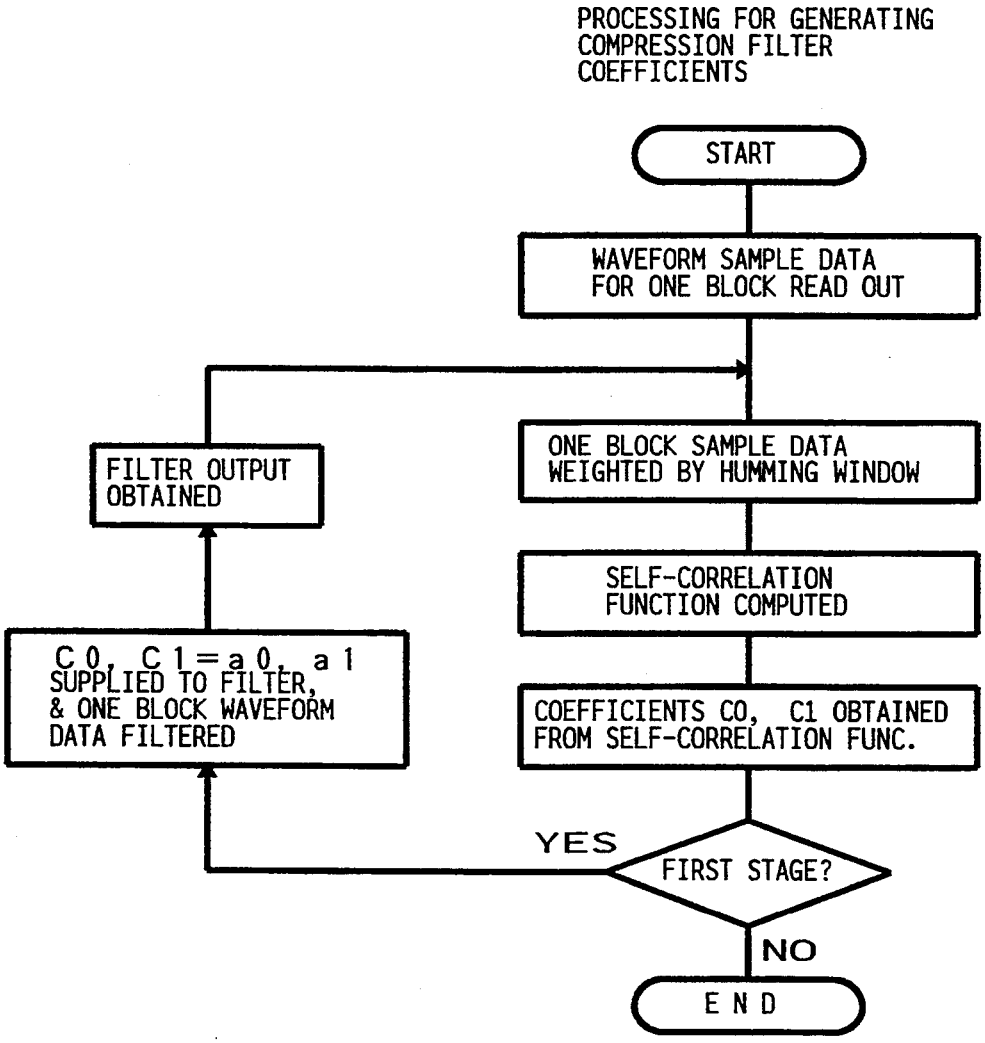
FIG. 9 is a flow chart showing an example of protocol for an operation for generating a compression filter coefficient according to the linear prediction method.

Referring now to FIG. 9, an example of processing for generating compression filter coefficients according to the linear prediction method by using the humming window multiplication section 49, humming buffer 50, coefficient generation operation section 51 and coefficient register 52 will be described. First, waveform sample data for one block (1024 samples) is sequentially read from the waveform memory 15 and applied to the humming window multiplication section 49 for multiplication by a humming window function. In this case, the humming window function consists of 1024 samples and waveform sample data for one block (1024 samples) is multiplied by each sample value of the humming window function. Product Sn (n being 0, 1, 2, 3, . . . 1023) is stored in the humming buffer 50. Then, in the coefficient generation operation section 51, self correlation function Ri is computed according to the following formula with respect to i=0, 1, 2 on the basis of the waveform sample data Sn which has been weighted in the humming window:

$$R1=\Sigma SnSn+i$$

(where the range of accumulation of Σ is from 0 to n=1023)

Then, on the basis of the self correlation function Ri computed in the above described manner, compression coefficients c0, c1 are obtained according to the following formulas:

$$c0=(R1\cdot R0-R1\cdot R2)/(R0\cdot R0-R1\cdot R1)$$

$$c1=(R2\cdot R0-R1\cdot R1)/(R0\cdot R0-R1\cdot R1)$$

When the compression filter coefficient of the first stage is computed, c0, c1 correspond to a0, s1 and, when the compression filter coefficients of the second stage is computed, c0, c1 correspond to b0, b1.

Nextly, whether or not the currently computed compression filter coefficients c0, c1 are of the first stage is confirmed. When the compression filter coefficients c0, c1 are of the first stage, the compression filter coefficients c0, c1, i.e., a0, a1, are stored in the coefficient register 52 and supplied also to the compression filter section 48. Waveform sample data for the block which is currently being processed is sequentially read from the waveform memory 15 and supplied to the compression filter section 48 to perform the compression processing according to the compression filter coefficients c0, c1, i.e., a0, a1. In this manner, output of the first stage filter 48A is obtained and supplied to the humming window multiplication section 49 for multiplication of the humming window function. The above described processing is repeated and products Sn is stored in the humming buffer 50, self correlation function Ri is computed and compression coefficients c0, c1 are computed. The compression c0, c1 thus obtained correspond this time to the compression filter coefficients b0, b1 of the second stage and these compression coefficients are stored in the coefficient register 52. The series of processings have now been completed.

In this manner, compression filter coefficients a0, a1, b0, b1 for the particular block have been computed and, thereafter, the compression processing for waveform sample data for this block is performed in the above described manner.

Description of Variable Bit Length and Hidden Bit

Figure 10:
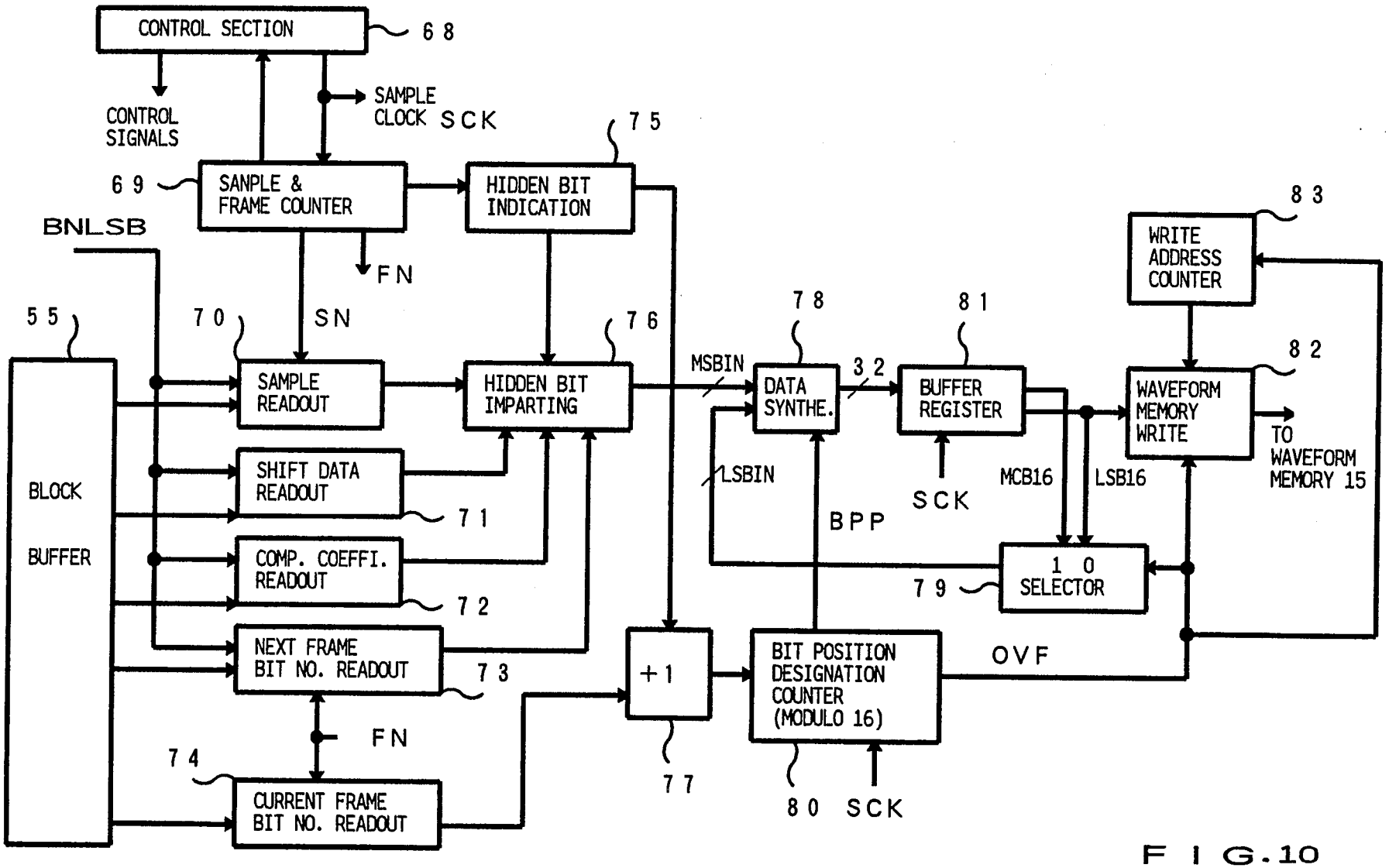
FIG. 10 is a functional block diagram for describing the variable bit length treatment and write processing section in FIG. 5.
Figure 11:
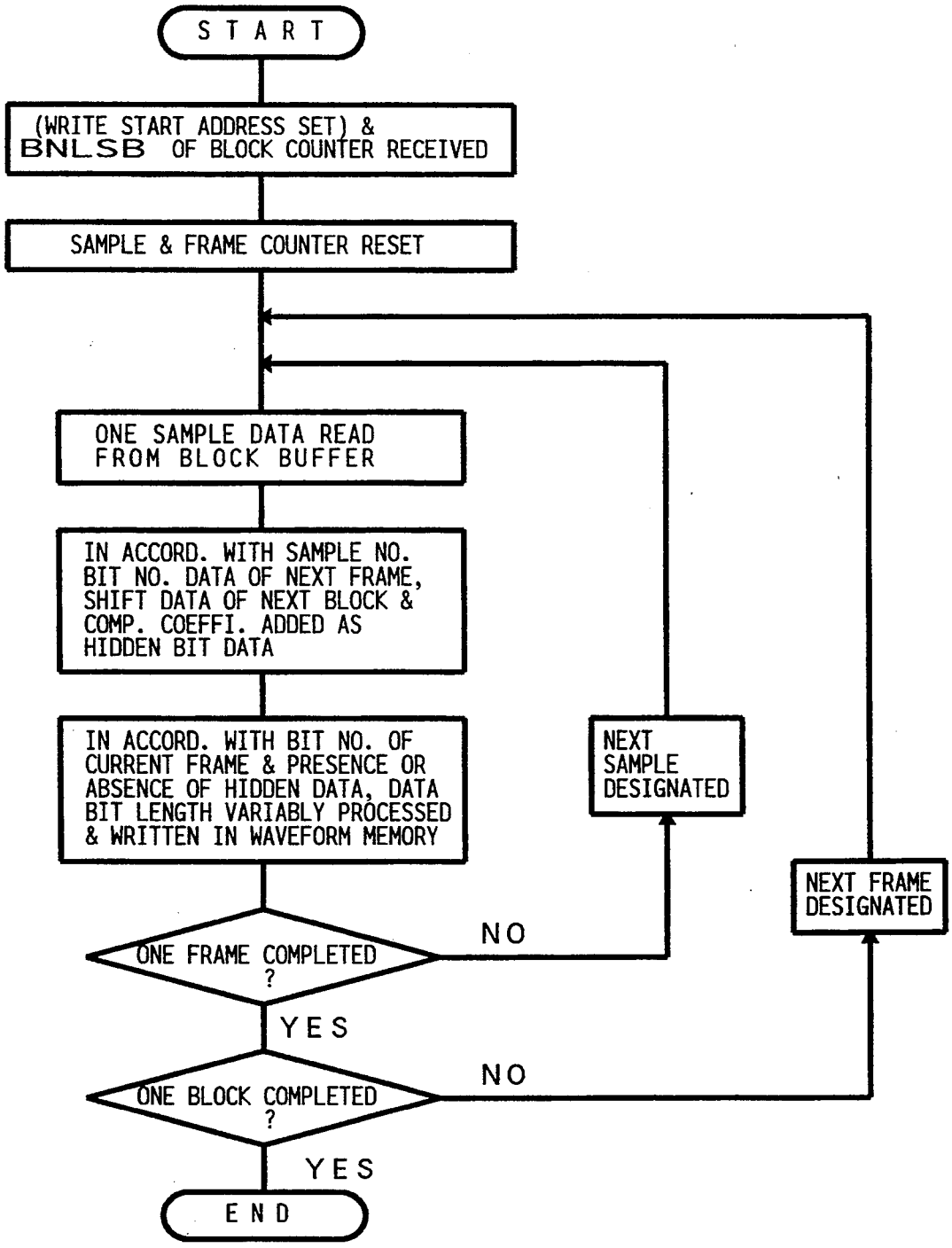
FIG. 11 is a flow chart showing an outline of the variable bit length treatment and write processings executed by the variable bit length treatment and write processing section.

Compressed data for one block stored in the block buffer 55 is written in the waveform memory 15 by processing made in the variable bit length processing and write section 58. FIG. 10 is a functional block diagram for explaining the processing performed by this variable bit length processing and writing section 58. FIG. 11 shows an outline of the protocol of the variable bit length processing and writing processing executed by this section 58. In other words, FIG. 11 shows the processing executed in step 36 of FIG. 3 in some more detail and FIG. 10 is a functional block diagram of a processing which is equivalent to the protocol executed in FIG. 11.

Figure 12:
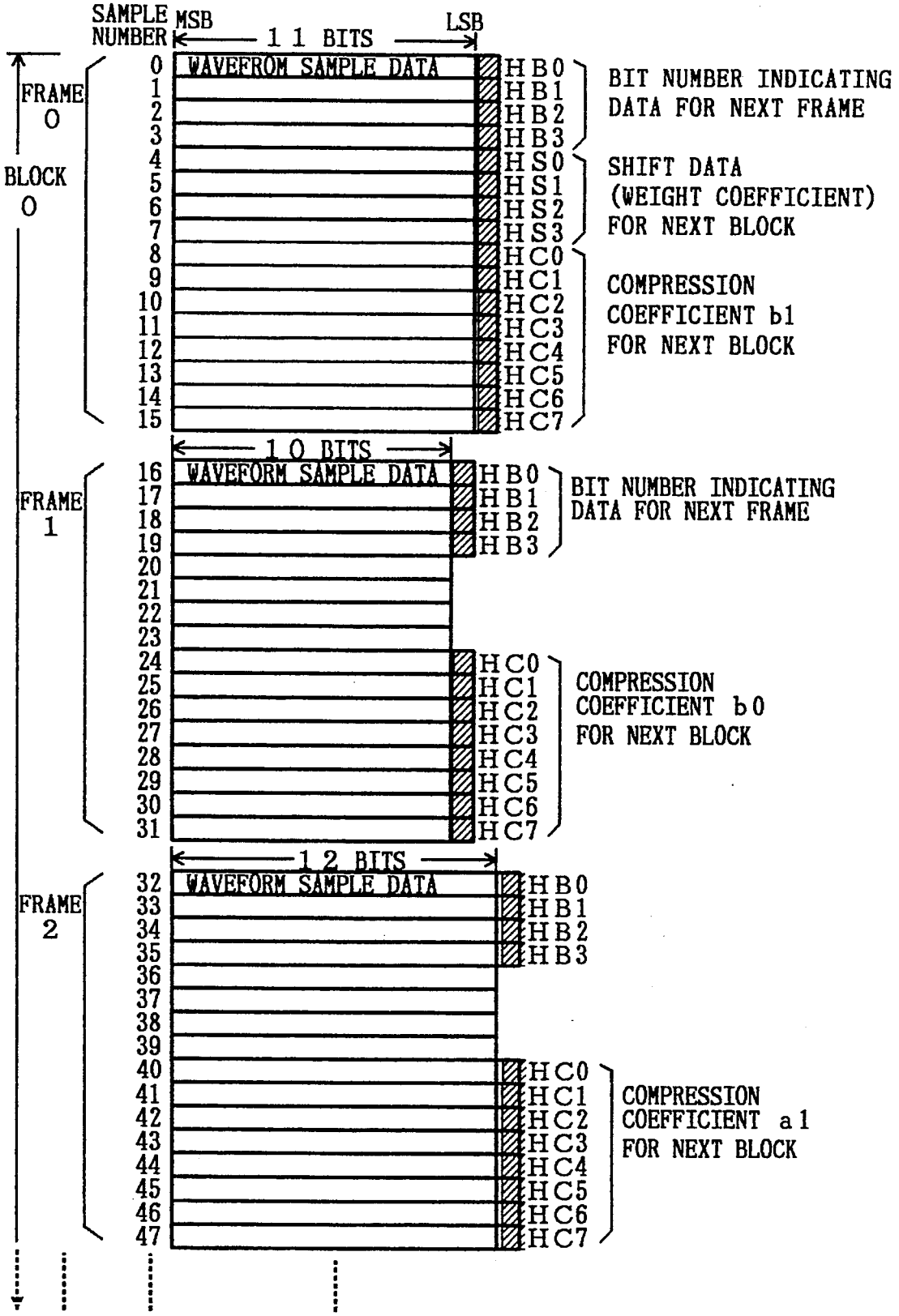
FIG. 12 is a diagram showing an example of data format of waveform sample data to which the variable bit length treatment has been applied and hidden bit data.

Description will initially be made about outline of the waveform sample data variable bit length processing and writing of hidden bit data. FIG. 12 shows an example of a format of waveform sample data which has been subjected to the variable bit length processing and hidden bit data.

1) Variable bit length

The bit number of waveform sample data is common within one frame and variable for each frame. More specifically, on the basis of the bit-number-by-frame data FBN which is the detected maximum value of the effective bit number in the frame, each sample data in the frame is extracted by the bit number of the data FBN from low order bits. The effective bit can be secured by this arrangement and the bit number of each sample data in the frame can be reduced. In the example of FIG. 12, the size, i.e., bit length, of the waveform data in frame 10 is 11 bits, that in frame 1 is 10 bits and that in frame 2 is 12 bits.

2) Hidden bit a) Bit number indicating data for each frame

As described previously, data indicating the bit number of waveform sample data which has been processed to variable bit length for each frame is written as hidden bit data mixedly with waveform sample data of the preceding frame. This bit number indicating data is data of 4 bits. This data is divided in single bits and the divided single bits are respectively located on the lower side of the respective least significant bits LSB of initial 4 samples of the preceding frame. In the example of FIG. 12, respective bits of hidden bit data corresponding to the bit number indicating data are designated by HB0, HB1, HB2 and HB3. In weighting in the binary coding system of each hidden bit, HB3 becomes the most significant bit, and weight decreases in the order of HB2, HB1 and HB0. In the example of FIG. 12, contents of the hidden bits HB3–HB0 of frame 0 are "1010" indicating that the data length of next frame 1 is 10 bits. Likewise, contents of the hidden bits HB3– HB0 of frame 1 are "1100" indicating that the data length of next frame 2 is 12 bits. At sample points having these hidden bits HB0–HB3, the data length is substantially longer by one bit than at other sample points. Without such hidden bits HB0–HB3, i.e., in the substantial waveform data size, all samples in the same frame have a constant size. As to the initial frame 0 of the first block, there is no preceding frame and, therefore, the bit number indicating data is written in the header section as described previously. The reason for writing the bit number indicating data for next frame mixedly with waveform data of the preceding frame is that, as will be apparent from the above description, this arrangement enables the bit number indicating data to be read out before starting the reproduction processing.

b) Shift data (weight coefficient)

Shift data (weight coefficient) for each block is written as hidden bit data mixedly with waveform sample data of the preceding block. This shift data (weight coefficient) is data of 4 bits. This data is divided in single bits and the respective single bits are located on the lower side of the respective least significant bits LSB of waveform data of 4 samples from the fifth to eighth samples in the initial frame 0 of the preceding block. In the example of FIG. 12, the respective bits of hidden bit data corresponding to the shift data (weight coefficient) are designated by HS0, HS1, HS2 and HS3.

c) Compression coefficient

The four compression coefficients a0, a1, b0, b1 for each block are written as hidden bit data mixedly with waveform sample data of the preceding block. Each compression coefficient is data of 8 bits. This data is divided in single bits and the respective single bits are located on the lower side of the respective least significant bits LSB of waveform data of 8 samples from the ninth to sixteenth samples in the initial frame 0 of the preceding block as to the coefficient b1, located on the lower side of the respective least significant bits LSB of waveform data of 8 samples from the ninth to sixteenth samples in the second frame 1 of the preceding block as to the coefficient b0, located on the lower side of the respective least significant bits LSB of waveform data of 8 samples from the ninth to sixteenth samples in the third frame 2 of the preceding block as to the coefficient a1, and located on the lower side of the respective least significant bits LSB of waveform data of 8 samples from the ninth to sixteenth samples in the fourth frame 3 of the preceding block as to the coefficient a0. In the example of FIG. 12, respective bits of hidden bit data corresponding to one compression coefficient are designated by HC0–HC7.

3) Packed storage

Figure 13:
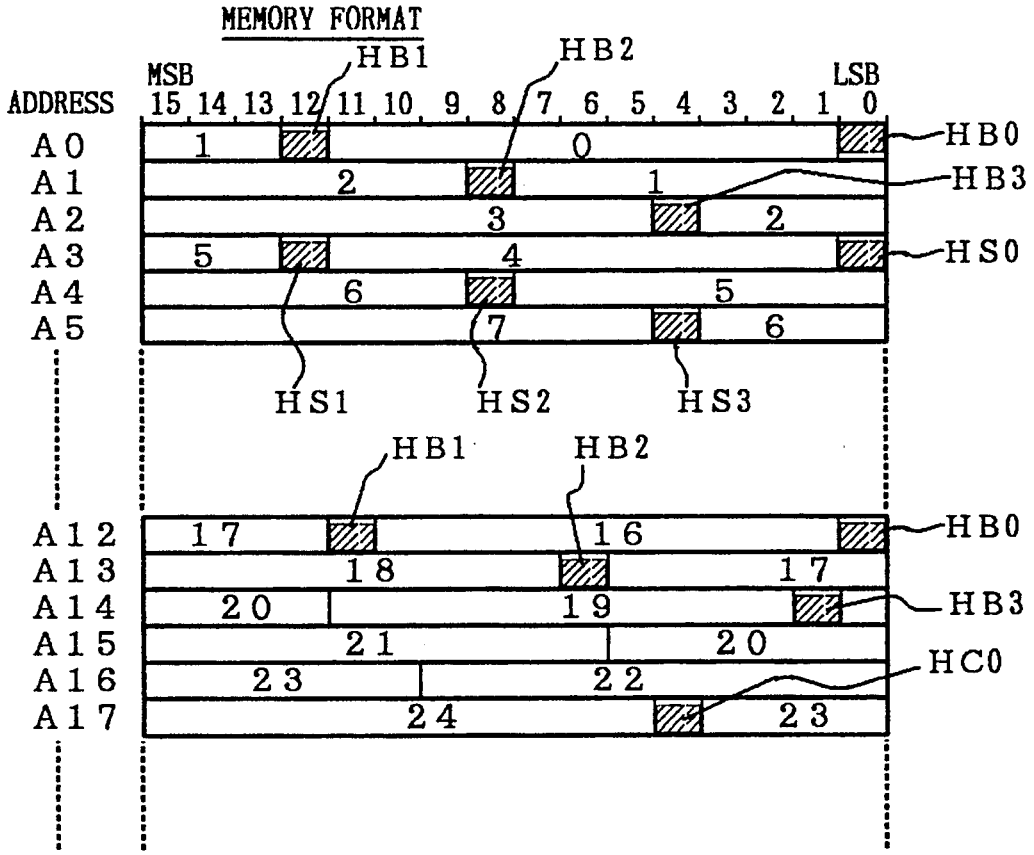
FIG. 13 is a diagram showing an example of memory format used in a case where data of variable bit length consisting of the format shown in FIG. 12 is actually packed in a waveform memory and stored therein.

FIG. 13 shows an example of a memory format used in a case where data of variable bit length having a format as shown in FIG. 12 is actually packed in the waveform memory 15 for storage.

In the case of FIG. 13, the size, i.e., data length, of the memory address in the waveform memory 15 is fixed to 16 bits for one address and each address is accessed by an address signal. Data of one sample point is not stored at one address but data of variable length is suitably packed and stored. For example, the hidden bit HB0 accompanying waveform data at sample point 0 is stored at the least significant bit of address A0, waveform data of sample point 0 is stored at 11 bits of higher orders, the hidden bit HB1 accompanying waveform data at sample point 1 is stored at one higher order bit and three lower order bits of waveform data at sample point 1 is stored at three higher order bits. The remaining eight higher order bits of waveform data at sample point 1 are stored at eight lower order bits of address A1. Subsequently, as illustrated, waveform data at each sample point and hidden bit data are packed and stored. In FIG. 13, the numeral in the address region indicates the sample point number of waveform data to be stored there and the shaded portions indicate regions where the hidden bit is stored. For enabling data to be packed and stored efficiently in the waveform memory 15, one data is divided properly into plural portions and stored over plural addresses.

Variable Bit Length Adjusting and Writing Processing

Referring to FIGS. 10 and 11, an example of the variable bit length adjusting and writing processing will be described. In FIG. 10, a control section 68 controls the entire operation of the variable bit length adjusting and writing processing section 58. This control section 68 may be considered to execute the processing program of FIG. 11 to control the variable bit length adjusting and writing processing. A sample and frame counter 69 increments the sample number SN of waveform data to be read from the block buffer 55 in accordance with a sample clock SCK and increments the frame number FN at each 16 samples.

A sample readout section 70 performs a control for reading waveform data from the block buffer 55 in accordance with the sample number SN designated by the sample and frame counter 69. The least significant bit BNLSB of the block number data counted by the block counter 42 (FIG. 5) is supplied to the sample readout section to inform whether the block number about which the compression processing has been completed is odd or even. By this signal, which of the two waveform data buffers BW(A) and BW(B) of the block buffer 55 (FIG. 6) waveform data should be read from is designated. Assume, for example, that waveform data of even number block numbers 0, 2, 4 . . . are stored in the waveform data buffer BW(A) and odd number block numbers 1, 3, 5, . . . are stored in the waveform data buffer BW(B). When the least significant bit BNLSB of the block number data is "0", it is found that the block about which the compression processing has just been completed is an even number block so that it is stored in the waveform data buffer BW(A) and the preceding block, which is an odd number block, is stored in the waveform data buffer BW(B). Accordingly, the preceding block is the odd number block stored in the waveform data buffer BW(B) and the control is made so that waveform data is read from this buffer BW(B). Conversely, when the least significant bit BNLSB of the block number data is "1", it is found that the block about which the compression processing has just been completed is the odd number block and the preceding block is the even number block stored in the waveform data buffer BW(A). Accordingly, the control is made so that the waveform data is read from the buffer BW(A).

A shift data reaout section 71 performs a control for reading shift data (weight coefficient) from the parameter buffers BP(A) and BP(B) of the block buffer 55. The least significant bit BNLSB of the block number data is supplied to this shift data readout section 71 to inform whether the block number about which the compression processing has been completed is odd or even. By this signal, which of the two parameter buffers BP(A) and BP(B) of the block buffer 55 (FIG. 6) shift data should be read from is indicated. When BNLSB is "0" in the above described case, data of the waveform data buffer BW(B) is read out as the preceding block (odd number block) in and stored the waveform memory 15 and, therefore, parameter data for next block (even number block) is stored in the parameter buffer BP(A). In the shift data readout section 71, therefore, shift data for the next block is read from the parameter buffer BP(B).

A compression coefficint readout section 72 performs a control for reading compression coefficients a0, a1, b0 and b1 from the parameter buffers BP(A) and BP(B) of the block buffer 55. In the same manner as described above, the least significant bit BNLSB of the block number data is supplied to the compression coefficient readout section 72 and, depending upon whether the block number is an even number or an odd number, a compression coefficient for next block is read from either of the two parameter buffers BP(A) and BP(B) of the block buffer 55.

A next frame bit number data readout section 73 performs a control for reading out bit-number-by-frame data FBN for next frame from either of the parameter buffers BP(A) and BP(B) of the block buffer 55 in accordance with the frame number FN from the sample and frame counter 69. When, for example, the least significant bit BNLSB of the block number data is "0", waveform data stored in the waveform data buffer BW(B) as the preceding block is read out and written in the waveform memory 15 and, therefore, the bit-number-by-frame data FBN for next frame is read from the parameter buffer BP(B) for the preceding block. The read out bit number data is written as hidden bit data.

A current frame bit number data readout section 74 performs a control for reading out bit-number-by-frame data FBN for the frame which is currently processed from either of the parameter buffers BP(A) and BP(B) of the block buffer 55 in accordance with the frame number FN from the sample and frame counter 69. When, for example, the least significant bit BNLSB of the block number data is "0", the preceding block is B block in the same manner as described above, so that the bit-number-by-frame data FBN for the frame which is currently processed is read from the parameter buffer BP(B). The read out bit number data is used for adjusting the bit number of waveform data of this frame.

A hidden bit indication section 75, responsive to the sample number SN supplied from the sample and frame counter 69, detects and indicates whether the sample is a sample point at which hidden bit data should be inserted or not and which type of data should be inserted as the hidden bit data. As has been described with reference to FIG. 12, since bit number data of next frame, shift data of next block and compression coefficients of next block are written dispersedly as hidden bit data on the lower bit side of waveform data of a predetermined sample number (sample number within one block), the predetermined sample number is detected and a proper indication thereupon is made.

A hidden bit imparting section 76 adds, in accordance with designation from the hidden bit indication section 75, one bit of predetermined hidden bit data on the lower bit side of waveform sample data read from the sample readout section 70 at a sample number at which hidden bit data should be imparted. Data which should be inserted as hidden bit data (i.e., shift data of 4 bits, compression coefficients a0–b1 of 8 bits and next frame bit number data of 4 bits) are supplied from the shift data readout section 71, compression coefficient readout section 72 and next frame bit number data readout section 73 to the hidden bit imparting section 76. The hidden bit imparting section 76 selects, as has been described with reference to FIG. 12, a predetermined one bit from among the supplied data in correspondence to the predetermined sample number and imparts the selected one bit data as hidden bit data, to the lower bit side of waveform sample data of the sample number.

An addition section 77 adds, in accordance with designation from the hidden bit indication section, 1 to bit number data of the current frame read from the current frame bit number data readout section 74 at a sample number at which hidden bit data should be imparted. By this arrangement, at the sample point at which the hidden bit data should be imparted, the value of the current frame bit number data is incremented by 1 in correspondence to imparting of one bit.

The waveform data which has been provided by the hidden bit imparting section 76 is supplied to a high order bit input MSBIN of a data synthesis section 78. To a low order bit input LSBIN of the data synthesis section 78 is supplied an output of a selector 79. The data synthesis section 78 controls a synthesis position so that waveform data supplied to the input MSBIN is located on the higher order bit side of a bit position indicated by bit position indication data BPP and thereby synthesizes the data of the high order bit input MSBIN and the data of the low order bit input LSBIN together to produce data of 32 bits. The data of 32 bits provided by the data synthesis section 78 is delayed by one sample clock by a buffer register 81. Among the output data of 32 bits from the buffer register 81, 16 high order bits MSB16 are applied to "1" input of the selector 79 and 16 low order bits LSB16 are applied to "0" input of the selector 79 and also to a waveform memory write section 82.

The bit position designation counter 80 is a counter of modulo 16 which cumulatively adds bit number data of the current frame provided by the adder 77 in response to the sample clock SCK and produces the bit position indication data BPP in accordance with its count. When the count has overflown (i.e., has exceeded 16), the counter 80 produces an overflow signal OVF.

The overflow signal OVF is applied to a selection control input of the selector 79. When there is no overflow output, the 16 low order bit output LSB16 of the buffer register 81 is selected through the "0" input of the selector 79 and is applied to the low order bit input LSBIN of the data synthesis section 78. When there is an overflow output, the 16 high order bit output MSB16 of the buffer register 81 is selected through the "1" input of the selector 79 and is applied to the low order bit input LSBIN of the data synthesis section 78. The overflow signal OVF is supplied to the waveform memory write section 82 to designate, when there is an overflow output, that the 16 low order bit output LSB16 of the buffer register 81 should be written in the waveform memory 15. The write address of the waveform memory 15 is designated by a write address counter 83. In this write address counter 83, a write start address is initially set and subsequently is incremented as the overflow signal OVF is produced.

The data synthesis section 78 leads data which has been applied to the high order bit input MSBIN to either one of bit position ranges among its 32 bit output and outputs the data therefrom. The 16 bit data which has been applied to the low order bit input LSBIN is led to the 16 low order bit range of the 32 bit output and delivered out therefrom, whereas in the bit position to which the data which has been applied to the high order bit input MSBIN is led, the data which has been applied to the high order bit input MSBIN is preferentially delivered out. This is because the data which has been applied to the high order bit input MSBIN is packed in a bit of "0" near high order bits in the 16 bit data applied to the low order bit input LSBIN and, therefore, the data which has been applied to the high order bit input MSBIN virtually appears directly on the output side.

The bit position indication data BPP assumes 16 different values from 0 to 15 and indicates, by this value, either one of bit positions of the 16 low order bits in the 32 bit output of the data synthesis section 78 thereby to lead the data applied to the high order bit input MSBIN so that the least significant bit of this data will be located at the indicated bit position.

Figures 14A, 14B, 14C:
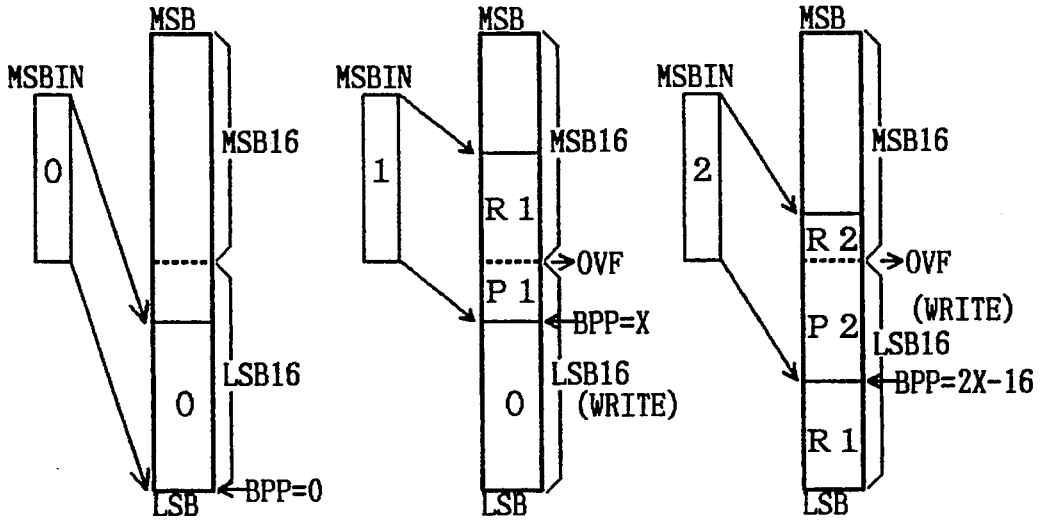
FIGS. 14*a*–14*c* are diagrams for describing a processing for packing data of variable bit length in a memory and writing it therein.

An example of a data synthesis state is shown in FIGS. 14*a*–14*c*. In this example, it is assumed that, when the data of the sample number 0 is applied to the high order bit input MSBIN of the data synthesis section 78, the value of the bit position indicating counter 80 is 0 and the bit position indication data BPP indicates 0. The data of the sample number 0 applied to the high order bit input MSBIN of the data synthesis section 78 in this state is packed in bits nearer to the least significant bit of the data synthesis section 78 as shown in FIG. 14*a*.

At next sample timing, the 16 low order bit data LSB16 is supplied to the low order bit input LSBIN of the data synthesis section 78 through the register 81 and the "0" input of the selector 79. At this time, the bit position indication counter 80 counts bit number x of the data of the sample number 0 and the bit position indication data BPP indicates x. At this time also, data of next sample number 1 is applied to the high order bit input MSBIN of the data synthesis section 78 and this data is packed, as shown in FIG. 14*b*, in a bit position range immediately higher than the data of the sample number 0 in accordance with the indication of BPP=x.

When the data shown in FIG. 14*b*has been provided from the register 81, the bit position indication counter 80 further adds the bit number x of the data of the sample number 1 thereby increasing the count to 2x. This value 2x is assumed to be a value at which overflow is produced. By this overflow, the 16 low order bit data LSB16 of the register 81 is written in the waveform memory 15. In other words, the data of the sample number 0 and a part (denoted by P1) of the data of the sample number 1 are tightly packed in one address of 16 bits.

At this time, the selector 79 selects the 16 high order bit data MSB16 of the register 81 through the "1" input and applies it to the low order bit input LSBIN of the data synthesis section 78. In other words, the remaining portion (denoted by R1) of the data of the sample number 1 is applied to the low order bit input LSBIN of the data synthesis section 78. At this time, data of next sample number 2 is applied to the high order bit input MSBIN of the data synthesis section 78. The value of the bit position indicating counter 80 is BPP=2x−16 and, in response to this indication, as shown in FIG. 14*c*, the data of the sample number 2 is packed in the bit position range immediately higher than the remaining data R1 of the sample number 1.

In this manner, data of the effective bit number (or the effective bit number plus 1 in a case where the waveform data is accompanied by hidden bit data) indicated by the bit number data is extracted and this data is packed and written in the waveform memory 15 without waste.

Description will now be made about the entire flow of the variable bit length adjusting and writing processing according to FIG. 11. In the processing of the first block, a write start address is initially received and set in a write address counter 83. Then, in starting processing of the respective blocks, the least significant bit BNLSB of the block number data then existing is received and used for detecting whether the block number is an even number or an odd number. Thereafter, the sample and frame counter 69 is reset. Then, waveform data indicated by the sample number SN of the sample and frame counter 69 is read from a waveform data buffer BW(A) or BW(B) of the block buffer 55. In accordance with the sample number SN, bit number data of next frame, shift data of next block and compression coefficients of next block are added as hidden bit data to the waveform data. The bit number of the data is determined depending upon presence or absence of the bit number data and hidden bit data of the current frame and the bit number of the data is adjusted to this bit number and the data is packed and written in the waveform memory 15 in the above described manner. The above described processing is repeated for one frame. Thereafter, the bit-number-by-frame is changed and the above described processing is repeated. Upon completion of the processing for one block, this processing is ended.

When writing of the entire block of this waveform has been completed, the write address counter 83 of the waveform memory 15 indicates the end address. In step 39 of FIG. 3, the end address data at this time is stored in the header section or size data indicating a memory address range is obtained from difference between the end address and the write start address and this size data is stored in the header section.

Reproduction Processing

An example of processing for reproducing and acoustically propagating waveform data which has been subjected to the compression and reduction processings and stored in the waveform memory 15 will be described below.

Figure 15:
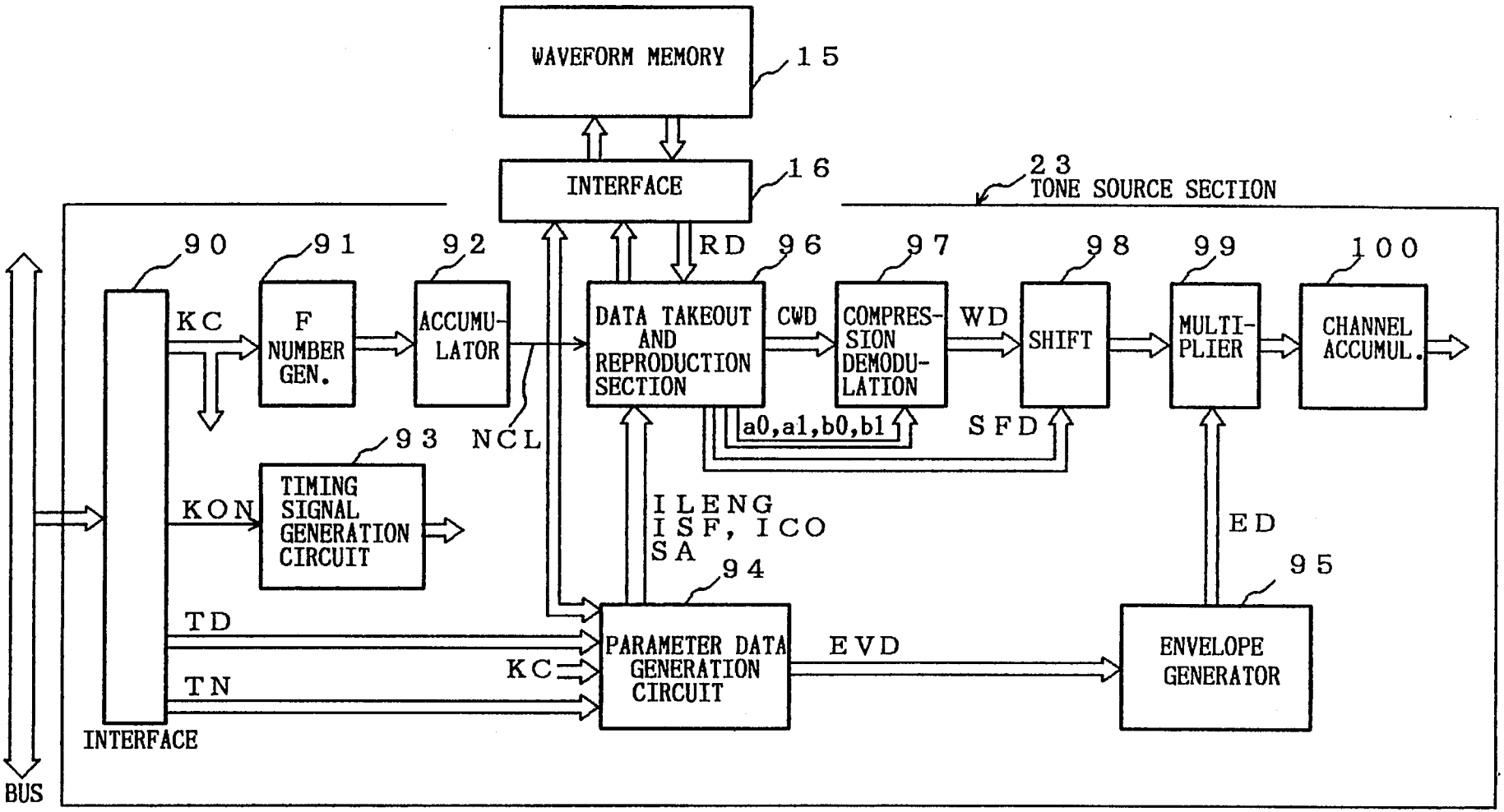
FIG. 15 is a block diagram showing an example of the tone source section in FIG. 2.

The tone source section 23 in FIG. 2 performs the reproduction processing. An example of this processing is shown in FIG. 15. In FIG. 2, the microcomputer scans the keyboard section 22 and the operator section 20 to detect depression and release of keys and detect states of selection of tone color etc. and assigns key depression information to plural (e.g., 8) tone generation channels. The microcomputer produces for each channel a key code KC representing a key assigned to each channel and a key-on signal KON representing the assigned key is kept depressed or has been released, and also produces tone color number data TN representing a selected tone color and touch data TD representing key depression touch. The outputs of the microcomputer are applied to the tone source section 23 through an interface 90. The interface 90 provides key codes KC and key-on signals KON of keys which have been assigned to the respective channels on a time shared basis in accordance with a predetermined channel time division timing and outputs tone color number data TN of the selected tone color and touch data TD. The tone source section 23 performs various processings for 8 channels in response to the data applied from the interface 90 on a time shared basis and produces tone waveform signals for 8 channels on a time shared basis.

An F number generation circuit 91 generates an F number which is a constant corresponding to tone pitch frequency of a tone to be generated in accordance with the key code KC supplied from the interface 90 and consists of, e.g., a ROM or a table. This F number is accumulated repeatedly by an accumulator 92 and a carry signal from a predetermined digit is provided as a note clock pulse NCL. This note clock pulse NCL corresponds to tone pitch frequency of a tone to be generated and designates a sample point increment at each pulse. This note clock pulse NCL, i.e., sample point increment, is a data readout command to the waveform memory 15 for one sample point per one pulse.

A clock and timing signal generation circuit 93 generates a system clock pulse and various other timing signals and supplies these signals to the respective circuits. The circuit 93 also generates and outputs a key-on pulse and a key-off pulse in response to the key-on signal KON supplied from the interface 90. The system clock pulse is a two-phase clock with its one cycle corresponding to a time slot width of one channel. A first key-on pulse KONP1 is a pulse which, when the key-on signal KON has risen from "0" to "1", i.e., upon start of depression of a key, is turen to "1" only once at the time slot of the particular channel. A second key-on pulse KONP2 is a pulse which, at next time division channel of a channel at which the key-on pulse KONP1 has been turned to "1", is turned to "1" only once at a time slot of this channel. A key-off pulse KOFP is a pulse which, when the key-on signal KON has fallen from "1" to "0", i.e., upon release of the depressed key, is turned to "1" only once at the time slot of the particular channel. These pulses are supplied to the respective circuits for controlling processings which are performed in synchronism with key-on and key-off.

A parameter data generation circuit 94 generates various parameter data for setting a tone color of a tone, performing a touch control and key scaling in response to the tone color number data TN, touch data TD and key code KC supplied from the interface 90. Parameter data generated with respect to the selected tone color, key touch and key-scaling include, for example, envelope setting data EVD for setting an envelope, initial data length data ILENG for designating the data bit length of the first frame of the first block, compression coefficient data ICO for the first block and shift data ISF for the first block. Parameter data which are stored in the header section of the waveform memory 15 among these parameter data are read through the waveform memory interface 16.

An envelope generator 95 generates and outputs envelope waveform data ED for each channel on a time shared basis in response to the key-on pulses KONP1 and KONP2, key-off pulse KOFP and envelope setting data EVD.

A data takeout and reproduction section 96 performs sample point increment for identifying the sample point number of data to be read from the waveform memory 15 in response to the note clock pulse NCL supplied from the accumulator 92 and identifies, from this sample point number and the data length of the data to be read out, the address at which the data to be read out is stored and thereupon generates an address signal CA. This address signal CA is a relative address within a region in which waveform data corresponding to one tone color is restored. By adding the start address data SA which is an absolute address to this address signal CA, the generated address signal is converted to an absolute address signal and address-inputted in the waveform memory 15.

The waveform memory 15 provides stored data of 16 bits from one memory address in response to the input address signal.

The data takeout and reproduction section 96 receives data RD of 16 bits read from the waveform memory 15 and provides data for necessary one sample point having a variable bit length. In a case where data for necessary one sample point is stored over plural addresses, necessary data are connected together from among data read from the plural addresses.

Further, the data takeout and reproduction section 96 takes out "hidden bit" data from data of 16 bits read from the waveform memory 15 and connects them together to provide a set of hidden bit data HB0–HB3, HS0–HS3, HC0–HC7. The data takeout and reproduction section 96 further takes out bit number indicating data for each frame, shift data for each block and compression coefficient for each block which have been stored in the waveform memory 15 as "hidden information". By utilizing the bit number indicating data taken out of the hidden bit, the data takeout and reproduction section 96 performs a processing for taking out data for one sample point having a variable bit length from the data of 16 bits read from the waveform memory 15. In the initial frame, the section 96 takes out data for one sample point having a variable bit length by using the initial data length data ILENG.

Waveform sample data CWD taken out by the data takeout and reproduction section 98 is applied to a compression demodulation circuit 97 where it is demodulated to normal PCM-coded waveform data WD. In this case, the compression coefficients a0, a1, b0 and b1 which have been taken out of the hidden bits are used for performing a compression demodulation operation with respect to waveform data of the corresponding block section. In the first block section, the demodulation operation is performed by using the initial compression coefficient data ICO from the parameter data generation circuit 94.

The waveform sample data WD provided by the compression data demodulation circuit 97 is applied to a shift circuit 98 where it is restored to a weight which is common throughout all blocks. In this case, by using the shift data SFD taken out of the hidden bits, a processing for restoring the weight of waveform data of the corresponding block section is performed. In the first block section, shift data SFG is generated by using the initial shift data ISF from the parameter data generation circuit 94 and used for the weight restoration operation. The data shift direction by this shift circuit 98 is reverse to the shift direction by the shift circuit 47 of FIG. 5.

The waveform data provided from the shift circuit 98 is multiplied in a multiplier 99 by the envelope waveform data Ed from the envelope generator 95 whereby the tone volume amplitude of the data is controlled in accordance with envelope waveform.

The reproduction and control of waveform data to the multiplier 99 are performed in a channel time division fashion and outputs of the multiplier 99 are accumulated by a channel accumulator 100 with respect to the respective channels during one channel time division cycle whereby tone waveform data of all channels is summed. The output of the accumulator 100 is supplied to the digital-to-analog converter 24 (FIG. 2) and then is acoustically propagated through the sound system 25.

Description of the Data Takeout and Reproduction Section

Figure 16:
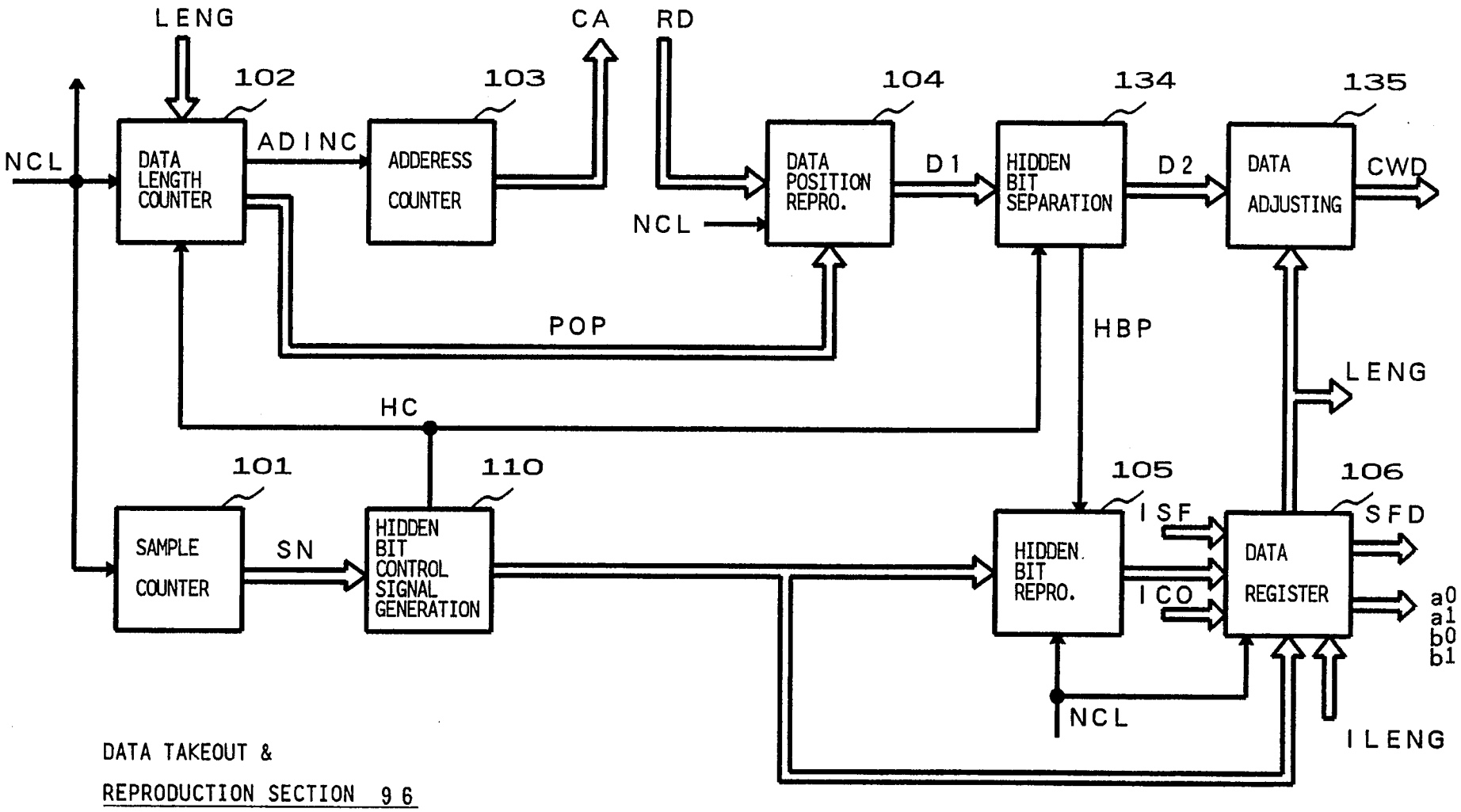
FIG. 16 is a block diagram showing an example of internal construction of the data takeout and reproduction section in FIG. 15.

FIG. 16 is a block diagram showing an example of the internal structure of the data takeout and reproduction section 96. The note clock pulse NCL for ordering readout of data at each one sample point is applied to a sample counter 101, a data length counter 102, an address counter 103 and a position reproduction circuit 104, a hidden bit reproduction circuit 105 and a data register 106.

Figure 17:
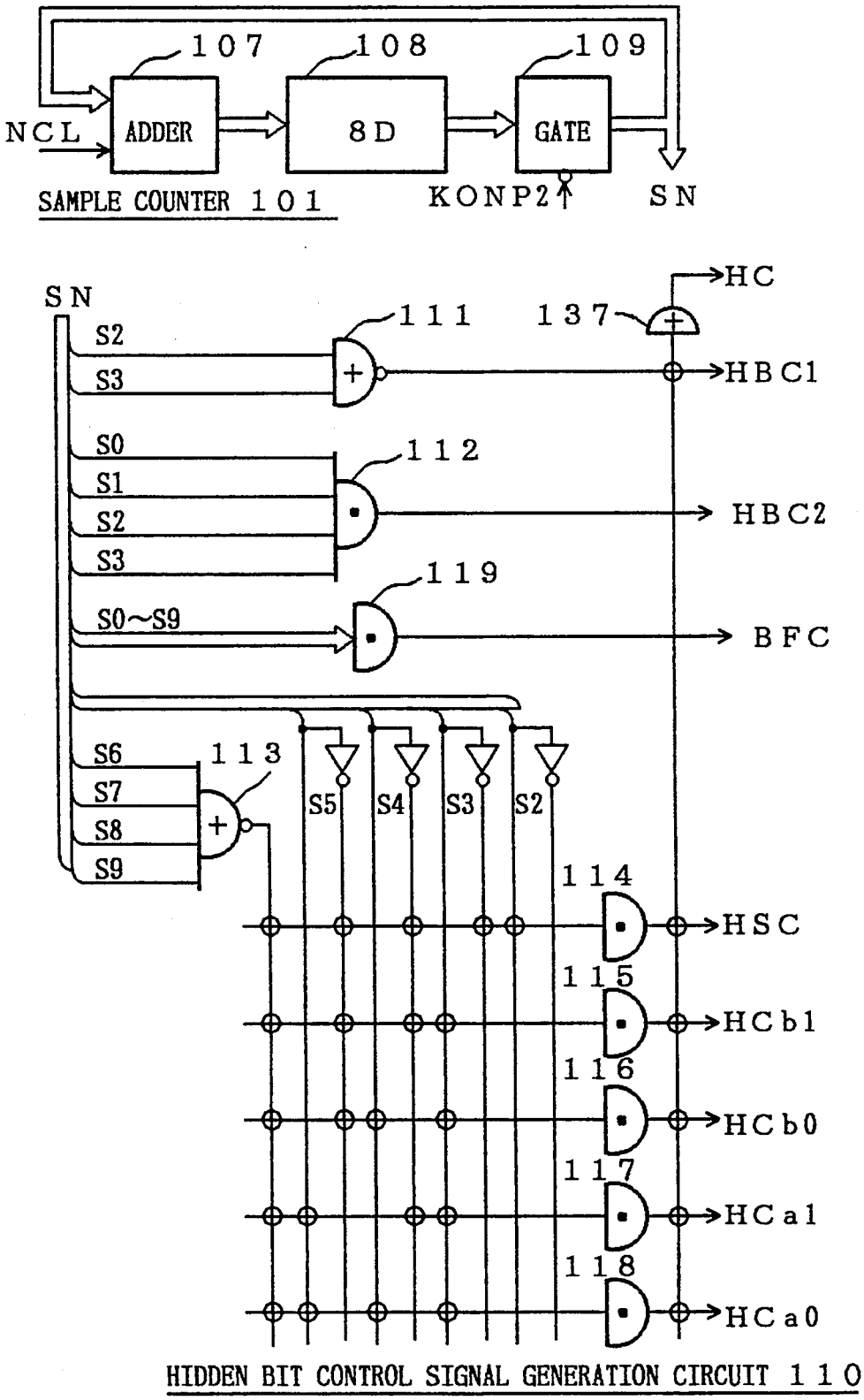
FIG. 17 is a block diagram showing a specific example of the sample counter and the hidden bit control signal generation circuit in FIG. 16.

The sample counter 101 counts the note clock pulse NCL and produces the sample number SN which designates the number of a sample point to be reproduced by a relative number in one block. A specific example of the sample counter 101 is shown in FIG. 17. The sample counter 101 includes an adder 107, an 8-stage/4-bit shift register 108 storing dynamically result of addition by the adder 107 in synchronism with the time division timing for each channel, and a gate 109 gating the output of the shift register 108. The output of the gate 109 is applied to the adder 107 and is added to the note clock pulse NCL which is applied to the other input of the adder 107. The output of the gate 109 is provided as the sample number SN. This 10-bit sample number SN identifies the relative sample numbers 0–1023 in one block. The gate 109 is closed by the second key-on pulse KONP2 and otherwise is opened. The reference character "8D" in the block of the shift register 108 represents that the shift register is of 8 stages. The shift register 108 is shift controlled by the above described two-phase system clock pulse in synchronism with the channel time division timing. The same applies to the other shift registers designated by the reference characters "8D".

By this construction, the sample counter 101 is once cleared to the initial state of key depression by the second key-on pulse KONP2 and subsequently counts the note clock pulse NCL thereby producing the sample number SN designating the number of sample point to be reproduced by the relative number 0–1023 in one block.

The produced sample number SN is applied to the hidden bit control signal generation circuit 110. The hidden bit control signal generation circuit 110 recognizes the sample number at which each hidden bit data HB0–HB3, HS0–HS3 and HC0–HC7 is assigned. For recognizing initially the first 4 sample numbers in one frame to which the hidden bit data HB0–HB3 corresponding to the bit number data of 4 bits for each frame is assigned, a NOR gate 111 is provided. Low order 4 bits S0, S1, S2 and S3 counting from the LSB in the sample number SN consisting of 10 bits recognize 16 sample points in one frame and relatively high order 2 bits S2 and S3 among them are applied to the NOR gate 111. At the initial 4 sample points in one frame, the 2 bits S2 and S3 of the sample number SN are all "0" and the output of the NOR gate 111 is "1". At the other sample points, the output of the NOR gate 111 is "0" . The output of the NOR gate 111 is supplied to other circuits as a hidden bit control signal HBC1 for the bit number data. When this signal HBC1 is "1", it represents that the current sample point is one at which the hidden bits HB0–HB3 corresponding to the bit number data are assigned. The 4 low order bits S0, S1, S2 and S3 of the sample number are applied to an AND gate 112. At the last sample point of the frame, these bits SO, S1, S2 and S3 all become "1" and, therefore, the output of the AND gate 112 becomes "1" and this signal is supplied to the other circuits as a frame change signal HBC2.

For recognizing 4 sample numbers from the fifth to eighth sample numbers in the first frame of each block to which the hidden bit data HS0–HS3 corresponding to the shift data of 4 bits for each block are assigned, a NOR gate 113 and an AND gate 114 are provided. High order 4 bits S6, S7, S8 and S9 counting from the MSB in the sample number SN are applied to the NOR gate 113. In the first 4 frames (frames 0 to 3) in one block, the 4 high order bits S6, S7, S8 and S9 are all "0" and, therefore, the output of the NOR gate 113 becomes "1". The ouptut of the NOR gate 113 and signals obtained by inverting the third bit S2 of the sample number SN and the fourth to sixth bits S3, S4 and S5 of the sample number SN are applied to the AND gate 114. It is at the 4 sample numbers 4, 5, 6 and 7 from the fifth to the eighth sample numbers in the first frame 0 of each block that the output of the NOR gate 113 is "1" and the bits S3, S4 and S5 are all "0". At this time, the output of the AND gate 114 is turned to "1" and this signal is supplied to the other circuit as the shift data hidden bit control signal HSC.

For recognizing 8 sample numbers from the ninth to sixteenth in each of 4 frames (frames 0 to 3) in each block to which the 8-bit hidden bit data HC0–HC7 corresponding to the 4 compression coefficient data a0, a1, b0 and b1 for each block, a NOR gate 113 and AND gates 115 to 118 are provided. As described previously, in the initial 4 frames (frames 0–3) in one block, the ouptut of the NOR gate 113 becomes "1". This output signal of the NOR gate 113 and signals obtained by inverting the fourth bit S3 of the sample number SN and the fifth and sixth bits S4 and S5 of the sample number SN are applied to the AND gate 115. It is at the 8 sample numbers 8–15 from the ninth to the sixteenth sample numbers in the initial frame of each block that the ouptut of the NOR gate 113 is "1", the bit S3 is "1" and the bits S4 and S5 are "0". At this time, the output of the AND gate 115 is turned to "1" and this signal is supplied to the other circuits as the hidden bit control signal HCb1 for the compression coefficient b1. As shown in FIG. 12, the hidden bit data HC0–HC7 for the compression coefficient b1 are assigned to these sample numbers 8–15.

The output signal of the NOR gate 113 and signals obtained by inverting the fourth bit S3 of the sample number SN and the fifth and sixth bits S4 and S5 of the sample number SN are applied to the AND gate 116. It is at the 8 sample numbers 24–31 from the ninth to the sixteenth in the second frame of each block that the output of the NOR gate 113 is "1" and the bits S3 and S4 are "1" and the bit S5 is "0". At this time, the output of the AND gate 116 is turned to "1" and this signal is supplied to the other circuits as a hidden bit control signal HCb0 for the compression coefficient b0. As shown in FIG. 12, the hidden bit data HC0–HC7 for the compression coefficient b0 are assigned to these sample numbers 24–31.

Likewise, the output signal of the NOR gate 113 and signals obtained by inverting the fourth bit S3, sixth bit S5 and fifth bit S4 of the sample number SN are applied to an AND gate 117. At the 8 sample numbers 40–47 from the ninth to the sixteenth in the third frame of each block, the output of the AND gate 117 is turned to "1" and this signal is supplied to the other circuits as a hidden bit control signal HCa1 for the compression coefficient a1. The output signal of the NOR gate 113 and the fourth to sixth bits S3, S4 and S5 of the sample number SN are applied to an AND gate 118. At the 8 sample numbers 56–83 from the ninth to the sixteenth in the fourth frame of each block, the output of the AND gate 118 is turned to "1" and this signal is supplied to the other circuits as a hidden bit control signal HCa0 for the compression coefficient a0.

The respective hidden bit control signals HBC1–HCa0 are OR-synthesized by an OR gate 137 and a hidden bit control signal HC representing that there is a hidden bit is provided.

All bits of the sample number SN are applied to an AND gate 119 and the output of this AND gate 119 is turned to "1" at the last sample number 1023 of the block. This signal is supplied to the other circuits as a block end control signal BFC.

Reverting to FIG. 16, the data length counter 102 is a counter of modulo 16 which inputs the data length indicating data LENG provided by the data register 106 and accumulates the data LENG at each timing of the note clock pulse NCL. This modulo number 16 corresponds to the bit number 16 of one address in the waveform memory 15. The count of the data length counter 102 indicates the border line of the variable length data in the memory address.

Figure 18:
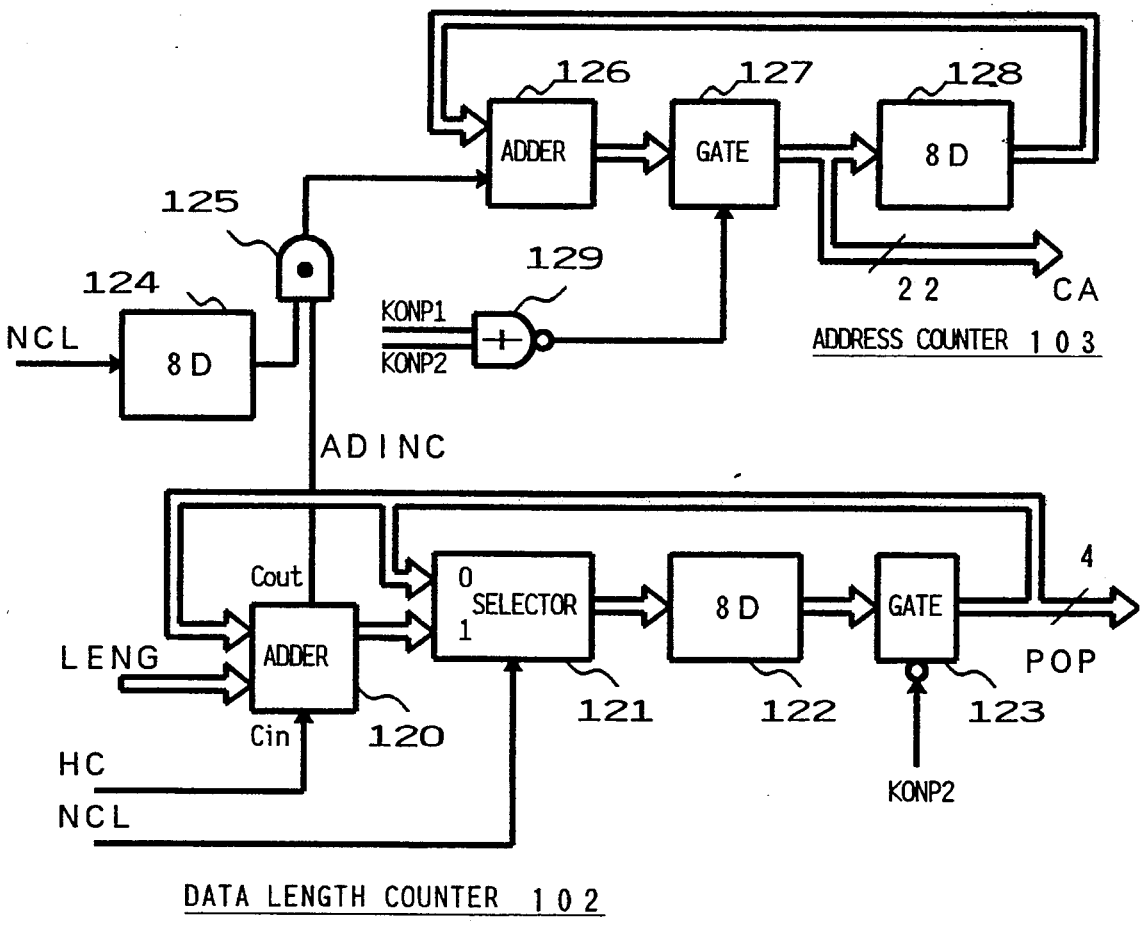
FIG. 18 is a block diagram showing a specific example of the data length counter and the address counter in FIG. 16.

A specific example of the data length counter is shown in FIG. 18. The data length counter 102 includes an adder 120, a selector 121 which receives result of addition by the adder 120 at its "1" input, an 8-stage/4-bit shift register 122 receiving the output of the selector 121 and storing it dynamically in synchronism with the time division timing for each channel and a gate 123 for gating the output of the shift register 122. The output of the gate 123 is applied to the adder 120 and added to the data length indicating data LENG applied to the other input of the adder 120. The output of the gate 123 is applied to "0" input of the selector 121. The gate 123 is closed by the second key-on pulse KONP2 and otherwise is opened. When the note clock pulse NCL is produced (i.e., "1"), the selector 121 selects result of addition by the adder 120 applied to its "1" input and, when the note clock pulse NCL is not produced (i.e., "0"), the selector 121 selects and holds the count applied to its "0" input.

By adopting this construction, the data length counter 102 is once cleared to the initial key depression state by the second key-on pulse KONP2 and subsequently accumulates the data length indicating data LENG each time the note clock pulse NCL is produced. The data length indicating data LENG indicates net data length, i.e., bit number, of waveform data portion and does not indicate data length including the hidden bits HB0–HC7. Accordingly, in order to have actual data length added at a sample point including the hidden bits HB0–HC7, the signal HC obtained by OR-synthesizing the above described hidden bit control signals HBC1, HSC, HCb1, HCb0, HCa1 and HCa0 is applied to a carry-in input Cin of the adder 120 to be added by 1 as the hidden bit portion. The count output of the data length counter 102 is provided by the gate 123 and supplied to the other circuits as a pull-out pointer (takeout pointer) POP. This pull-out pointer POP indicates a bit position in the memory address at which the least significant bit of the data at one sample point to be taken out is located.

In the example shown in FIG. 13, the pull-out pointer POP at the first sample point 0 indicates "0" by clearing by the key-on pulse KONP2, i.e., the least significant bit 0 in the memory address. Upon arrival of the timing of the note clock pulse NCL, 11 of the data length indicating data LENG and 1 of the hidden bit control signal HBC are added together by the adder 120 and the pull-out pointer POP thereby becomes 12 indicating the bit 12 in the memory address. Upon arrival of the timing of next note clock pulse NCL, the pull-out pointer POP becomes $12+12=24$ and "1" is produced at the carry-out output Cout of the adder 120 whereby the result of addition becomes 8 indicating the bit 8 in the memory address. In this manner, the pullout pointer POP indicates the bit position in the memory address at which the least significant bit of data of one sample point to be taken out is located.

The signal from the carryout output Cout of the adder 120 is provided from the data length counter 102 as an address increment pulse ADINC.

The address counter 103 performs address counting for accessing the waveform memory 15 in response to the address increment pulse ADINC and the note clock pulse NCL and produces the address signal CA which is a relative value of the read address. The address increment pulse ADINC produced at the timing of the note clock pulse NCL is used as an effective address increment pulse to count up the address by 1.

A specific example of the address counter 103 is shown in FIG. 18. The address counter 103 includes an 8-stage/1-bit shift register 124 for delaying the note clock pulse NCL, an AND gate 125 receiving the output this shift register 124 and the address increment pulse ADINC, an adder 126 which receives at one input thereof the output of the AND gate 125, a gate 127 gating result of addition by the adder 126 and an 8-stage/22-bit shift register 128 receiving the output of the gate 127 and storing it dynamically in synchronism with the time division timing for each channel. The output of the shift register 128 is applied to the adder 126 and added to the output of the AND gate 125. The key-on pulses KONP1 and KONP2 are applied to a NOR gate 129 and the gate 127 is controlled by the output of the NOR gate 129.

In the data length counter 102, the timing at which the carryout output is produced from the adder 120 is delayed due to the delay by the shift register 122 by 8 system clocks from the timing of the note clock pulse NCL. Accordingly, when the address increment pulse ADINC has been produced as a result of adding the data length indicating data LENG at the timing of the note clock pulse NCL, the output of the AND gate 125 is turned to "1" and the address counter 108 counts up by 1. The address counter 103 provides the output of the gate 127 as the address signal CA.

In the example of FIG. 13, the address signal CA initially indicates "0", i.e., memory address A0, due to clearing by the key-on pulses KONP1 and KONP2 and data of 16 bits stored at this address A0 is read out. Upon arrival of the timing of next note clock pulse NCL, the addition output of the adder 120 of the data length counter 102 becomes 12 as described above and this output is selected by the selector 121 and applied to the shift register 122. Then, 8 system clocks later, the pull-out pointer POP=12 is produced. At this time, in the adder 120, 12 is further added and the carryout output Cout thereby becomes "1", so that "1" of the address increment pulse ADINC and the note clock pulse NCL which has been delayed by 8 system clocks are applied to the AND gate 125 and the address counter 103 is thereby counted up. The address signal CA therefore indicates "1", i.e., memory address A1, and data of 16 bits stored in this address A1 is read out. On the other hand, in the selector 121, the output of the adder 120 is not selected but the pull-out pointer POP of the data length counter 102 maintains 12.

As will be understood from the foregoing description, the pull-out pointer POP indicates, as regards data of the sample number 1 stored over the two addresses A0 and A1, the bit 12 in the address A0 at which the least significant bit of the data is located and the output address signal CA of the address counter 103 indicates the next address A1. In other words, the address signal CA precedes the pull-out pointer POP by one address. This is because, as will be described more fully later, a data position reproduction circuit 104 temporarily stores, for reproducing data for one sample point, stored over two addresses, data of a preceding address read from the waveform memory 15 and the pullout pointer POP indicates the least significant bit of data to be taken out with respect to the read out data of the preceding address which has been temporarily held.

The data position reproduction circuit 104 receives data RD of 16 bits read from the waveform memory 15 and performs (a) a function of reproducing data for one sample point stored over two addresses in a combined form and (b) a function of pretreatment for taking out a necessary portion only of data for one sample of a variable bit length from the data of 16 bits by performing a processing for adjusting the bit position of the data to the least significant bit of the data of the variable bit length.

Figure 19:
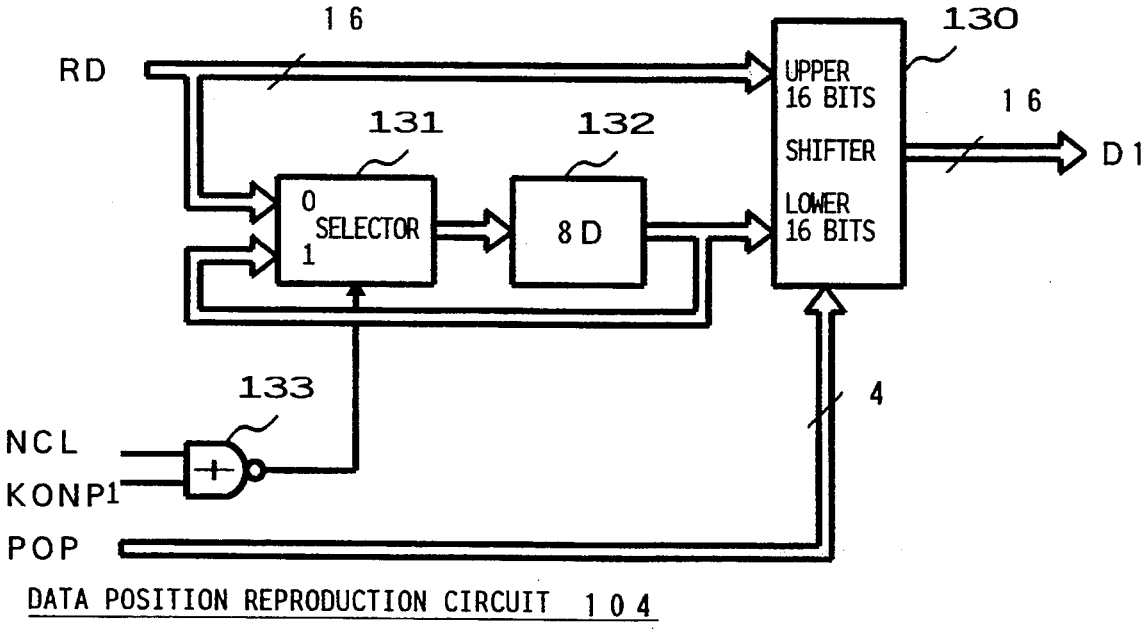
FIG. 19 is a block diagram showing a specific example of the data position reproduction circuit in FIG. 16.

A specific example of the data position reproduction circuit 104 is shown in FIG. 19. The data position reproduction circuit 104 includes a 32-bit parallel input/16-bit parallel output shifter 130. To 16 high order bits of the shifter 130 is applied directly the data RD of 16 bits read from the waveform memory 15. This read out data RD is applied to "0" input of a selector 131. The output of the selector 131 is applied to an 8-stage/16-bit shift register 132 and the output of the shift register 132 is applied to "1" input of the selector 131 and also to 16 low order bit inputs of the shifter 130. The note clock pulse NCL and the key-on pulse KONP1 are applied to a NOR gate 133. When the output signal of the NOR gate 133 is "0", the "0" input of the selector 131 is selected and when the output signal of the NOR gate 133 is "1", the "1" input of the selector 131 is selected.

To a control input of the shifter 130 is applied the pull-out pointer POP from the data length counter 102 of FIG. 18. This pull-out pointer POP indicates a bit corresponding to the least significant bit of data to be taken out as 16-bit parallel output data from 32-bit parallel input data. When, for example, the POP is 0, the least significant bit of the 32-bit parallel input data is indicated as the least significant bit of the 16-bit parallel output data and data of 16 higher order bits from the least significant bit is taken out. When, for another example, the POP is 1, the second least significant bit in the 32-bit parallel input data is indicated as the least significant bit of the 16-bit parallel output data and data of 16 higher order bits from this bit is taken out. When, for another example, the POP is 12, the thirteenth bit counting from the least significant bit in the 32-bit parallel input data is indicated as the least significant bit of the 16-bit parallel output data and data of 16 higher order bits from this bit is taken out.

Among the 32-bit parallel input of the shifter 130, data of 16 high order bits is the data RD which is currently read form the waveform memory 15 and data of 16 low order bits which is applied from the shift register 132 is data read from the address preceding the current address by one address. Accordingly, data read from the two addresses is loaded in parallel in the shifter 130, so that when data for one sample point is stored over two addresses, necessary data for one sample point can be taken out of the parallel data totalling 32 bits for two addresses loaded in the shifter 130.

The pull-out pointer POP indicates the least significant bit of data of variable bit length and, therefore, the bit position of data can be adjusted to the least significant bit of the data of variable bit length by indicating by the pull-out pointer POP an input bit position of data to be taken out as the least significant bit of the 16-bit parallel output data whereby a pretreatment for taking out a necessary portion only of the data for one sample point of variable bit length can be taken out of 16-bit data can be performed.

Figures 20A, 20B:
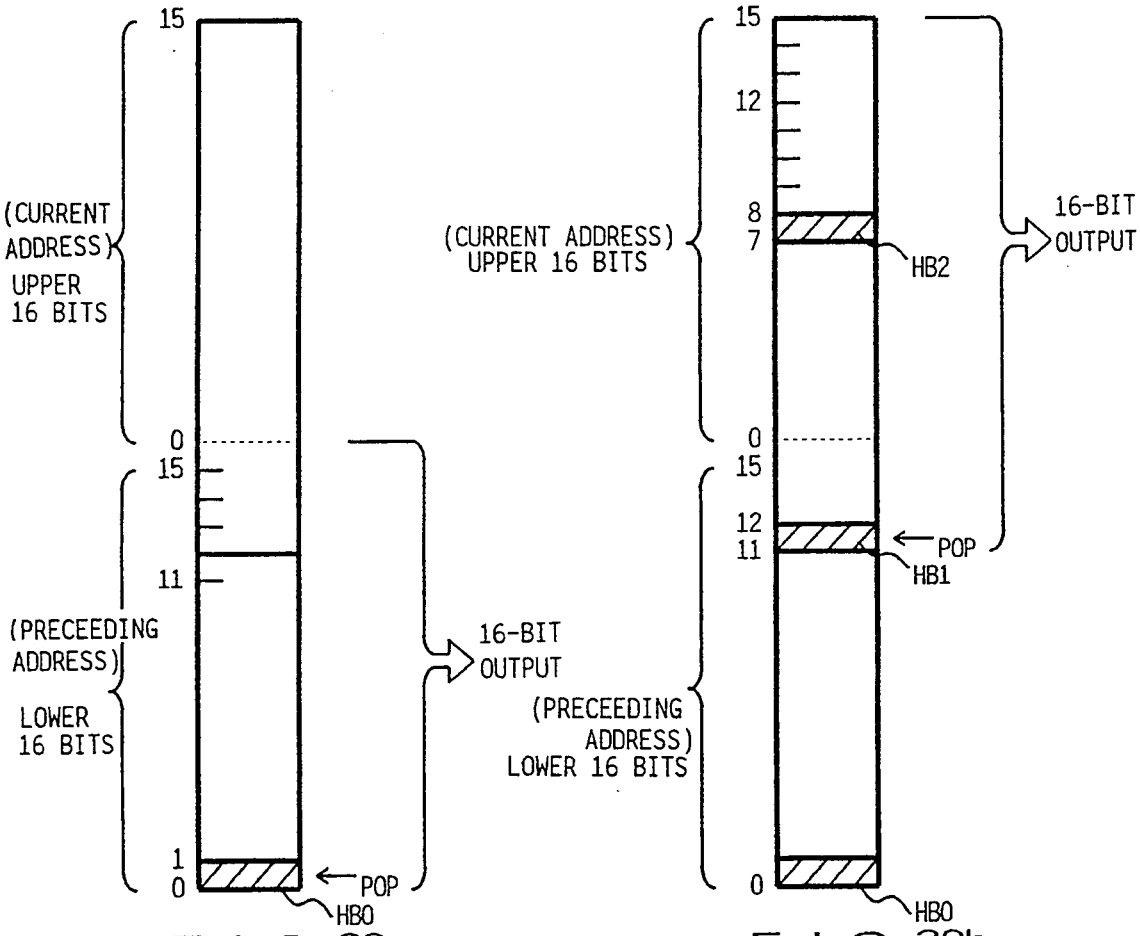
FIGS. 20*a* and 20*b* are diagrams for describing an example of operation of the shifter in FIG. 19.

By way of example, as shown in FIG. 13, when the first key-on pulse KONP1 has been produced, the address counter 103 in FIG. 18 is cleared and the address signal CA thereby becomes "0" and data is read from the address A0. At this time, the selector 131 selects the read out data RD from the address A0 by the output "0" from the NOR gate 133 and loads this data in the shift register 132. In next cycle, the selector 131 selects the output of the shift register 132 by the output "1" from the NOR gate 133 and holds the read data RD from the address A0 in storage. At this time, the pull-out pointer POP is "0" and data of 16 low order bits in the input to the shift register 132, i.e., the read data RD from the address A0 held in the shift register 132, is directly selected and provided. This data contains the whole data for the sample point 0 in 12 low order bits. In other words, the data for the sample point 0 to be taken out first is taken out its entirety with its least in significant bit being register with the least in significant bit of the 16-bit output. This state is schematically shown in FIG. 20*a*.

Then, upon generation of the note clock pulse NCL, as described above, the pull-out pointer POP becomes "12" 8 system clocks later and the address signal CA is changed to the address A1 (see FIG. 18). Since, however, the note clock pulse NCL applied to the NOR gate 133 is not delayed, the address signal CA has not been changed yet when the output of the NOR gate 133 becomes "0" by this note clock pulse NCL, so that the read data RD from the address A0 is selected by the selector 131 and stored in the shift register 132. Accordingly, when the read address of the waveform memory 15 has been changed to A1 8 system clocks later and the read out data RD from the address A1 is applied to 16 high order bits of the shifter 130, read out data from the preceding address A0 is supplied from the shift register 132 to 16 low order bits of the shifter 130. Thus, read out data from the two timewise adjacent addresses are applied in parallel to the input of the shifter 130. At this time, the pull-out pointer POP is "12" indicating the bit position of the least significant bit of the data of the sample point 1 at the preceding address A0. By this arrangement, 16-bit data including the least significant bit of the data for the sample point 1 as the least significant bit and higher order bits is taken out of the shifter 130. This data contains the data for the sample point 1 in its entirety in 12 low order bits. Thus, the data for the sample point 1 stored separately over the two addresses is combined to one data and is provided with its least significant bit being in register with the least significant bit of the 16-bit output. This state is schematically shown in FIG. 20*b*.

In this manner, 16-bit data D1 in which the object data of variable bit length to be taken out is arranged in its order from the least significant bit is provided from the shifter 130. Since this 16-bit data D1 may contain unnecessary data on its high order bit side, the object data for one sample point of variable bit length has not necessarily been taken out in this stage. A further processing therefore is necessary.

Reverting to FIG. 16, the data D1 provided from the shifter 130 of the data position reproduction circuit 104 is applied to a data adjusting circuit 135 through a hidden bit separation circuit 134. The hidden bit separation circuit 134 takes out net waveform data of the data D1 by separating hidden bits HB0–HC7 from the data D1 in case the hidden bits HB0–HC7 are included therein and supplies the taken out net data to the data adjusting circuit 135 as data D2. The data adjusting circuit 135 is provided for taking the object waveform sample data of variable bit length for one sample out of the data D2. A one-bit hidden bit possibility signal HBP (a signal representing that if has possibility of being one of the hidden bits HB0–HC7) separated by the hidden bit separation circuit 134 is applied to a hidden bit reproduction circuit 105. The hidden bit reproduction circuit 105 reproduces a set of hidden bit data HB0–HB3, HS0–HSS3 and HC0–HC7 on the basis of the hidden bit possibility signal HBP provided by the hidden bit separation circuit 134. The reproduced hidden bit data HB0–HB3, HS0–HS3 and HC0–HC7, i.e., bit number data (data length indicating data LENG) for each frame, shift data (weight coefficient) for next block and compression coefficient data a0, a1, b0 and b1 for next block are supplied to a data register 106.

Figure 21:
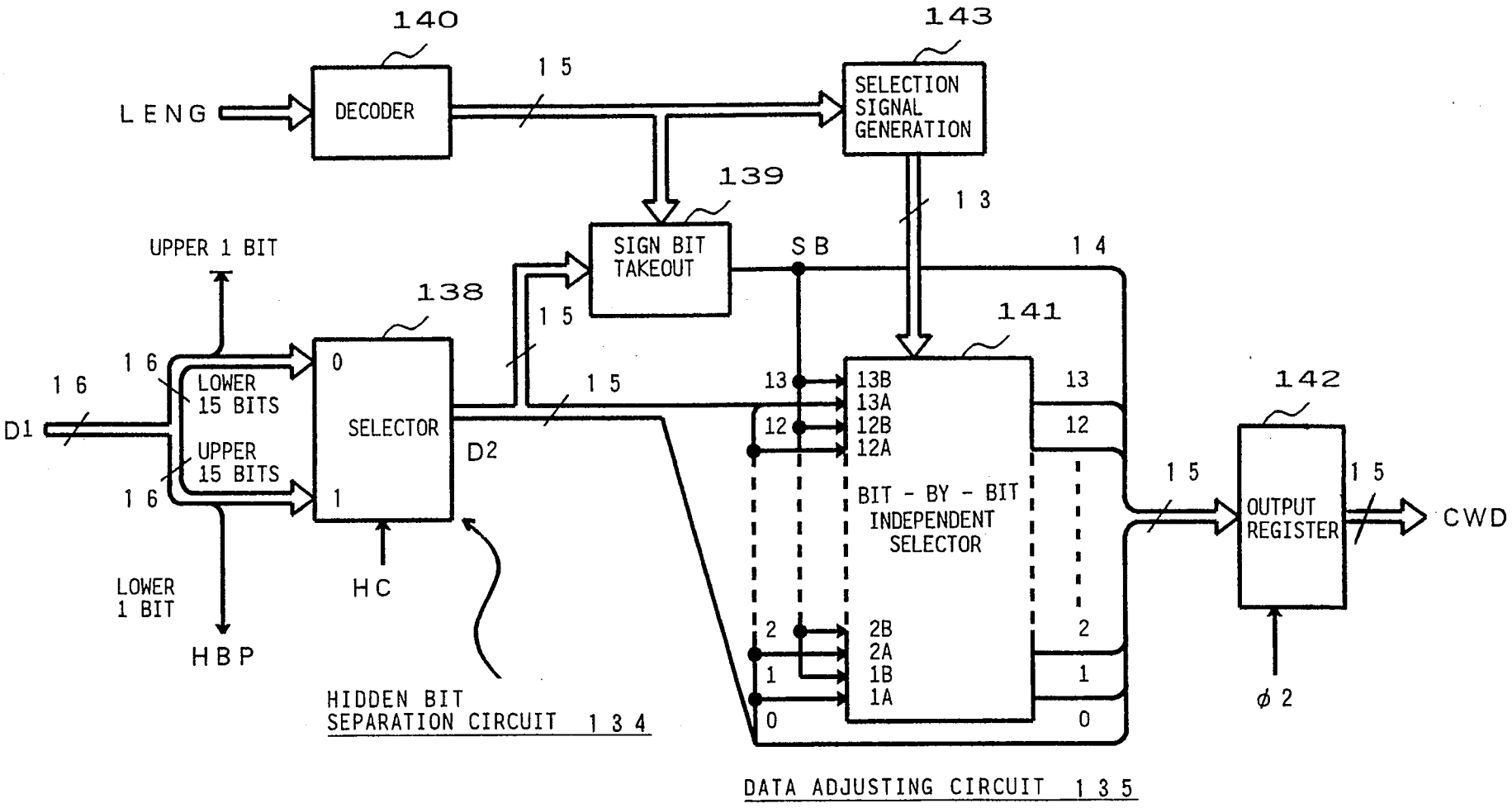
FIG. 21 is a block diagram showing a specific example of the hidden bit separation circuit and the data adjusting circuit in FIG. 16.

A specific example of the hidden bit separation circuit 134 and the data adjusting circuit 135 is shown in FIG. 21.

In this embodiment, the bit length, i.e., size, of the net waveform sample data is variable within a range of 15 bits. The maximum bit length of effective data is 16 bits when it includes a hidden bit and 15 bits when it does not include a hidden bit. The maximum data length of effective data of data D1 which may include a hidden bit is 16 bits and, therefore, this data D1 is taken out as 16-bit data. The maximum bit length of effective data of the data D2 after separating a hidden bit is 15 bits. The most significant bit of waveform data of variable bit length for one sample is a sign bit.

In FIG. 21, the hidden bit separation circuit 134 consists of a selector 138 which receives at its "0" input 15 low order bits of the data D1 and, at its "1" input, 15 high order bits of the data D1. The selector 138 receives at its selection control input the above described hidden bit control signal HC (see FIG. 17) and, when HC is "1", selects "1" input and, when HC is "0", selects "0" input. When, therefore, data for a sample point including the hidden bits HB0–HC7 is taken out, the selector 138 selects 15 high order bits of the data D1 in response to "1" of the hidden bit control signal HC and removes the hidden bit HB0–HC7 located at the least significant bit. This 15-bit data is data which, as described above, is sufficient for securing effective bits of net waveform data. On the other hand, when data for a sample point including no hidden bits HB0–HC7 is taken out, the selector 138 selects 15 low order bits of the data D1 in response to "0" of the hidden bit control signal HC. This 15-bit data also is data which is sufficient for securing effective bits of net waveform data.

The net waveform data D2 which has been removed of a hidden bit in the above described manner is applied to the data adjusting circuit 135. As described above, this data D2 may contain, not only the object waveform data for one sample point, but also a part of waveform data of next sample point.

In taking out the object waveform data for one sample point from the data D2, there will be inconvenience in subsequent data processing if the data is taken out with the data length remaining variable. The data adjusting circuit 135 therefore adjusts the data to a data size of fixed length of 15 bits. For this purpose, the object waveform data for one sample point is taken out of the data D2 and, when the taken out waveform data for one sample point is not sufficient for satisfying the data size of fixed length of 15 bits, a processing for expanding a sign bit to all superfluous high order bits is made whereby the object waveform data of variable bit length for one sample point only is taken while the size of the entire data is adjusted to the fixed length of 15 bits.

In the data adjusting circuit 135 of FIG. 21, the data D2 is applied to a sign bit takeout circuit 139 where a sign bit SB is taken out. The data length indicating data LENG is decoded by a decoder 140 and an output line among 15 decoder output lines corresponding to the most significant bit of the data of variable bit length becomes "1". By the output of the decoder 140, the position of the sign bit SB to be taken out by the sign bit takeout circuit 139 is indicated. When, for example, the bit length is 10 bits, the tenth bit of the data D2 is the most significant bit of the data of variable bit length, i.e., the sign bit SB, and the data of this bit is taken out in response to the signal "1" on the tenth output line of the decoder 140.

In the data adjusting circuit 135 of FIG. 21, a bit-by-bit independent selector 141 selects the object waveform sample data for one sample point, removes a part of data for another sample point, and expands the sign bit SB. Among 14 low order bits of the data D2 (since the most significant bit cannot be any other bit than the sign bit SB which can be established by the output of the sign bit takeout circuit 139, the most significant bit may be excluded), data of the least significant bit 0 belongs always to the object waveform data for one sample point and, therefore, this data may be applied directly to an output register 142 without being applied to the selector 141. Among the 14 low order bits of the data D2, data of bits 1–13 other than the least significant bit 0 are applied to bit-by-bit A inputs 1A–13A of the selector 141. Signal of the sign bit SB taken out by the sign bit takeout circuit 139 is applied commonly to bit-by-bit B inputs 1B–13B of the selector 141. A bit-by-bit control in the selector 141 is made by signals on 13 signal lines provided by a selection signal generation circuit 143. The selection signal generation circuit 143 provides, responsive to an output signal of the decoder 140, a selection control signal "1" for all bits located at bit positions of the sign bit SB and higher bits.

When, for example, the sign bit SB is bit 1 which is the second least significant bit in the data D2, the 13 signal lines of the selection signal generation circuit 143 all become "1" and the bit-by-bit independent selector 141 selects the sign bits SB of the B inputs B1–B13 at all bits. When the sign bit SB is bit 2 which is the third bit from the least significant bit, a low order one of the 13 signal lines of the selection signal generation circuit 143 becomes "0" and the 12 signal lines of higher orders become "1" and the bit-by-bit independent selector 141 selects waveform data of the A input 1A at bit 1 and selects the sign bits SB of the B inputs 2B–13B at bits 2–13. When the sign bit SB is bit 3 which is the fourth bit from the least significant bit in the data D2, the two low order signal lines of the selection signal generation circuit 143 become "0" and the 11 higher order lines thereof become "1" and the bit-by-bit independent selector 141 selects waveform data of the A inputs 1A and 2A at bits 1 and 2 and selects the sign bits SB of the B inputs 3B–13B at bits 3–13. Likewise, as the position of the sign bit SB is shifted, the manner of the bit-by-bit selection is also shifted and, as a result, the object waveform data for one sample point is selectively taken out and data of other sample point is removed and instead the sign bit SB is expanded.

Data of total bits of 15 consisting of the least significant bit of the data D2, the 13 bit output of the selector 141 and the sign bit SB taken out of the sign bit takeout circuit 139 is applied to an output register 142 and stored in the register 142 at a timing of rising of a system clock pulse $\phi 2$. The rising timing of this system clock pulse $\phi 2$ occurs during one time slot of the time division channel timing and the data is stored after the data in the time division channel timing has sufficiently risen. The output of the output register 142 is provided as waveform data CWD for one sample which has been taken out.

Figure 22:
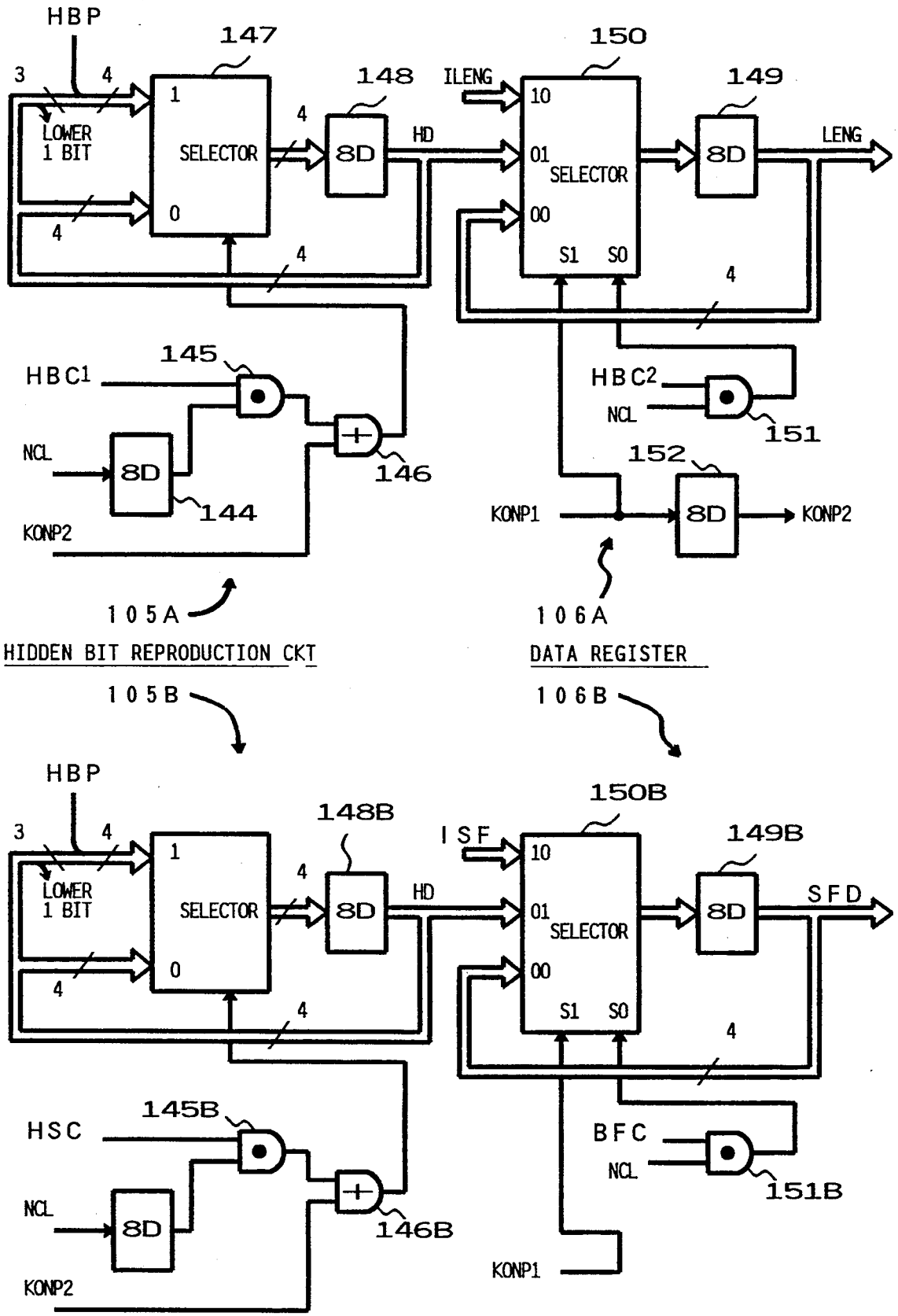
FIG. 22 is a block diagram showing a specific example of the hidden bit reproduction circuit and the data register in FIG. 16.

FIGS. 22 and 23 show specific examples of the hidden bit reproduction circuit 105 and the data register 106. The hidden bit reproduction circuit 105 and the data register 106 are provided respectively in correspondence to the type of the hidden bit. In FIG. 22, a specific example of a hidden bit reproduction circuit 105A and data register 106A for "bit number data" and a specific example of a hidden bit reproduction circuit 105B and data register 106B for "shift data" are shown. In FIG. 23, a specific example of hidden bit reproduction circuits 105C–105F and data registers 106C–106F for the respective compression coefficients b1, b0, a1 and a0 are shown.

Referring now to FIG. 22, the hidden bit reproduction circuit 105A and data register 106A for "bit number data" will be described. The hidden bit reproduction circuit 105A includes an AND gate 145 which receives a signal obtained by delaying the note clock pulse NCL by an 8-stage/1-bit shift register 144 and the hidden bit control signal HBC1, an OR gate 146 which receives the second key-on pulse KONP2 and the output of the AND gate 145, a selector 147 which is controlled by the output of the OR gate 146, and an 8-stage/4-bit shift register 148 which receives the output of the selector 147. The output of the shift register 148 is applied directly to "0" input of the selector 147. To the most significant bit in 4 bits of "1" input of the selector 147 is applied a signal of the least significant bit of the data D1 provided from the shifter 130, i.e., the hidden bit possibility signal HBP. To the remaining 3 low order bits of 4 bits of the "1" input of the selector 147 is applied data obtained by shifting the output of the shift register 148 towards the low order bit side by one bit.

By the above described construction, when the second key-on pulse KONP2 has been turned to "1", the "1" input of the selector 147 is selected by the output "1" of the OR gate 146. At this time, as the data D1, data of the sample number 0 read from the address A0 is provided due to address clearing by the first key-on pulse KONP1 and, as the hidden bit possibility signal HBP, the hidden bit HB0 stored with the data of the sample number 0 is provided. Since the output of the shift register 148 may initially take any value, it will be explained as "x" (x may be either 0 or 1). Thus, 4-bit data having contents of HB0, x, x, x from the most significant bit is loaded in the shift register 148 through the "1" input of the selector 147. In next cycle, the output of the OR gate 146 is turned to "0" and the data HB0, x, x, x loaded in the shift register 148 is held by the shift register 148 through the "0" input of the selector 147.

Then, when the note clock pulse NCL has been produced and data of the sample number 1 has been provided as the data D1, the output of the AND gate 145 is turned to "1" by "1" of HBC1 and the delay output "1"of the note clock pulse NCL (delay by the shift register 144 is synchronized with HBC1, see FIG. 17) and the output of the OR gate 146 is turned to "1" whereby the "1" input of the selector 147 is selected. At this time, the hidden bit HB1 stored with the data of the sample number 1 provided as the hidden bit is possibility signal and, therefore, 4-bit data having contents of HB1, HB0, x, x from the most significant bit is loaded in the shift register 148 through the "1" input of the selector 147. In next cycle, the output of the OR gate 146 is turned to "0" and the data HB1, HB0, x, x loaded and held in the shift register 148 through the "0" input of the selector 147.

Then, when the note clock pulse NCL has been produced and data of the sample number 3 has been provided as the data D1, the hidden bit HB2 stored with the data of the sample number 2 is provided as the hidden bit possibility signal HBP and, in the same manner as described above, data having contents of HB2, HB1, HB0, x is loaded and held in the shift register 148.

Further, when the note clock pulse NCL has been produced and data of the sample number 3 has been provided as the data D1, the hidden bit HB3 stored with the data of the sample number 3 is provided as the hidden bit possibility signal HBP and, in the same manner as described above, data having contents of HB3, HB2, HB1, HB0 is loaded and held in the shift register 148.

Thereafter, since the hidden bit control signal HC1 is "0", the output of the AND gate 145 is not turned to "1" even when the note clock pulse NCL has been produced and, accordingly, the data having contents of HB3, HB2, HB1, HB0 is held by the shift register 148.

In the above described manner, the 4-bit hidden bits HB3, HB2, HB1, HB0 are reproduced and held in the shift register 148. These hidden bits are supplied to the data register 106A as hidden information HD designating the data bit length of data for next frame.

The data register 106A includes an 8-stage/4-bit shift register 140 and a selector 150. To "10" input of the selector 150 is applied initial data length data ILENG and to "01" input of the selector 150 is applied the hidden information HD, i.e., data indicating the data bit length of data for next frame, and to "00" input of the selector 150 is applied the output of the shift register 149. To a high order bit input of 2-bit control input of the selector 150 is applied the first key-on pulse KONP1 and to a low order bit input of the 2-bit control input is applied the output of an AND gate 151. To the AND gate 151 are applied a frame change signal HBC2 from the AND gate 112 in FIG. 17 and the note clock pulse NCL.

By this arrangement, when the key-on pulse KONP1 is "1", the selector 150 selects the initial data length data ILENG at the "10" input thereof and loads this data in the shift register 140. In next cycle, the selector 150 selects the "00" input and holds the loaded data ILENG. The output of the shift register 149 is supplied as described previously to the respective circuits as the data length indicating data LENG. Accordingly, in the initial frame 0, the initial data length data ILENG supplied from the parameter generation circuit 94 is used as the data length indicating data LENG.

In this frame 0, as described above, the hidden information HD indicating the data bit length of data for the next frame is supplied to the selector 150.

Then, when the frame has been changed, the output of the AND gate 151 is turned to "1" and the selector 150 selects the information HD at the "01" input thereof and loads this information in the shift register 149. In next cycle, the selector 150 selects the "00" input and holds the loaded data HD. Thus, in the second and subsequent frames, the hidden information HD indicating the data bit length stored as hidden information with waveform data of the preceding frame is used as the data length indicating data LENG. By delaying the first key-on pulse KONP1 by 8 system clocks by an 8-stage/1-bit shift register 152, the second key-on pulse KONP2 may be produced.

The hidden bit reproduction circuit 105B and data register 106B for the shift data are of a similar construction to the above described hidden bit reproduction circuit 105A and data register 106A. Difference resides in that an AND gate 145B corresponding to the ANG gate 145 receives the hidden bit control signal HSC for shift data which is produced by the AND gate 114 of FIG. 17, that the initial data supplied to "10" input of a selector 150B is initial shift data ISF and that an AND gate 151B corresponding to the AND gate 151 receives a block end control signal BFC produced by the AND gate 119 of FIG. 17. By this arrangement, hidden bit data HS3, HS2, HS1, HS0 corresponding to the shift data for next block is reproduced and stored in the shift register 148B and this data is loaded in the shift register 149B at the end of the block. Accordingly, shift data SFD for the block which is currently under processing is provided by the shift register 149B.

In FIG. 23, the hidden bit reproduction circuit 105C and data register 106C for the compression coefficient b1 are of a similar construction to the above described hidden bit reproduction circuit 105B and data register 106B. Difference resides in that the bit number of shift registers 148C and 149C is 8 bits, that an AND gate 145C corresponding to the AND gate 145B receives the hidden bit control signal HCb1 for the compression coefficient b1 provided by the AND gate of FIG. 17 and that the initial data applied to "10" input of a selector 150C is an initial compression coefficient ICO corresponding to the compression coefficient b1. The AND gate 151C receives the block end control signal BFC produced by the AND gate 119 of FIG. 17. By this arrangement, hidden bit data HC0–HC7 corresponding to the compression coefficient b1 for next block is reproduced and stored in the shift register 148C and this data is loaded in the shift register 149C at the end of the block. Accordingly, the compression coefficient b1 for the block which is currently under processing is provided by the shift register 149C.

The other hidden bit reproduction circuits 105D, 105E and 105F and data registers 106D, 106E and 106F are of similar construction to the above described hidden bit reproduction circuit 105C and data register 106C. Difference resides in that AND gates 145D, 145E and 145F corresponding to the above described AND gate 145C receive the hidden bit control signals HCb0, HCa1 and HCa0 corresponding to the compression coefficients b0, a1, a0 which are produced by the AND gates 116, 117 and 118 of FIG. 17. By this arrangement, the compression coefficients b0, a1 and a0 for the block which is currently under processing are provided by the registers 106D, 106E and 106F.

An Example of the Compressed Data Demodulation Circuit

Figure 24:
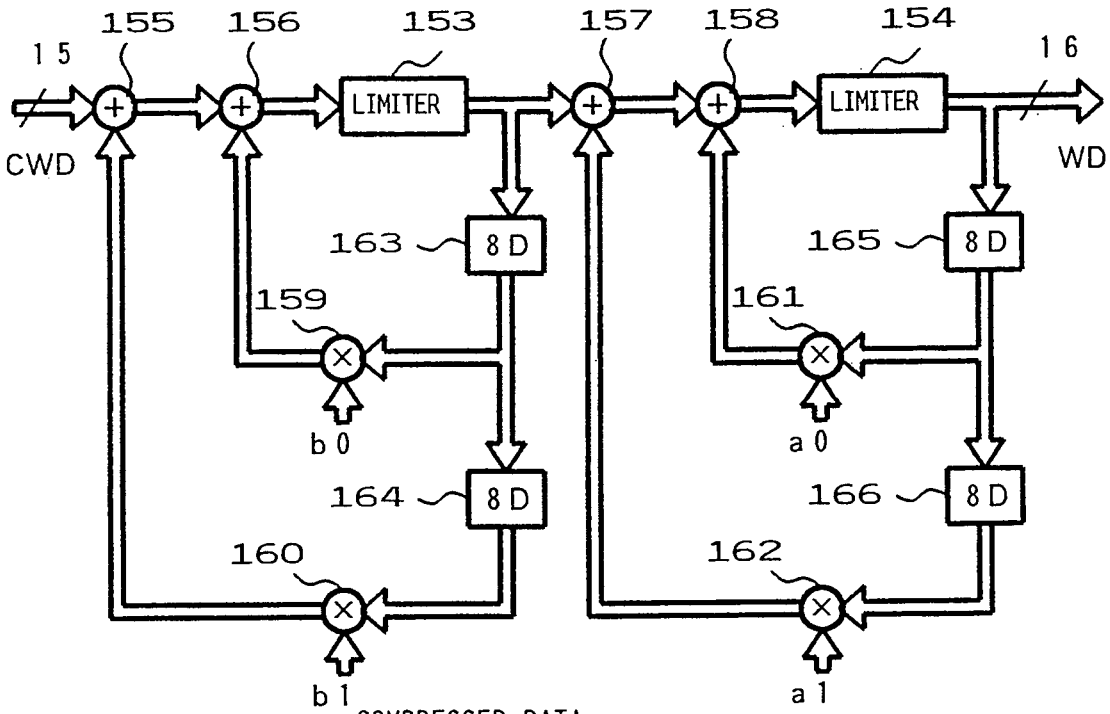
FIG. 24 is a block diagram showing an example of the compressed data demodulation circuit in FIG. 15.

When the waveform data CWD which has been taken out and reproduced by the data takeout and reproduction section 96 is data compressed by the linear prediction coding (LPC) system, an LPC demodulation circuit as shown in FIG. 24 is used as the compressed data demodulation circuit 97 shown in FIG. 15. In the figure, the compressed data demodulation circuit 97 includes limiters 153 and 154, adders 155–158, multipliers 159–162 and 8-stage shift registers 163–166. This is a construction which is reverse to the compression filter circuit in FIG. 7, i.e., the compression coefficients b0, b1 for the second stage are used as demodulation coefficients for the demodulation circuit of the first stage and the compression coefficients a0, a1 for the first stage are used as demodulation coefficients for the demodulation circuit of the second stage.

Another Example of the Compression and Reduction Processings (Second Embodiment)

In the above described embodiment, the data reduction processing by the weight coefficient (shift data) is performed in a stage prior to the data compression processing by the compression filter. The data reduction processing may however be performed after the data compression processing as described below.

Figure 25:
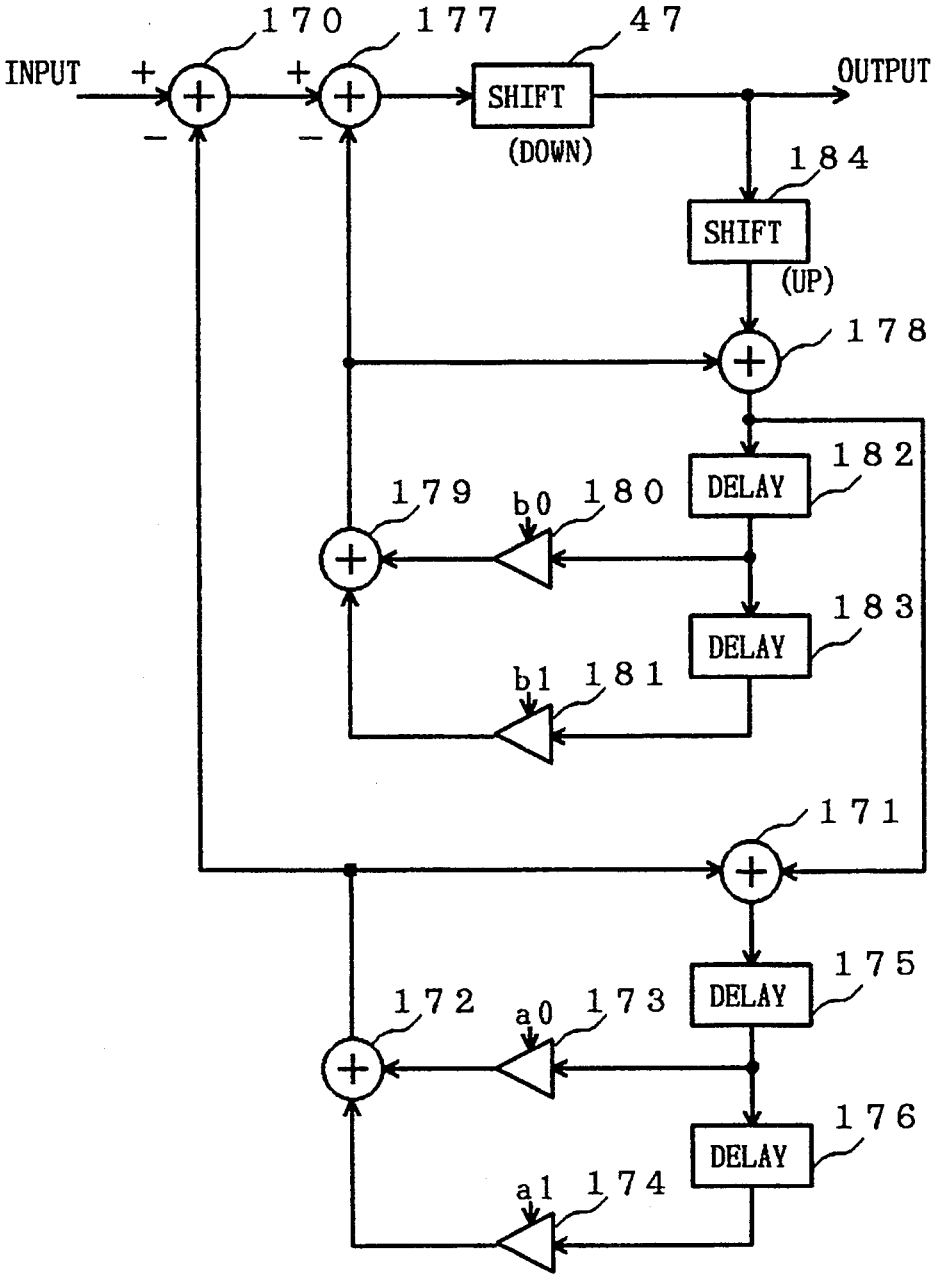
FIG. 25 is a block diagram showing an example in which the shift circuit for the data reduction operation is provided in a post stage of the compression filter section.

FIG. 25 shows an example of a circuit for a compression and reduction operation used for performing the data reduction processing by weight coefficients (shift data) after the data compression processing. The compression filter circuit is made of two cascade-connected secondary filters in the same manner as in the first embodiment. A first stage filter 48A includes a subtractor 170, adders 171 and 172, multipliers 173 and 174 and delay sections 175 and 176. A second stage filter 48B includes a subtractor 177, adders 178 and 179, multipliers 180 and 181 and delay sections 182 and 183. Waveform data to be compressed is applied to the subtractor 170 of the first stage filter 48A and convolution sum of the second degree by the coefficients a0, a1 is subtracted by the subtractor 170. The output of the subtractor 177 of the second stage filter 48B is the output signal of the compression filter. This compression filter output signal is applied to a shift circuit 47 and weighted (shifted) in the direction in which it is reduced by the weight coefficient (shift data). The output of the shift circuit 47 is temporarily stored by a block buffer 55 as waveform sample data which has been subjected to the compression and reduction processings and thereafter is written in a waveform memory 15.

A shift circuit 184 shifts data by the same amount in a direction opposite to the shift direction of the shift circuit 47 thereby simulating restoration of weight during reproduction of the data. The output of the shift circuit 184 is applied to the delay sections 175, 176, 182 and 183 through the adders 178 and 171 whereby multiplication of the compression coefficients is made with respect to the signal which has simulated the weight restoration during reproduction. By this arrangement, an accurate compression filter operation by which a data discarding error due to the data shift down has been absorbed can be achieved.

Figure 26:
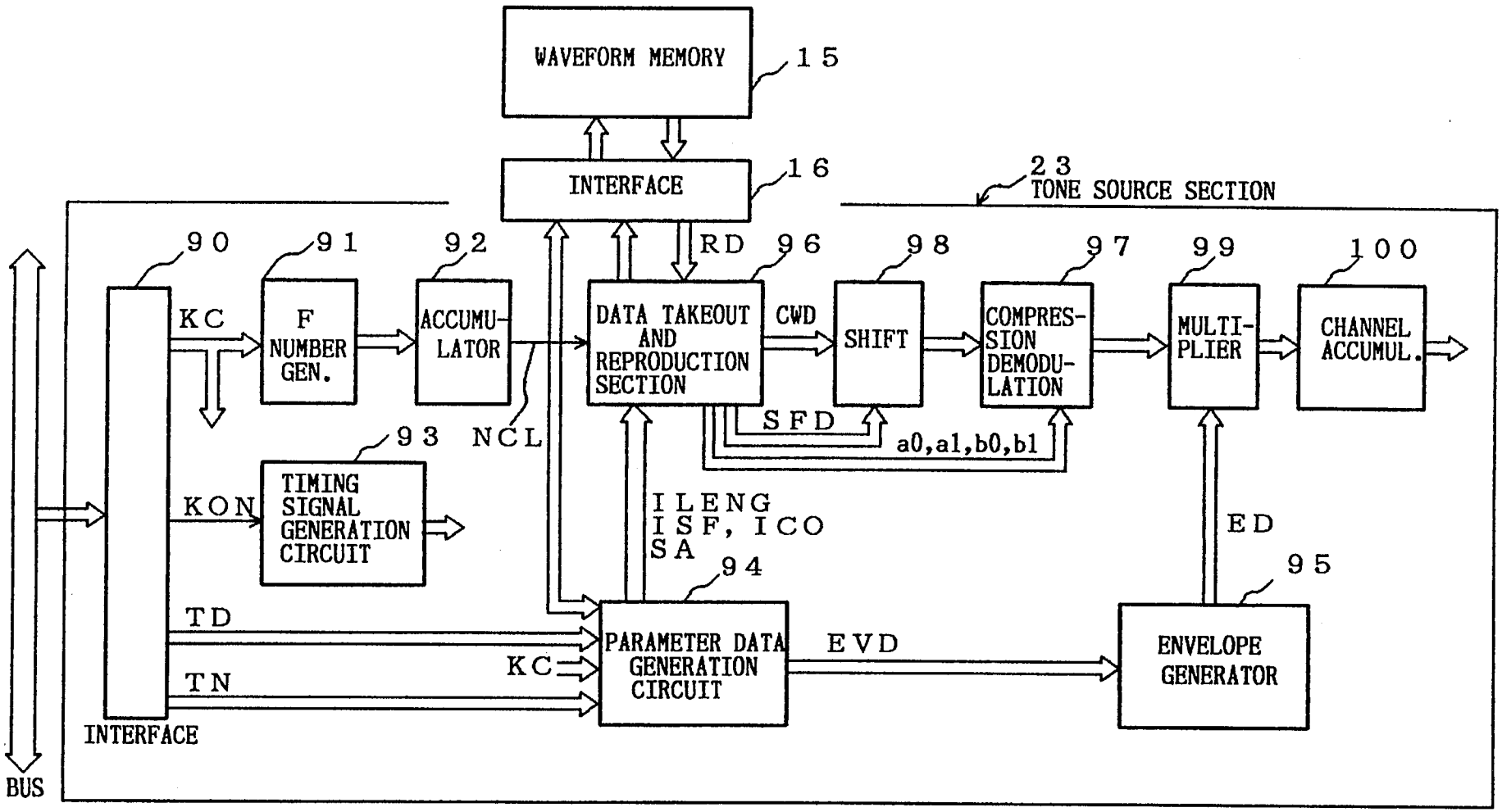
FIG. 26 is a block diagram showing an example of a tone source section for reproducing waveform data to which the compression and reduction processings have been applied according to the example of FIG. 25.

In this second embodiment, the compression filter coefficients a0, a1, b0, b1 may be calculated in the same manner as in the first embodiment. Since the position of the shift circuit 47 is different, it is not possible to apply the functional block diagram of FIG. 5 directly to the second embodiment. However, the shift circuit 47 and compression filter section 48 in FIG. 5 may be suitably modified so that the construction of FIG. 25 may be realized. In the second embodiment, the steps of demodulation of compressed data during reproduction and weight restoration are reverse to the first embodiment. Therefore, as shown in FIG. 26, the construction of the tone source section 23 may be modified so that the shift circuit 98 is disposed in a stage prior to the compressed data demodulation circuit 97.

Modified Embodiments

Execution of the data reduction processing is not limited to either prior stage or post stage of the data compression processing but the data reduction processing by weight coefficients (shift data) may be executed both in prior and post stages of the data compression processing. The data reduction processing by weight coefficients (shift data) may also be inserted in some stage of the data compression processing.

The weighting operation is not limited to shift data but multiplication or division may also be used for the weighting operation.

The division of waveform sections is not limited to one according to which data consists of blocks and frames as in the above described embodiments but any manner of dividing data into sections may be employed.

The data bit length need not necessarily be variable but it may be fixed. Waveform data need not necessarily be packed in a memory as in the above described embodiments. Control data for reproduction (i.e., compression coefficients and weight coefficients) need not necessarily be provided in the form of hidden bit data but it may be provided separately in a suitable manner.

The data compression system is not limited to the LPC system but any other system such as DPCM, ADPCM and delta modulation may be employed.

In the above described embodiments, the invention has been applied to tone waveform data. The invention is not limited to this but it is also applicable to various waveform data in an electronic musical instrument such as various control data which change timewise such as envelope waveform data for setting a tone volume level, envelope waveform data for various control purposes and filter coefficients. The invention is applicable not only to waveform data in an electronic musical instrument but to compression of waveform data in other voice signal or sound signal processing devices.

In the above described embodiments, for taking out and reproducing data for one sample, multi-stage processing steps including sample counting, data length counting, address counting, data position reproduction and hidden bit reproduction are required in the data takeout and reproduction section and these processing steps are executed at a timing of one sample. This may sometimes require a relatively long time for one sample. For solving this problem, a processing over plural sampling timings may be executed by a pipe line processing method in the same channel timing. Time for one sample will thereby be shortened and data reading speed will be improved.

This invention is applicable not only to a single completed electronic musical instrument but also to a part of a moduled electronic musical instrument. The invention is also applicable to a device which has no keyboard or switch means for selecting tones but generates a tone on the basis of input code information. Further, the invention is applicable to a device which has no device for generating a tone signal or a loudspeaker for sounding a tone but generates data for forming or controlling a tone signal. The term "electronic musical instrument" is used herein in the broadest sense of the term. The invention is applicable also to a general sound signal processing device or a general voice signal processing device. The invention is applicable not only to compression of waveform data but to compression of digital data for tone control or sound control.

From the standpoint of variable bit length treatment processing, the data compression processing and data reduction processing using the weight coefficient operation as in the above described embodiments are not essential in the invention. That is, the invention is applicable to compression of the bit size of digital data which is not subjected to any particular data compression processing.

As described in the foregoing, according to the invention, a predetermined data compression processing is performed for waveform data and, in some stage before or after the data compression processing, a processing is performed for further reducing the value of waveform data in accordance with a desired weight coefficient. The value of waveform data compressed by the data compression processing therefore is further reduced whereby data compression is further advanced. Moreover, a control for changing the rate of reduction by changing the weight coefficient or not reducing the value at all can be made readily and freely. Accordingly, implementation of data compression to a further degree in a part of waveform and implementation of data compression of different degrees for different sections of waveform can be realized in a simple manner by only changing the weight coefficient and without changing the system of predetermined compression processing. Besides, the processing of the invention is a very simple processing of reducing the value of waveform data in accordance with a desired weight coefficient (this processing can be made by a suitable coefficient operation, e.g., data shifting, division or multiplication) and, accordingly, the construction for realizing this can be a simple one.

Furthermore, according to the invention, waveform sample data consisting of multiple samples or other tone control digital data is divided into plural sections consisting of plural samples, the maximum value of effective bit number of the data is detected for each section, each data is adjusted to a bit number corresponding to the detected maximum value for each section, and data which is adjusted in its bit number for each section is stored in a memory. The bit size of the data therefore can be compressed in the most efficient manner. Furthermore, this arrangement enables saving of the capacity of the memory and the most efficient use of the memory.

What is claimed is:

1. A method for use in a digital musical tone generating apparatus comprising the steps of:

providing digital waveform data to be used as a musical sound source wherein said waveform data comprises a plurality of data items, each having plural bits;

performing a predetermined data compression processing on the waveform data;

providing a weight coefficient;

performing a data reduction processing for reducing a value of the waveform data in accordance with said weight coefficient at least at one stage selected from a stage in time before the data compression processing is performed, a stage when the data compression processing is being performed and a stage after the data compression processing has been completed; and storing in a waveform memory the waveform data on which the data compression processing and the data reduction processing have been performed.

2. A method as defined in claim 1 wherein data reduction processing step is performed at a stage before the data compression processing step and the data compression processing step is performed using a data compression filter.

3. A method as defined in claim 1 wherein data reduction processing step is performed at a stage after the data compression processing step and the data compression processing step is performed using a data compression filter.

4. A method as defined in claim 1 wherein said data reduction processing step comprises:

dividing said waveform data into a plurality of sections wherein each of said sections includes at least one data item;

providing weight coefficients for each of said said plural sections;

and wherein the reduction processing is performed for each of the sections in accordance with a respective weight coefficient for each of the sections.

5. A method as defined in claim 4 wherein:

said reduction processing step further comprises designating a bit number corresponding to the maximum number of bits in any one data item for each of the sections; and setting the weight coefficient for each of the sections in such a manner that data for each of the sections after the data compression and reduction processings have been completed is of a bit number designated by said bit number for the section.

6. A method as defined in claim 1 wherein the data reduction processing step is performed by data shifting.

7. A method as defined in claim 1 wherein:

the data compression processing step is performed by a two-stage compression filter;

the data compression processing step comprises the steps of:

preparing filter coefficients to be used in the compression filter by a linear prediction method, said coefficient preparation step comprising multiplying waveform data to be applied to a first stage of the compression filter with a humming window function, generating a first linear prediction coefficient on the basis of a self-correlation coefficient which is a result of the multiplication and providing the first linear prediction coefficient as a filter coefficient of the compression filter of the first stage;

performing the waveform data compression processing by the compression filter of the first stage, using the first linear prediction coefficient as the filter coefficient of the compression filter of the first stage; and multiplying output waveform data of the compression filter of the first stage with a humming window function, calculating a second linear prediction coefficient on the basis of a self-correlation coefficient, said self-correlation coefficient being a result of the multiplication and providing the second linear prediction coefficient as a filter coefficient of the compression filter of the second stage.

8. A method as defined in claim 1 wherein said memory comprises a plurality of addresses, said method further comprising:

generating and storing data indicating a memory address of the series of waveform data in the memory, when the data compression processing and the data reduction processing for a series of waveform data have been completed.

9. A musical tone generating device comprising:

means for acquiring waveform data, said waveform data to be used as a musical sound source and said waveform data comprising a plurality of data items, each having plural bits;

weight coefficient providing means;

reduction operation means for inputting waveform data to be compressed and performing an operation for reducing a value of the waveform data in accordance with a weight coefficient provided by the weight coefficient providing means;

coefficient generation means for producing a filter coefficient;

compression filter means for inputting waveform data provided by the reduction operation means and inputting the filter coefficient produced by the coefficient generation means and performing a data compression processing on the waveform data using a linear prediction method; and memory means for storing waveform data on which the data compression processing and the data reduction processing have been performed.

10. A device as defined in claim 9 wherein the compression filter means comprises:

means for dividing a series of waveform data into plural sections, wherein each of the sections comprises at least one data item;

means for providing filter coefficients for each of the sections, wherein each filter coefficient is set independently for each of the sections;

means for performing the data compression processing on each of the sections in accordance with its respective filter coefficient;

a delay section;

memory means for temporarily holding data which is held in the delay section when the data compression processing for one section has been completed; and control means for reading, with respect to a certain section, data for an immediately preceding section held by the memory means and setting the read out data in the delay section of the compression filter means for enabling re-performing of the data compression processing with respect to the certain section.

11. A device as defined in claim 9 wherein:

the reduction operation means comprises:

means for dividing a series of waveform data into plural sections;

means for providing a weight coefficient for each of the sections;

means for performing the data reduction processing independently for each of the sections in accordance with its respective weight coefficient; and said memory means further comprises means for storing waveform data for each of the sections on which the data compression processing and the data reduction processing have been performed and also storing the respective weight coefficient for each of the sections.

12. A device as defined in claim 11 wherein, in the memory means, the weight coefficient for each of the sections is stored in a part of a memory region storing waveform data for a section which precedes the section.

13. A device as defined in claim 12 further comprising:

means for providing filter coefficients for each of the sections, wherein each filter coefficient is independently set for each of the sections; and wherein:

the compression filter means further comprises means for performing the data compression processing independently for each of the sections in accordance with the respective filter coefficient: and the memory means further comprises means for storing the filter coefficient for each of the sections in a part of a memory region storing waveform data for a preceding section and for storing the filter coefficient for the first section in a header section memory.

14. A device as defined in claim 9 further comprising:

setting means for setting a bit limiting number which designates a maximum number of bits in any one data item; and wherein:

said weight coefficient providing means comprises a control means for setting the weight coefficient in such a manner that the data items after the data compression processing and the data reduction processing have a bit number designated by said bit limiting number.

15. A device as defined by claim 14 wherein the control means further comprises:

means for setting the weight coefficient to a predetermined value;

means for changing the weight coefficient automatically to re-perform the data compression processing and the data reduction processing when at least one of the data items after the data compression processing and the data reduction processing is of a bit number which is not less than said bit limiting number.

16. A waveform data compression device comprising:

means for acquiring waveform data, said waveform data to be used as a musical sound source wherein said waveform data comprising a plurality of data items, each of said data items having plural bits;

coefficient generation means for producing a filter coefficient;

compression filter means for inputting waveform data to be compressed and performing a data compression processing on the waveform data by a linear prediction method utilizing the filter coefficient;

weight coefficient providing means;

reduction operation means for performing an operation for reducing a value of waveform data provided by the compression filter means in accordance with a weight coefficient provided by the weight coefficient providing means;

memory means for storing waveform data on which the data compression processing and the data reduction processing have been performed.

17. A device as defined in claim 16 wherein the compression filter means comprises:

means for dividing a series of waveform data into plural sections, wherein each of the sections comprises at least one data item;

means for providing filter coefficients for each of the sections, wherein each filter coefficient is set independently for each of the sections;

means for performing the data compression processing on each of the plural sections in accordance with its respective filter coefficient;

a delay section;

memory means for temporarily holding data which is held in the delay section when the data compression processing for one section has been completed; and control means for reading, with respect to a certain section, data for an immediately preceding section held by the memory means and setting the read out data in the delay section of the compression filter means for enabling the re-performing of the data compression processing with respect to the certain section.

18. A device as defined in claim 16 wherein:

the reduction operation means comprises:

means for dividing a series of waveform data into plural sections, wherein each of said sections comprises at least one data item;

means for providing a weight coefficient for each of the plural sections, wherein each weight coefficient is set independently for each of the sections;

means for performing the data reduction processing for each of the sections in accordance with its respective weight coefficient; and said memory means further comprises means for storing waveform data for each of the sections on which the data compression processing and the data reduction processing have been performed and also storing the respective weight coefficient for each of the sections.

19. A device as defined in claim 18 wherein said memory means further comprises a plurality of memory regions wherein the respective weight coefficient for each of the sections is stored in a part of a memory region storing waveform data for a preceding section and the weight coefficient for the first section is stored in a header section.

20. A device as defined in claim 19 further comprising:

means for providing filter coefficients for each of the sections, wherein each filter coefficient is set independently for each of the sections; and wherein:

the compression filter means further comprises means for performing the data compression processing independently for each of the sections in accordance with the respective filter coefficient which is set independently for each of the sections; and the memory means further comprises means for storing the filter coefficient for each of the sections in a part of a memory region storing waveform data for a preceding section and for storing the filter coefficient for the first section in a header section memory.

21. A device as defined in claim 16 further comprising:

setting means for setting a desired bit limiting number which designates a limited number of bits in one sample data; and control means for automatically setting the weight coefficient in such a manner that data after the data compression processing and the data reduction processing is of a bit number designated by said bit limiting number.

22. A device as defined in claim 21 wherein the control means further comprises:

means for setting the weight coefficient to a predetermined value;

means for changing the weight coefficient automatically to re-perform the data compression processing and the data reduction processing when data after the data compression processing and the data reduction processing is of a bit number which is not within said bit limiting number.

23. A method for compressing musical waveform data for use in a music processing apparatus comprising:

providing digital waveform sample data comprising plural data items each of which comprises plural bits;

dividing the waveform sample data into plural sections each of the sections comprising plural data items;

detecting a maximum effective number of bits in any one data item for each of the sections; and adjusting the bit number of waveform sample data from the providing step in such a manner that the maximum number of bits in each of the data items in any section is no more than the maximum effective number of bits detected for the data items in that section; and storing the adjusted waveform sample data in memory means.

24. A method as defined in claim 23 further comprising storing data indicating the maximum number of bits for each of the sections in said memory means.

25. A method as defined in claim 24 wherein and said storing data indicating the maximum number of bits step comprises storing each of the sections in the memory means and storing the data indicating the maximum number of bits for any given section other than the first section in a part of the memory means storing waveform sample data for a preceding section.

26. A method as defined in claim 23 which further comprises performing a data compression processing on the waveform sample data provided by the providing step, and wherein, the detecting step is performed for the waveform sample data which has been compressed in the performing data compression processing step.

27. A method for compressing digital musical waveform data for use in a music processing apparatus comprising:

providing digital waveform sample data comprising plural data items each of which comprises plural bits;

dividing the waveform sample data into plural block sections each of the sections comprising plural data items;

performing a data compression processing for each of the block sections to produce compressed waveform data;

dividing the compressed waveform sample data of each of the block sections into plural frame sections each comprising plural data items;

detecting a maximum effective number of bits in any one data item for each of the frame sections; and adjusting the compressed waveform sample data in such a manner that the maximum number of bits in each of the data items in any frame section is no more than the maximum effective number of bits detected for the data items in that frame section; and storing the adjusted waveform sample data in a memory means.

28. A method as defined in claim 27 further comprising:

providing a weight coefficient for each of the block sections;

reducing a value of the waveform sample data in accordance with said weight coefficient for each of the block sections, at least at one stage selected from a stage in time before the data compression processing is performed, a stage when the data compression processing is being performed and a stage after the data compression processing has been completed.

29. A method as defined in claim 27 further comprising storing a weight coefficient for each of the block sections and storing data indicating for each frame section the maximum number of bits for the data items the frame section contains.

30. A method as defined in claim 29 wherein the storing a weight coefficient step further comprises:

storing the weight coefficient for each of the block sections after the first block section in a part of the memory in which waveform sample data for a block section which precedes the block section is stored and storing the data indicating the maximum number of bits for the data items in each frame section after the first frame section in a part of the memory storing waveform sample data for a preceding frame section.

31. A method for compressing digital data for a tone control comprising:

a first step for providing digital data said digital data comprising plural data items each of which comprises plural bits;

a second step for dividing the digital data into plural sections each comprising plural data items and for detecting a maximum value of effective bit number of the digital data for each of the sections; and a third step for adjusting the digital data provided by the first step in such a manner that the digital data for each of the sections has a bit number corresponding to the maximum value which has been detected for each of the sections in the second step and for storing the adjusted digital data in memory means.

32. A method as defined in claim 31 which further comprises a fourth step for performing a data compression processing on the digital data provided by the first step and wherein, in the second step, the processing for detecting the maximum value of effective bit number is performed on the digital data which has been compressed in the fourth step.

33. A musical tone generating apparatus comprising:

inputting means for receiving waveform data to be recorded;

filter coefficient providing means for providing a filter coefficient corresponding to the waveform data;

compression filter means for receiving said waveform data and said filter coefficient and for performing a data compression processing on said waveform data in accordance with said filter coefficient to generate compressed waveform data items having less than the fixed number of bits;

a waveform memory for storing data of a fixed number of bits per memory address; and recording means for recording the compressed waveform data items into said waveform memory in a packed fashion in which some data items are recorded in memory areas spanning plural memory addresses.

34. The musical tone generating apparatus of claim 33 wherein said filter coefficient providing means further comprises:

first digital processing means for analyzing said waveform data; and second digital processing means for generating said filter coefficient responsive to said first digital processing means.

35. The musical tone generating apparatus of claim 33 wherein said compression filter means comprises a means for compressing the waveform data using a linear predictive procedure using said filter coefficient provided by said filter coefficient providing means.

36. The musical tone generating apparatus of claim 33 wherein:

said compressed waveform data comprises a plurality of blocks sections, each of said block sections having a respective filter coefficient; and said filter coefficient providing means provides said respective filter coefficient for at least one of said block sections.

37. The musical tone generating apparatus of claim 33 wherein:

said compressed waveform data comprises a plurality of a plurality of frame sections and wherein each of said frame sections comprises a plurality of data items;

each of said data items has an associated maximum value corresponding to a bit number and each of said data items within any given frame section has the same maximum value;

said recording means comprises:

detecting means for detecting the maximum value of the compressed waveform data for each of said frame sections;

shortening means for shortening the bit number of each of the data items in each of said frames in accordance with the maximum value associated with the data items in the frame to produce shortened data items.

38. The musical tone generating apparatus of claim 37 wherein said recording means further comprises:

packing means for packing said shortened data items closely to generate packed data, said packed data comprising a fixed number of bits corresponding to said maximum value associated with each of said data items;

writing means for writing packed data into said waveform memory.

39. The musical tone generating apparatus of claim 38 wherein said recording means further comprises:

counting means for accumulating the number of bits of said packed shortened data items;

writing means for writing said packed data into said waveform memory each time said accumulated value exceeds a desired level.

40. The musical tone generating apparatus of claim 37 wherein said recording means further comprises:

arranging means for generating an arranged frame section which includes at least its corresponding shortened data items and the maximum value of the shortened data items of the following frame section; and writing means for writing said arranged frame section into said waveform memory.

41. A musical tone generating apparatus comprising:

providing means for providing waveform data to be recorded;

filter coefficient providing means for providing a filter coefficient corresponding to the waveform data;

compression filter means comprising:

receiving means for receiving said waveform data and said filter coefficient;

compression means for performing a data compression processing on said waveform data in accordance with said filter coefficient and for generating compressed waveform data, wherein said compressed waveform data comprises a plurality of blocks wherein each of said blocks comprises a plurality of frames and wherein each of said frames has an associated shortening bit number;

a waveform memory for storing waveform data of a fixed number of bits; and recording means for recording the compressed waveform data into said waveform memory comprising:

means for recording in said waveform memory each of said blocks in series and each of said frames in series;

means for recording in said waveform memory the shortening bit number for at least one of said frames intermixed with the preceding frame.

42. The musical tone generating apparatus of claim 41 wherein:

each of said blocks has an associated weight coefficient; and said recording means further comprises means for recording in said digital waveform memory the weight coefficient for at least one of said blocks closely with one of the frames of the preceding block.

43. The musical tone generating apparatus of claim 41 wherein:

each of said blocks has at least one associated compression coefficient; and said recording means further comprises means for recording in said digital waveform memory said at least one compression coefficient for at least one of said blocks mixedly with at least one of the frames of the preceding block.

44. A digital musical tone generating apparatus comprising:

means for generating bit-shortened compressed waveform data;

a waveform memory for storing said bit-shortened compressed waveform data;

reading means comprising:

retrieving means for retrieving said bit-shortened compressed waveform data from said waveform memory;

extending means for generating extended waveform data of a predetermined bit length wherein said extending means comprises means for expanding the bit-length of said waveform data to said predetermined bit length;

coefficient providing means for providing a demodulation filter coefficient; and demodulation filter means comprising:

receiving means for receiving said extended waveform data and said demodulation coefficient;

demodulation means for performing a data demodulation on said extended waveform data in accordance with said demodulation coefficient and for generating reproduced waveform data; and output means for outputting said reproduced waveform data.

45. The musical tone generating apparatus of claim 44 wherein said means for generating bit-shortened compressed waveform data comprises a compression filter means for compressing the waveform data using a linear predictive procedure using said coefficient.

46. The musical tone generating apparatus of claim 44 wherein:

said means for generating bit-shortened compressed waveform data comprises:

weight coefficient providing means for providing a desired weight coefficient; and means for performing an operation for reducing a value of said waveform data in accordance with said weight coefficient; and said musical tone generating apparatus further comprises a restoring means, said restoring means comprising:

means for receiving said reproduced waveform data from said demodulation means;

means for restoring said value of the reproduced waveform data corresponding to said weight coefficient and generating restored waveform data; and means for outputting said restored waveform data.

47. The musical tone generating apparatus of claim 44 wherein:

said means for generating bit-shortened compressed waveform data comprises:

weight coefficient providing means for providing a desired weight coefficient; and means for performing an operation for reducing a value of said waveform data in accordance with said weight coefficient;

said musical tone generating apparatus further comprises a restoring means, said restoring means comprising:

means for receiving said extended waveform data from said extending means;

means for restoring said value of the reproduced waveform data corresponding to said weight coefficient and generating restored waveform data; and means for outputting said restored waveform data; and said receiving means in said demodulation filter means receives said restored waveform data; and said demodulation means in said demodulation filter means performs said data demodulation on said restored waveform data.

48. The musical tone generating apparatus of claim 44 further wherein:

said compressed waveform data comprises a plurality of blocks sections, each of said block sections having a respective filter coefficient; and said coefficient providing means provides said respective filter coefficient for at least one of said block sections.

49. The musical tone generating apparatus of claim 44 wherein:

said waveform memory comprises a plurality of addresses for storing data, each of said addresses comprising means for storing a fixed number of bits of data;

said waveform memory comprises means for storing said bit-shortened compressed waveform data in a data format comprising said fixed number of bits.

50. The musical tone generating apparatus of claim 49 wherein said waveform memory comprises means for storing said compressed waveform data organized into a plurality of frame sections, wherein each of said frame sections comprises a plurality of data items, and wherein each of said data items has an associated maximum value and each of said data items within any given frame has the same maximum value.

51. The musical tone generating apparatus of claim 50 wherein said coefficient providing means comprises means for supplying length data designating said fixed number of bits of data of each of said data items and said extending means further comprises means for generating waveform data in accordance with said length data.

52. A digital musical tone generating apparatus comprising:

means for generating bit-shortened compressed waveform data;

a waveform memory for storing said bit-shortened compressed waveform data;

reading means for retrieving said bit-shortened compressed waveform data from said waveform memory;

coefficient providing means for providing a demodulation filter coefficient and a bit-value coefficient;

demodulation means for performing data demodulation processing on said waveform data in accordance with said demodulation coefficient.

* * * * *